US012264862B2

(12) United States Patent
Lee et al.

(10) Patent No.: US 12,264,862 B2
(45) Date of Patent: Apr. 1, 2025

(54) REFRIGERATOR

(71) Applicant: LG ELECTRONICS INC., Seoul (KR)

(72) Inventors: Donghoon Lee, Seoul (KR); Wookyong Lee, Seoul (KR); Sunggyun Son, Seoul (KR); Donghoon Lee, Seoul (KR); Seungseob Yeom, Seoul (KR); Yongjun Bae, Seoul (KR); Chongyoung Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/432,820

(22) Filed: Feb. 5, 2024

(65) Prior Publication Data

US 2024/0175620 A1 May 30, 2024

Related U.S. Application Data

(63) Continuation of application No. 17/281,786, filed as application No. PCT/KR2019/012861 on Oct. 1, 2019, now Pat. No. 11,971,204.

(30) Foreign Application Priority Data

Oct. 2, 2018 (KR) ..... 10-2018-0117785
Oct. 2, 2018 (KR) ..... 10-2018-0117819
(Continued)

(51) Int. Cl.
*F25C 1/24* (2018.01)
*F25C 5/08* (2006.01)

(52) U.S. Cl.
CPC ..... *F25C 1/24* (2013.01); *F25C 5/08* (2013.01); *F25C 2400/10* (2013.01); *F25C 2400/14* (2013.01); *F25C 2600/04* (2013.01)

(58) Field of Classification Search
CPC ..... F25C 1/24; F25C 5/08; F25C 2400/10; F25C 2400/14; F25C 2600/04
See application file for complete search history.

(56) References Cited

U.S. PATENT DOCUMENTS 6,438,988 B1 8/2002 Paskey
9,234,689 B2 1/2016 Son et al.
(Continued)

FOREIGN PATENT DOCUMENTS

CN 102878743 1/2013
CN 103033011 4/2013
(Continued)

OTHER PUBLICATIONS

International Search Report (with English Translation) dated Jan. 22, 2020 issued in Application No. PCT/KR2019/012861.
(Continued)

*Primary Examiner* — Elizabeth J Martin
(74) *Attorney, Agent, or Firm* — KED & ASSOCIATES, LLP

(57) ABSTRACT

The refrigerator according to the present invention may comprise: a first tray assembly forming a part of ice-making cells; and a second tray assembly forming the other part of the ice-making cells. In order that ice can be produced in the direction of ice-making cells formed by any one of the first and second tray assemblies to ice-making cells formed by the other tray assembly, following the start of an ice-making process, the one tray assembly comprises a first part, and the first part comprises: a first surface forming a part of the ice-making cells; and a first deformation-resistant reinforcement part extending from the first surface in the vertical direction away from a heater.

20 Claims, 44 Drawing Sheets

(30) Foreign Application Priority Data

| | | |
|---|---|---|
| Oct. 2, 2018 | (KR) | 10-2018-0117821 |
| Oct. 2, 2018 | (KR) | 10-2018-0117822 |
| Nov. 16, 2018 | (KR) | 10-2018-0142117 |
| Jul. 6, 2019 | (KR) | 10-2019-0081741 |
| Jul. 6, 2019 | (KR) | 10-2019-0081749 |

(56) References Cited

U.S. PATENT DOCUMENTS

| | | | | |
|---|---|---|---|---|
| 9,581,372 | B2 | 2/2017 | Lee et al. | |
| 2010/0313594 | A1 | 12/2010 | Lee et al. | |
| 2013/0014535 | A1 | 1/2013 | Son et al. | |
| 2013/0014536 | A1* | 1/2013 | Son | F25C 1/25 62/340 |
| 2013/0081412 | A1 | 4/2013 | Son et al. | |
| 2013/0327082 | A1 | 12/2013 | Son et al. | |
| 2014/0165598 | A1 | 6/2014 | Boarman | |
| 2014/0167321 | A1 | 6/2014 | Culley et al. | |
| 2014/0182325 | A1 | 7/2014 | Lee et al. | |
| 2016/0245574 | A1 | 8/2016 | Jeong et al. | |
| 2018/0187941 | A1 | 7/2018 | An et al. | |
| 2018/0335240 | A1 | 11/2018 | Jeong | |
| 2019/0219317 | A1 | 7/2019 | Yoon et al. | |
| 2021/0095910 | A1 | 4/2021 | Jeon | |
| 2021/0364211 | A1* | 11/2021 | Xue | F25C 1/04 |

FOREIGN PATENT DOCUMENTS

| | | |
|---|---|---|
| CN | 106257212 | 12/2016 |
| CN | 108444160 | 8/2018 |
| EP | 3059526 | 8/2016 |
| JP | H01-230969 | 9/1989 |
| JP | H05-203299 | 8/1993 |
| JP | H05-203302 | 8/1993 |
| JP | H06-70543 | 9/1994 |
| JP | 09-269172 | 10/1997 |
| JP | 2001-289544 | 10/2001 |
| JP | 2002-350019 | 12/2002 |
| JP | 2005-326035 | 11/2005 |
| JP | 2010-051715 | 3/2010 |
| JP | 4572833 | 11/2010 |
| JP | 2011-064371 | 3/2011 |
| JP | 2011-064373 | 3/2011 |
| JP | 2011-237077 | 11/2011 |
| JP | 2013-032871 | 2/2013 |
| KR | 20-0145881 | 6/1999 |
| KR | 10-2005-0041252 | 5/2005 |
| KR | 10-2005-0069319 | 7/2005 |
| KR | 10-2005-0096336 | 10/2005 |
| KR | 10-2009-0079377 | 7/2009 |
| KR | 10-0935746 | 1/2010 |
| KR | 10-2010-0133155 | 12/2010 |
| KR | 10-2012-0003233 | 1/2012 |
| KR | 10-2013-0009332 | 1/2013 |
| KR | 10-2013-0009521 | 1/2013 |
| KR | 10-2014-0088321 | 7/2014 |
| KR | 10-2016-0046551 | 4/2016 |
| KR | 10-1643635 | 7/2016 |
| KR | 10-2017-0052235 | 5/2017 |
| KR | 10-1850918 | 5/2018 |
| KR | 10-2018-0093666 | 8/2018 |
| KR | 10-2018-0100752 | 9/2018 |

OTHER PUBLICATIONS

Chinese Office Action dated Jun. 6, 2022 in Application No. 201980064153.3.

Extended European Search Report dated Jun. 28, 2022 in Application No. 19869401.0.

Korean Office Action dated May 1, 2023 issued in Application No. 10-2018-0117785.

Korean Office Action dated May 8, 2023 issued in Application No. 10-2018-0117819.

Korean Office Action dated May 14, 2023 issued in Application No. 10-2018-0117821.

Korean Office Action dated May 15, 2023 issued in Application No. 10-2018-0117822.

Korean Office Action dated Jul. 4, 2023 issued in Application No. 10-2018-0142117.

Korean Office Action dated Nov. 7, 2023 issued in Application No. 10-2018-0117821.

Korean Office Action dated Jan. 10, 2024 issued in Application No. 10-2018-0142117.

U.S. Office Action dated Apr. 21, 2023 issued in U.S. Appl. No. 17/281,786.

U.S. Office Action dated Sep. 13, 2023 issued in U.S. Appl. No. 17/281,786.

Korean Office Action dated Mar. 12, 2024 issued in Application No. 10-2018-0117822.

Korean Office Action dated Jun. 19, 2024 issued in Application No. 10-2018-0117819.

Korean Office Action dated Aug. 12, 2024 issued in Application No. 10-2018-0117822.

Korean Notice of Allowance dated Nov. 19, 2024 issued in Application No. 10-2024-0018570.

* cited by examiner

REFRIGERATOR

CROSS-REFERENCE TO RELATED PATENT APPLICATIONS

This application is a continuation of U.S. patent application Ser. No. 17/281,786, filed Mar. 31, 2021, which is a U.S. National Stage Application under 35 U.S.C. § 371 of PCT Application No. PCT/KR2019/012861, filed Oct. 1, 2019, which claims priority to Korean Patent Application Nos. 10-2018-0117819 (filed Oct. 2, 2018), 10-2018-0117821 (filed Oct. 2, 2018), 10-2018-0117822 (filed Oct. 2, 2018), 10-2018-0117785 (filed Oct. 2, 2018), 10-2018-0142117 (filed Nov. 16, 2018), 10-2019-0081749 (filed Jul. 6, 2019), and 10-2019-0081741 (filed Jul. 6, 2019), whose entire disclosures are hereby incorporated by reference.

TECHNICAL FIELD

The present disclosure relates to a refrigerator.

BACKGROUND ART

In general, refrigerators are home appliances for storing foods at a low temperature in a storage chamber that is covered by a door. The refrigerator may cool the inside of the storage space by using cold air to store the stored food in a refrigerated or frozen state. Generally, an ice maker for making ice is provided in the refrigerator. The ice maker makes ice by cooling water after accommodating the water supplied from a water supply source or a water tank into a tray. The ice maker may separate the made ice from the ice tray in a heating manner or twisting manner. As described above, the ice maker through which water is automatically supplied, and the ice automatically separated may be opened upward so that the mode ice is pumped up. As described above, the ice made in the ice maker may have at least one flat surface such as crescent or cubic shape.

When the ice has a spherical shape, it is more convenient to use the ice, and also, it is possible to provide different feeling of use to a user. Also, even when the made ice is stored, a contact area between the ice cubes may be minimized to minimize a mat of the ice cubes.

An ice maker is disclosed in Korean Registration No. 10-1850918 (hereinafter, referred to as a "prior art document 1") that is a prior art document.

The ice maker disclosed in the prior art document 1 includes an upper tray in which a plurality of upper cells, each of which has a hemispherical shape, are arranged, and which includes a pair of link guide parts extending upward from both side ends thereof, a lower tray in which a plurality of upper cells, each of which has a hemispherical shape and which is rotatably connected to the upper tray, a rotation shaft connected to rear ends of the lower tray and the upper tray to allow the lower tray to rotate with respect to the upper tray, a pair of links having one end connected to the lower tray and the other end connected to the link guide part, and an upper ejecting pin assembly connected to each of the pair of links in at state in which both ends thereof are inserted into the link guide part and elevated together with the upper ejecting pin assembly.

In the prior art document 1, although the spherical ice is made by the hemispherical upper cell and the hemispherical lower cell, since the ice is made at the same time in the upper and lower cells, bubbles containing water are not completely discharged but are dispersed in the water to make opaque ice.

An ice maker is disclosed in Japanese Patent Laid-Open No. 9-269172 (hereinafter, referred to as a "prior art document 2") that is a prior art document.

The ice maker disclosed in the prior art document 2 includes an ice making plate and a heater for heating a lower portion of water supplied to the ice making plate. In the case of the ice maker disclosed in the prior art document 2, water on one surface and a bottom surface of an ice making block is heated by the heater in an ice making process. Thus, when solidification proceeds on the surface of the water, and also, convection occurs in the water to make transparent ice. When growth of the transparent ice proceeds to reduce a volume of the water within the ice making block, the solidification rate is gradually increased, and thus, sufficient convection suitable for the solidification rate may not occur. Thus, in the case of the prior art document 2, when about ⅔ of water is solidified, a heating amount of heater increases to suppress an increase in the solidification rate. However, the prior art document 2 discloses a feature in which when the volume of water is simply reduced, only the heating amount of heater increases and does not disclose a structure and a heater control logic for making ice having high transparency without reducing the ice making rate.

DISCLOSURE

Technical Problem

Embodiments provide a refrigerator capable of making ice having uniform transparency by reducing transfer of heat, which is transferred to one tray adjacent to an operating heater, to an ice making cell provided by the other tray in an ice making process.

Embodiments provide a refrigerator capable of making ice in the same shape as a tray defining an ice making cell while making transparent by freezing water in a direction closer to a heater.

Embodiments provide a refrigerator in which transparency per unit height is uniform even while transparent ice is made.

Technical Solution

In one embodiment, a refrigerator may include a first tray assembly defining a portion of an ice making cell and a second tray assembly defining another portion of the ice making cell. The refrigerator may further include a heater. One of the first tray assemblies may be disposed farther from the heater. The first portion of the one tray assembly may include a first surface defining a portion of the ice making cell and a deformation resistance part extending from the first surface in a vertical direction away from the heater. This configuration may induce ice to be made in a direction from an ice making cell defined by one tray assembly to an ice making cell defined by the other tray assembly after the ice making process starts (or after the heater is turned on). The tray assembly may be defined as a tray. The tray assembly may be defined as a tray and a tray case surrounding the tray. The other tray assembly may be closer to the heater than the one tray assembly. The heater may be disposed on the other tray assembly.

The refrigerator may further include a pusher located at one side of the first tray assembly or the second tray assembly such that ice is easily separated from the tray assembly in an ice separation process. The first portion may include a through-hole in which the pusher is movable. When the degree of deformation resistance of the first portion is reinforced, the pusher presses a portion of the tray assembly and thus it may be difficult to separate ice from the tray assembly.

The degree of deformation resistance of at least a portion of an upper portion of the first portion from a center of the ice making cell in the circumferential direction of an outer circumferential surface of the ice making cell may be greater than that of at least a portion of a lower portion of the first portion. The degree of deformation resistance of at least a portion of the upper portion of the first portion may be greater than a lowermost end of the first portion.

The refrigerator may further include a heater (ice separation heater) disposed at one side of the first tray or the second tray such that ice is easily separated from the tray in the ice separation process. The first portion may include a mounting part or an accommodation part in which the additional heater is disposed. When ice is made in a direction from an ice making cell defined by one of the first and second tray assemblies to an ice making cell defined by the other tray assembly, ice is first made in the one tray assembly. Accordingly, a time when ice is attached to the one tray assembly may be lengthened. When the attachment time is lengthened, a degree of attachment between the one tray assembly and ice increases. Therefore, in the ice separation process, it may be difficult to separate ice from the tray assembly.

The one tray assembly may include a first portion that defines at least a portion of the ice making cell and a second portion extending from a predetermined point of the first portion. A predetermined point of the first portion may be an end of the first part or a point at which the first and second tray assemblies meet each other.

At least a portion of the second portion may extend in a direction away from the ice making cell defined by the other tray assembly. The direction may be a horizontal direction passing through a center of the ice making cell. The direction may be an upper side with respect to a horizontal line passing through the center of the ice making cell. At least a portion of the second portion may extend to a point equal to or higher than an uppermost end of an ice making cell defined by the one tray assembly. When the extension part is lengthened, a degree of deformation resistance of the one tray assembly may increase.

The one tray assembly may be located farther from the heater than the other tray assembly. The one tray assembly may include a second portion extending from a predetermined point of the first portion, and the second portion may include a second deformation resistance reinforcement part. The one tray assembly may include a first region and a second region spaced farther apart from the heater. A wall defining the storage chamber may include a first through-hole for enabling the cooler to supply cold to the storage chamber. The refrigerator may further include a bracket supported on a wall defining the storage chamber, and the bracket may include a first wall formed therein having a second through-hole in which cold passing through the first through-hole flows. The first through-hole is disposed closer to the second region than the first region, such that decrease in an ice making rate is reduced by turning on the heater. The first through-hole may be located above the second through-hole, such that decrease in an ice making rate is reduced by turning on the heater. The refrigerator may further include a pusher having a first edge formed therein having a surface for pressing the ice or at least one surface of the tray assembly such that ice is easily separated from the other tray assembly. The bracket may include a second wall, to which the pusher is fixed. The second wall may extend in a direction crossing the first wall. The second wall may extend to be inclined in a direction away from a vertical center line passing through a center of the ice making cell from an upper side to a lower side. Therefore, it is possible to increase the rotation angle of the second tray. In addition, it is possible to increase pressing force of the pusher. A strength reinforcement member may be disposed on the second wall. Therefore, even when pressing force of the pusher increases, it is possible to reduce deformation of the bracket. In addition, it is possible to reduce damage to the bracket. A degree of deformation resistance of an upper portion of a place, in which the pusher is located, of the strength reinforcement member may be greater than that of a lower portion of the place where the pusher is located.

In another embodiment, a refrigerator includes: a storage chamber configured to store foods; a cooler configured to supply cold into the storage chamber; a first temperature sensor configured to sense a temperature within the storage chamber; a first tray assembly configured to define a portion of an ice making cell that is a space in which water is phase-changed into ice by the cold; a second tray assembly configured to define another portion of the ice making cell, the second tray assembly being connected to a driver to contact the first tray assembly during an ice making process and to be spaced apart from the first tray assembly during an ice separation process; a water supply part configured to supply water into the ice making cell; a second temperature sensor configured to sense a temperature of the water or the ice within the ice making cell; a heater disposed adjacent to at least one of the first tray assembly or the second tray assembly; and a controller configured to control the heater and the driver.

The controller may control the cooler so that the cold is supplied to the ice making cell after the second tray assembly moves to an ice making position when the water is completely supplied to the ice making cell. The controller may control the second tray assembly so that the second tray assembly moves in a reverse direction after moving to an ice separation position in a forward direction so as to take out the ice in the ice making cell when the ice is completely made in the ice making cell. The controller may control the second tray assembly so that the supply of the water starts after the second tray assembly moves to a water supply position in the reverse direction when the ice is completely separated.

The controller may control the heater to be turned on in at least partial section while the cooler supplies the cold so that bubbles dissolved in the water within the ice making cell moves from a portion, at which the ice is made, toward the water that is in a liquid state to make transparent ice.

In order to make ice in a direction from an ice making cell defined by one of the first and second tray assemblies to an ice making cell defined by the other tray assembly after an ice making process starts, the one tray assembly may include a first portion. The first portion may include a first surface defining a portion of the ice making cell and a first deformation resistance reinforcement part extending from the first surface in a vertical direction away from the heater. The one tray assembly may be located farther from the heater than the other tray assembly. The one tray assembly may include a second portion extending from a predetermined point of the first portion, and the second portion may include a second deformation resistance reinforcement part.

A bracket supported on a wall defining the storage chamber may be further included. The bracket may include a support surface on which one or more of the first and second deformation resistance reinforcement parts is supported. The one tray assembly may include a first region and a second region spaced farther apart from the heater. A wall defining the storage chamber may include a first through-hole for enabling the cooler to supply cold to the storage chamber. The bracket may include a first wall formed therein having a second through-hole in which cold passing through the first through-hole flows. The first through-hole may be disposed closer to the second region than the first region. The first through-hole may be located above the second through-hole. A pusher having a first edge formed therein having a surface for pressing the ice or at least one surface of the tray assembly such that ice is easily separated from the other tray assembly may be further included. The bracket may include a second wall, to which the pusher is fixed. The second wall may extend in a direction crossing the first wall. The second wall may extend to be inclined in a direction away from a vertical center line passing through a center of the ice making cell from an upper side to a lower side. A strength reinforcement member may be disposed on the second wall. A degree of deformation resistance of an upper portion of a place, in which the pusher is located, of the strength reinforcement member may be greater than that of a lower portion of the place where the pusher is located. The bracket may further include a third wall having the driver mounted thereon. An additional heater mounted in the first portion may be further included, such that ice is easily separated from the tray in an ice separation process. A pusher located at one side of the one tray assembly may be further included such that ice is easily separated from the one tray assembly. The first portion may include a through-hole, through which the pusher passes.

A refrigerator according to another aspect may include a first tray assembly defining a portion of an ice making cell, a second tray assembly defining another portion of the ice making cell, a heater and a controller for controlling the heater.

In order to make ice in a direction from an ice making cell defined by one of the first and second tray assemblies to an ice making cell defined by the other tray assembly after an ice making process starts, the one tray assembly may include a first portion. The first portion may include a first surface defining a portion of the ice making cell and a first deformation resistance reinforcement part extending from the first surface in a vertical direction away from the heater. The one tray assembly may further include a second portion extending from a predetermined point of the first portion, and the second portion may include a second deformation resistance reinforcement part. The bracket may include a support surface on which one or more of the first and second deformation resistance reinforcement parts is supported. A pusher having a first edge formed therein having a surface for pressing the ice or at least one surface of the tray assembly such that ice is easily separated from the other tray assembly may be further included. The bracket may include a second wall, to which the pusher is fixed. The second wall may extend to be inclined in a direction away from a vertical center line passing through a center of the ice making cell from an upper side to a lower side. A strength reinforcement member may be disposed on the second wall. A degree of deformation resistance of an upper portion of a place, in which the pusher is located, of the strength reinforcement member may be greater than that of a lower portion of the place where the pusher is located. A wall defining the storage chamber may include a first through-hole for enabling the cooler to supply cold to the storage chamber. The bracket may include a first wall formed therein having a second through-hole in which cold passing through the first through-hole flows. The first through-hole may be disposed closer to the second region than the first region, such that decrease in ice making rate is reduced by turning on the heater.

In the refrigerator according to another aspect, a minimum value of a degree of deformation resistance of the one tray assembly is greater than that of the other tray assembly, such that ice is made in a direction from an ice making cell defined by one of the first and second tray assemblies to an ice making cell defined by the other tray assembly after an ice making process starts.

A pusher having a first edge formed therein having a surface for pressing the ice or at least one surface of the tray assembly such that ice is easily separated from the other tray assembly may be further included. The bracket may include a wall, to which the pusher is fixed. A wall of the bracket extends to be inclined in a direction away from a vertical center line passing through a center of the ice making cell from an upper side to a lower side. A strength reinforcement member may be disposed on the second wall. A degree of deformation resistance of an upper portion of a place, in which the pusher is located, of the strength reinforcement member may be greater than that of a lower portion of the place where the pusher is located.

A refrigerator according to another aspect may include a first tray assembly defining a portion of an ice making cell and a second tray assembly defining another portion of the ice making cell. The refrigerator may further include a heater. The heater may supply heat to the ice making cell.

One of first and second tray assemblies may be disposed farther from the heater. The first portion of the one tray assembly may include a first surface defining a portion of the ice making cell and a deformation resistance reinforcement part extending from the first surface in a vertical direction away from the heater. This configuration may induce ice to be made in a direction from an ice making cell defined by the one tray assembly to an ice making cell defined by the other tray assembly, after an ice making process starts (or after the heater is turned on). The tray assembly may be defined as a tray. The tray assembly may be defined as a tray and a tray case surrounding the tray. The other tray assembly may be closer to the heater than the one tray assembly. The heater may be disposed in the other tray assembly.

The refrigerator may further include a pusher located at one side of the first tray assembly or the second tray assembly such that ice is easily separated from the tray assembly in an ice separation process. The first portion may include a through-hole in which the pusher is movable. When the degree of deformation resistance of the first portion is reinforced, the pusher may press a portion of the tray assembly and thus it may be difficult to separate ice from the tray assembly.

The degree of deformation resistance of at least a portion of an upper portion of the first portion from a center of the ice making cell in the circumferential direction of an outer circumferential surface of the ice making cell may be greater than that of at least a portion of a lower portion of the first portion. The degree of deformation resistance of at least a portion of the upper portion of the first portion may be greater than a lowermost end of the first portion.

The refrigerator may further include a heater (ice separation heater) disposed at one side of the first tray or the second tray such that ice is easily separated from the tray in the ice separation process. The first portion may include a mounting part or an accommodation part in which the additional heater is disposed. When ice is made in a direction from an ice making cell defined by one of the first and second tray assemblies to an ice making cell defined by the other tray assembly, ice is first made in the one tray assembly. Accordingly, a time when ice is attached to the one tray assembly may be lengthened. When the attachment time is lengthened, a degree of attachment between the one tray assembly and ice increases. Therefore, in the ice separation process, it may be difficult to separate ice from the tray assembly.

The one tray assembly may include a first portion that defines at least a portion of the ice making cell and a second portion extending from a predetermined point of the first portion. A predetermined point of the first portion may be an end of the first part or a point at which the first and second tray assemblies meet each other. At least a portion of the second portion may extend in a direction away from the ice making cell defined by the other tray assembly. The direction may be a horizontal direction passing through a center of the ice making cell. The direction may be an upper side with respect to a horizontal line passing through the center of the ice making cell. At least a portion of the second portion may extend to a point equal to or higher than an uppermost end of an ice making cell defined by the one tray assembly. When the extension part is lengthened, a degree of deformation resistance of the one tray assembly may increase.

By increasing coupling force between the first and second tray assemblies, degrees of deformation resistances against force generated by the driver and transmitted to the first and second tray assemblies may be different from each other, such that expansion of made ice in a horizontal direction passing through the center of the ice making cell is reduced after the ice making process starts (or after the ice making heater is turned on). The degree of deformation resistance of the one tray assembly may be greater than that of the other tray assembly. By this configuration, it is possible to increase coupling force of the first and second tray assemblies without applying excessive force to the tray assembly. In addition, it is possible to reduce damage to the tray assembly by excessive force.

By increasing coupling force between the first and second tray assemblies, degrees of deformation resistances against force generated by the driver and transmitted to the first and second tray assemblies may be different from each other, such that leakage of the supplied water is reduced after the second tray moves from a water supply position to an ice making position by water supply completion. The degree of deformation resistance of the one tray assembly may be greater than that of the other tray assembly. By this configuration, it is possible to increase sealing force of the first and second tray assemblies without a sealing member such as a separate gasket.

In the refrigerator according to another aspect, the first portion may include a first surface defining a portion of the ice making cell and a first deformation resistance reinforcement part extending from the first surface in a vertical direction away from the heater. By this structure, after ice making starts, ice may be made in a direction from an ice making cell defined by one of the first and second tray assemblies to an ice making cell defined by the other tray assembly. The one tray assembly may be located farther from the heater than the other tray assembly.

A pusher located at one side of the first tray assembly or the second tray assembly may be further included such that ice is easily separated from the tray assembly in an ice separation process. The first portion may include a through-hole in which the pusher is movable.

The degree of deformation resistance of at least a portion of an upper portion of the first portion from a center of the ice making cell in the circumferential direction of an outer circumferential surface of the ice making cell may be greater than that of at least a portion of a lowermost portion of the first portion. An additional heater located at one side of the first tray assembly or the second tray assembly may be further included such that ice is easily separated from the tray assemblies in the ice separation process.

The first portion may include a mounting part in which the additional heater is mounted.

The one tray assembly may include a tray and a tray case supporting the tray.

The degree of deformation resistance of the tray case against pressure in a vertical direction applied to the tray assembly in a process in which water in the ice making cell is phase-changed and expanded may be greater than that of the tray. Rigidity of the tray case may be greater than that of the tray. The degree of deformation resistance of the one tray assembly against pressure in a vertical direction applied to the tray assembly in a process in which water in the ice making cell is phase-changed and expanded may be greater than that of the other tray assembly. Rigidity of the one tray assembly may be greater than that of the other tray assembly. Rigidity of the one tray assembly may be greater than that of the other tray assembly. In a process in which the second tray assembly moves to the ice making position by the driver, the first tray assembly and the second tray assembly may be brought into contact with each other such that rotation force of the driver may be transmitted to each tray assembly.

A degree of deformation resistance of the one tray assembly against force transmitted to each tray assembly may be greater than that of the other tray assembly. By this feature, coupling force between the first and second tray assemblies may increase and expansion in a horizontal direction passing through the center of the ice making cell in the process in which water is phase-changed into ice can be reduced. In addition, when coupling force between the first and second tray assemblies increases, it is possible to reduce leakage of water supplied to the ice making cell between the first and second tray assemblies. The one tray assembly may further include a second portion extending from the first portion in a direction away from the ice making cell. The degree of deformation resistance of the one tray assembly may further increase by the second portion.

Advantageous Effects

According to the embodiments, since the heater is turned on in at least a portion of the sections while the cooler supplies cold, the ice making rate may decrease by the heat of the heater so that the bubbles dissolved in the water inside the ice making cell move toward the liquid water from the portion at which the ice is made, thereby making the transparent ice.

In addition, when the first portion of a tray assembly includes a surface defining an ice making cell and a deformation resistance reinforcement part, ice is made in a direction close to a heater and deformation of a tray due expansion force of ice is limited, such that ice has the same shape as the tray.

In addition, when one tray assembly, which is located farther from a heater, of the first tray assembly and the second tray assembly includes a deformation resistance reinforcement part, ice may be made in a direction close to the heater and ice may have the same shape as the tray, thereby improving transparency of ice.

Also, according to the embodiments, one or more of the cooling power of the cooler and the heating amount of heater may be controlled to vary according to the mass per unit height of water in the ice making cell to make the ice having the uniform transparency as a whole regardless of the shape of the ice making cell.

Also, the heating amount of transparent ice heater and/or the cooling power of the cooler may vary in response to the change in the heat transfer amount between the water in the ice making cell and the cold air in the storage chamber, thereby making the ice having the uniform transparency as a whole.

MODE FOR INVENTION

Figure 1B:
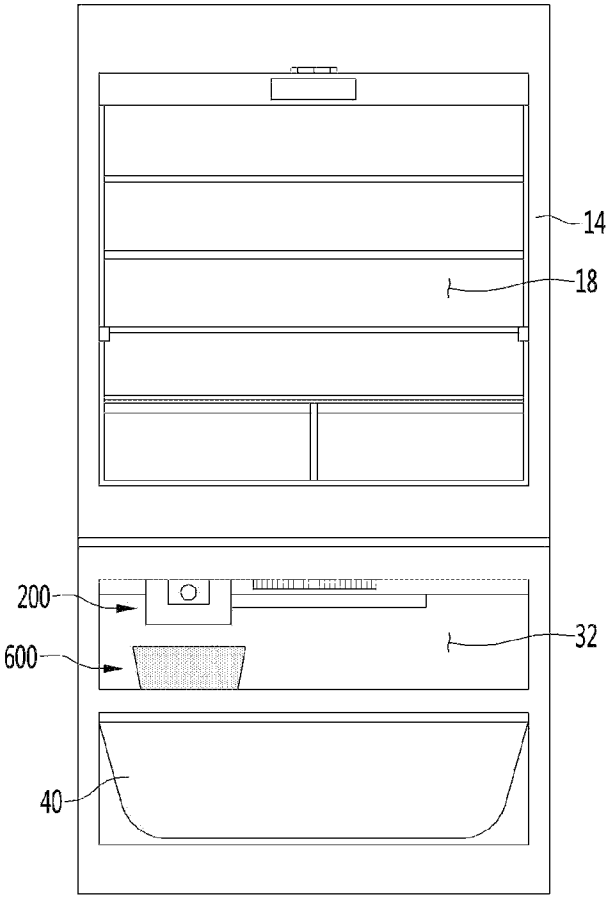
FIGS. 1A-1B are front views of a refrigerator according to an embodiment.

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

The refrigerator according to an embodiment may include a tray assembly defining a portion of an ice making cell that is a space in which water is phase-changed into ice, a cooler supplying cold air to the ice making cell, a water supply part supplying water to the ice making cell, and a controller. The refrigerator may further include a temperature sensor detecting a temperature of water or ice of the ice making cell. The refrigerator may further include a heater disposed adjacent to the tray assembly. The refrigerator may further include a driver to move the tray assembly. The refrigerator may further include a storage chamber in which food is stored in addition to the ice making cell. The refrigerator may further include a cooler supplying cold to the storage chamber. The refrigerator may further include a temperature sensor sensing a temperature in the storage chamber. The controller may control at least one of the water supply part or the cooler. The controller may control at least one of the heater or the driver.

The controller may control the cooler so that cold is supplied to the ice making cell after moving the tray assembly to an ice making position. The controller may control the second tray assembly so that the second tray assembly moves to an ice separation position in a forward direction so as to take out the ice in the ice making cell when the ice is completely made in the ice making cell. The controller may control the tray assembly so that the supply of the water supply part after the second tray assembly moves to the water supply position in the reverse direction when the ice is completely separated. The controller may control the tray assembly so as to move to the ice making position after the water supply is completed.

According to an embodiment, the storage chamber may be defined as a space that is controlled to a predetermined temperature by the cooler. An outer case may be defined as a wall that divides the storage chamber and an external space of the storage chamber (i.e., an external space of the refrigerator). An insulation material may be disposed between the outer case and the storage chamber. An inner case may be disposed between the insulation material and the storage chamber.

According to an embodiment, the ice making cell may be disposed in the storage chamber and may be defined as a space in which water is phase-changed into ice. A circumference of the ice making cell refers to an outer surface of the ice making cell irrespective of the shape of the ice making cell. In another aspect, an outer circumferential surface of the ice making cell may refer to an inner surface of the wall defining the ice making cell. A center of the ice making cell refers to a center of gravity or volume of the ice making cell. The center may pass through a symmetry line of the ice making cell.

According to an embodiment, the tray may be defined as a wall partitioning the ice making cell from the inside of the storage chamber. The tray may be defined as a wall defining at least a portion of the ice making cell. The tray may be configured to surround the whole or a portion of the ice making cell. The tray may include a first portion that defines at least a portion of the ice making cell and a second portion extending from a predetermined point of the first portion. The tray may be provided in plurality. The plurality of trays may contact each other. For example, the tray disposed at the lower portion may include a plurality of trays. The tray disposed at the upper portion may include a plurality of trays. The refrigerator may include at least one tray disposed under the ice making cell. The refrigerator may further include a tray disposed above the ice making cell. The first portion and the second portion may have a structure inconsideration of a degree of heat transfer of the tray, a degree of cold transfer of the tray, a degree of deformation resistance of the tray, a recovery degree of the tray, a degree of supercooling of the tray, a degree of attachment between the tray and ice solidified in the tray, and coupling force between one tray and the other tray of the plurality of trays.

According to an embodiment, the tray case may be disposed between the tray and the storage chamber. That is, the tray case may be disposed so that at least a portion thereof surrounds the tray. The tray case may be provided in plurality. The plurality of tray cases may contact each other. The tray case may contact the tray to support at least a portion of the tray. The tray case may be configured to connect components except for the tray (e.g., a heater, a sensor, a power transmission member, etc.). The tray case may be directly coupled to the component or coupled to the component via a medium therebetween. For example, if the wall defining the ice making cell is provided as a thin film, and a structure surrounding the thin film is provided, the thin film may be defined as a tray, and the structure may be defined as a tray case. For another example, if a portion of the wall defining the ice making cell is provided as a thin film, and a structure includes a first portion defining the other portion of the wall defining the ice making cell and a second part surrounding the thin film, the thin film and the first portion of the structure are defined as trays, and the second portion of the structure is defined as a tray case.

According to an embodiment, the tray assembly may be defined to include at least the tray. According to an embodiment, the tray assembly may further include the tray case.

According to an embodiment, the refrigerator may include at least one tray assembly connected to the driver to move. The driver is configured to move the tray assembly in at least one axial direction of the X, Y, or Z axis or to rotate about the axis of at least one of the X, Y, or Z axis. The embodiment may include a refrigerator having the remaining configuration except for the driver and the power transmission member connecting the driver to the tray assembly in the contents described in the detailed description. According to an embodiment, the tray assembly may move in a first direction.

According to an embodiment, the cooler may be defined as a part configured to cool the storage chamber including at least one of an evaporator or a thermoelectric element.

According to an embodiment, the refrigerator may include at least one tray assembly in which the heater is disposed. The heater may be disposed in the vicinity of the tray assembly to heat the ice making cell defined by the tray assembly in which the heater is disposed. The heater may include a heater to be turned on in at least partial section while the cooler supplies cold so that bubbles dissolved in the water within the ice making cell moves from a portion, at which the ice is made, toward the water that is in a liquid state to make transparent ice. The heater may include a heater (hereinafter referred to as an "ice separation heater") controlled to be turned on in at least a section after the ice making is completed so that ice is easily separated from the tray assembly. The refrigerator may include a plurality of transparent ice heaters. The refrigerator may include a plurality of ice separation heaters. The refrigerator may include a transparent ice heater and an ice separation heater. In this case, the controller may control the ice separation heater so that a heating amount of ice separation heater is greater than that of transparent ice heater.

According to an embodiment, the tray assembly may include a first region and a second region, which define an outer circumferential surface of the ice making cell. The tray assembly may include a first portion that defines at least a portion of the ice making cell and a second portion extending from a predetermined point of the first portion.

For example, the first region may be defined in the first portion of the tray assembly. The first and second regions may be defined in the first portion of the tray assembly. Each of the first and second regions may be a portion of the one tray assembly. The first and second regions may be disposed to contact each other. The first region may be a lower portion of the ice making cell defined by the tray assembly. The second region may be an upper portion of an ice making cell defined by the tray assembly. The refrigerator may include an additional tray assembly. One of the first and second regions may include a region contacting the additional tray assembly. When the additional tray assembly is disposed in a lower portion of the first region, the additional tray assembly may contact the lower portion of the first region. When the additional tray assembly is disposed in an upper portion of the second region, the additional tray assembly and the upper portion of the second region may contact each other.

For another example, the tray assembly may be provided in plurality contacting each other. The first region may be disposed in a first tray assembly of the plurality of tray assemblies, and the second region may be disposed in a second tray assembly. The first region may be the first tray assembly. The second region may be the second tray assembly. The first and second regions may be disposed to contact each other. At least a portion of the first tray assembly may be disposed under the ice making cell defined by the first and second tray assemblies. At least a portion of the second tray assembly may be disposed above the ice making cell defined by the first and second tray assemblies.

The first region may be a region closer to the heater than the second region. The first region may be a region in which the heater is disposed. The second region may be a region closer to a heat absorbing part (i.e., a coolant pipe or a heat absorbing part of a thermoelectric module) of the cooler than the first region. The second region may be a region closer to the through-hole supplying cold to the ice making cell than the first region. To allow the cooler to supply the cold through the through-hole, an additional through-hole may be defined in another component. The second region may be a region closer to the additional through-hole than the first region. The heater may be a transparent ice heater. The heat insulation degree of the second region with respect to the cold may be less than that of the first region.

The heater may be disposed in one of the first and second tray assemblies of the refrigerator. For example, when the heater is not disposed on the other one, the controller may control the heater to be turned on in at least partial section of the cooler to supply the cold air. For another example, when the additional heater is disposed on the other one, the controller may control the heater so that the heating amount of heater is greater than that of additional heater in at least a section of the cooler to supply the cold air. The heater may be a transparent ice heater.

The embodiment may include a refrigerator having a configuration excluding the transparent ice heater in the contents described in the detailed description.

The embodiment may include a pusher including a first edge having a surface pressing the ice or at least one surface of the tray assembly so that the ice is easily separated from the tray assembly. The pusher may include a bar extending from the first edge and a second edge disposed at an end of the bar. The controller may control the pusher so that a position of the pusher is changed by moving at least one of the pusher or the tray assembly. The pusher may be defined as a penetrating type pusher, a non-penetrating type pusher, a movable pusher, or a fixed pusher according to a view point.

The through-hole through which the pusher moves may be defined in the tray assembly, and the pusher may be configured to directly press the ice in the tray assembly. The pusher may be defined as a penetrating type pusher.

The tray assembly may be provided with a pressing part to be pressed by the pusher, the pusher may be configured to apply a pressure to one surface of the tray assembly. The pusher may be defined as a non-penetrating type pusher.

The controller may control the pusher to move so that the first edge of the pusher is disposed between a first point outside the ice making cell and a second point inside the ice making cell. The pusher may be defined as a movable pusher. The pusher may be connected to a driver, the rotation shaft of the driver, or the tray assembly that is connected to the driver and is movable.

The controller may control the pusher to move at least one of the tray assemblies so that the first edge of the pusher is disposed between the first point outside the ice making cell and the second point inside the ice making cell. The controller may control at least one of the tray assemblies to move to the pusher. Alternatively, the controller may control a relative position of the pusher and the tray assembly so that the pusher further presses the pressing part after contacting the pressing part at the first point outside the ice making cell. The pusher may be coupled to a fixed end. The pusher may be defined as a fixed pusher.

According to an embodiment, the ice making cell may be cooled by the cooler cooling the storage chamber. For example, the storage chamber in which the ice making cell is disposed may be a freezing compartment which is controlled at a temperature lower than 0 degree, and the ice making cell may be cooled by the cooler cooling the freezing compartment.

The freezing compartment may be divided into a plurality of regions, and the ice making cell may be disposed in one region of the plurality of regions.

According to an embodiment, the ice making cell may be cooled by a cooler other than the cooler cooling the storage chamber. For example, the storage chamber in which the ice making cell is disposed is a refrigerating compartment which is controlled to a temperature higher than 0 degree, and the ice making cell may be cooled by a cooler other than the cooler cooling the refrigerating compartment. That is, the refrigerator may include a refrigerating compartment and a freezing compartment, the ice making cell may be disposed inside the refrigerating compartment, and the ice maker cell may be cooled by the cooler that cools the freezing compartment. The ice making cell may be disposed in a door that opens and closes the storage chamber.

According to an embodiment, the ice making cell is not disposed inside the storage chamber and may be cooled by the cooler. For example, the entire storage chamber defined inside the outer case may be the ice making cell.

According to an embodiment, a degree of heat transfer indicates a degree of heat transfer from a high-temperature object to a low-temperature object and is defined as a value determined by a shape including a thickness of the object, a material of the object, and the like. In terms of the material of the object, a high degree of the heat transfer of the object may represent that thermal conductivity of the object is high. The thermal conductivity may be a unique material property of the object. Even when the material of the object is the same, the degree of heat transfer may vary depending on the shape of the object.

The degree of heat transfer may vary depending on the shape of the object. The degree of heat transfer from a point A to a point B may be influenced by a length of a path through which heat is transferred from the point A to the point B (hereinafter, referred to as a "heat transfer path"). The more the heat transfer path from the point A to the point B increases, the more the degree of heat transfer from the point A to the point B may decrease. The more the heat transfer path from the point A to the point B, the more the degree of heat transfer from the point A to the point B may increase.

The degree of heat transfer from the point A to the point B may be influenced by a thickness of the path through which heat is transferred from the point A to the point B. The more the thickness in a path direction in which heat is transferred from the point A to the point B decreases, the more the degree of heat transfer from the point A to the point B may decrease. The greater the thickness in the path direction from which the heat from point A to point B is transferred, the more the degree of heat transfer from point A to point B.

According to an embodiment, a degree of cold transfer indicates a degree of heat transfer from a low-temperature object to a high-temperature object and is defined as a value determined by a shape including a thickness of the object, a material of the object, and the like. The degree of cold transfer is a term defined in consideration of a direction in which cold flows and may be regarded as the same concept as the degree of heat transfer. The same concept as the degree of heat transfer will be omitted.

According to an embodiment, a degree of supercooling is a degree of supercooling of a liquid and may be defined as a value determined by a material of the liquid, a material or shape of a container containing the liquid, an external factor applied to the liquid during a solidification process of the liquid, and the like. An increase in frequency at which the liquid is supercooled may be seen as an increase in degree of the supercooling. The lowering of the temperature at which the liquid is maintained in the supercooled state may be seen as an increase in degree of the supercooling. Here, the supercooling refers to a state in which the liquid exists in the liquid phase without solidification even at a temperature below a freezing point of the liquid. The supercooled liquid has a characteristic in which the solidification rapidly occurs from a time point at which the supercooling is terminated. If it is desired to maintain a rate at which the liquid is solidified, it is advantageous to be designed so that the supercooling phenomenon is reduced.

According to an embodiment, a degree of deformation resistance represents a degree to which an object resists deformation due to external force applied to the object and is a value determined by a shape including a thickness of the object, a material of the object, and the like. For example, the external force may include a pressure applied to the tray assembly in the process of solidifying and expanding water in the ice making cell. In another example, the external force may include a pressure on the ice or a portion of the tray assembly by the pusher for separating the ice from the tray assembly. For another example, when coupled between the tray assemblies, it may include a pressure applied by the coupling.

In terms of the material of the object, a high degree of the deformation resistance of the object may represent that rigidity of the object is high. The degree of the deformation resistance may be a unique material property of the object. Even when the material of the object is the same, the degree of deformation resistance may vary depending on the shape of the object. The degree of deformation resistance may be affected by a deformation resistance reinforcement part extending in a direction in which the external force is applied. The more the rigidity of the deformation resistant-resistance reinforcement part increases, the more the degree of deformation resistance may increase. The more the height of the extending deformation resistance reinforcement part increase, the more the degree of deformation resistance may increase.

According to an embodiment, a degree of restoration indicates a degree to which an object deformed by the external force is restored to a shape of the object before the external force is applied after the external force is removed and is defined as a value determined by a shape including a thickness of the object, a material of the object, and the like. For example, the external force may include a pressure applied to the tray assembly in the process of solidifying and expanding water in the ice making cell. In another example, the external force may include a pressure on the ice or a portion of the tray assembly by the pusher for separating the ice from the tray assembly. For another example, when coupled between the tray assemblies, it may include a pressure applied by the coupling force.

In view of the material of the object, a high degree of the restoration of the object may represent that an elastic modulus of the object is high. The elastic modulus may be a material property unique to the object. Even when the material of the object is the same, the degree of restoration may vary depending on the shape of the object. The degree of restoration may be affected by an elastic resistance reinforcement part extending in a direction in which the external force is applied. The more the elastic modulus of the elastic resistance reinforcement part increases, the more the degree of restoration may increase.

According to an embodiment, the coupling force represents a degree of coupling between the plurality of tray assemblies and is defined as a value determined by a shape including a thickness of the tray assembly, a material of the tray assembly, magnitude of the force that couples the trays to each other, and the like.

According to an embodiment, a degree of attachment indicates a degree to which the ice and the container are attached to each other in a process of making ice from water contained in the container and is defined as a value determined by a shape including a thickness of the container, a material of the container, a time elapsed after the ice is made in the container, and the like.

The refrigerator according to an embodiment includes a first tray assembly defining a portion of an ice making cell that is a space in which water is phase-changed into ice by cold, a second tray assembly defining the other portion of the ice making cell, a cooler supplying cold to the ice making cell, a water supply part supplying water to the ice making cell, and a controller. The refrigerator may further include a storage chamber in addition to the ice making cell. The storage chamber may include a space for storing food. The ice making cell may be disposed in the storage chamber. The refrigerator may further include a first temperature sensor sensing a temperature in the storage chamber. The refrigerator may further include a second temperature sensor sensing a temperature of water or ice of the ice making cell. The second tray assembly may contact the first tray assembly in the ice making process and may be connected to the driver to be spaced apart from the first tray assembly in the ice separation process. The refrigerator may further include a heater disposed adjacent to at least one of the first tray assembly or the second tray assembly.

The controller may control at least one of the heater or the driver. The controller may control the cooler so that the cold is supplied to the ice making cell after the second tray assembly moves to an ice making position when the water is completely supplied to the ice making cell. The controller may control the second tray assembly so that the second tray assembly moves in a reverse direction after moving to an ice separation position in a forward direction so as to take out the ice in the ice making cell when the ice is completely made in the ice making cell. The controller may control the second tray assembly so that the supply of the water supply part after the second tray assembly moves to the water supply position in the reverse direction when the ice is completely separated.

Transparent ice will be described. Bubbles are dissolved in water, and the ice solidified with the bubbles may have low transparency due to the bubbles. Therefore, in the process of water solidification, when the bubble is guided to move from a freezing portion in the ice making cell to another portion that is not yet frozen, the transparency of the ice may increase.

A through-hole defined in the tray assembly may affect the making of the transparent ice. The through-hole defined in one side of the tray assembly may affect the making of the transparent ice. In the process of making ice, if the bubbles move to the outside of the ice making cell from the frozen portion of the ice making cell, the transparency of the ice may increase. The through-hole may be defined in one side of the tray assembly to guide the bubbles so as to move out of the ice making cell. Since the bubbles have lower density than the liquid, the through-hole (hereinafter, referred to as an "air exhaust hole") for guiding the bubbles to escape to the outside of the ice making cell may be defined in the upper portion of the tray assembly.

The position of the cooler and the heater may affect the making of the transparent ice. The position of the cooler and the heater may affect an ice making direction, which is a direction in which ice is made inside the ice making cell.

In the ice making process, when bubbles move or are collected from a region in which water is first solidified in the ice making cell to another predetermined region in a liquid state, the transparency of the made ice may increase. The direction in which the bubbles move or are collected may be similar to the ice making direction. The predetermined region may be a region in which water is to be solidified lately in the ice making cell.

The predetermined region may be a region in which the cold supplied by the cooler reaches the ice making cell late. For example, in the ice making process, the through-hole through which the cooler supplies the cold to the ice making cell may be defined closer to the upper portion than the lower portion of the ice making cell so as to move or collect the bubbles to the lower portion of the ice making cell. For another example, a heat absorbing part of the cooler (that is, a refrigerant pipe of the evaporator or a heat absorbing part of the thermoelectric element) may be disposed closer to the upper portion than the lower portion of the ice making cell. According to an embodiment, the upper and lower portions of the ice making cell may be defined as an upper region and a lower region based on a height of the ice making cell.

The predetermined region may be a region in which the heater is disposed. For example, in the ice making process, the heater may be disposed closer to the lower portion than the upper portion of the ice making cell so as to move or collect the bubbles in the water to the lower portion of the ice making cell.

The predetermined region may be a region closer to an outer circumferential surface of the ice making cell than to a center of the ice making cell. However, the vicinity of the center is not excluded. If the predetermined region is near the center of the ice making cell, an opaque portion due to the bubbles moved or collected near the center may be easily visible to the user, and the opaque portion may remain until most of the ice until the ice is melted. Also, it may be difficult to arrange the heater inside the ice making cell containing water. In contrast, when the predetermined region is defined in or near the outer circumferential surface of the ice making cell, water may be solidified from one side of the outer circumferential surface of the ice making cell toward the other side of the outer circumferential surface of the ice making cell, thereby solving the above limitation. The transparent ice heater may be disposed on or near the outer circumferential surface of the ice making cell. The heater may be disposed at or near the tray assembly.

The predetermined region may be a position closer to the lower portion of the ice making cell than the upper portion of the ice making cell. However, the upper portion is also not excluded. In the ice making process, since liquid water having greater density than ice drops, it may be advantageous that the predetermined region is defined in the lower portion of the ice making cell.

At least one of the degree of deformation resistance, the degree of restoration, and the coupling force between the plurality of tray assemblies may affect the making of the transparent ice. At least one of the degree of deformation resistance, the degree of restoration, and the coupling force between the plurality of tray assemblies may affect the ice making direction that is a direction in which ice is made in the ice making cell. As described above, the tray assembly may include a first region and a second region, which define an outer circumferential surface of the ice making cell. For example, each of the first and second regions may be a portion of one tray assembly. For another example, the first region may be a first tray assembly. The second region may be a second tray assembly.

To make the transparent ice, it may be advantageous for the refrigerator to be configured so that the direction in which ice is made in the ice making cell is constant. This is because the more the ice making direction is constant, the more the bubbles in the water are moved or collected in a predetermined region within the ice making cell. It may be advantageous for the degree of deformation resistance of the portion to be greater than the degree of deformation resistance of the other portion so as to induce the ice to be made in the direction of the other portion in a portion of the tray assembly. The ice tends to be grown as the ice is expanded toward a potion at which the degree of deformation resistance is low. To start the ice making again after removing the made ice, the deformed portion has to be restored again to make ice having the same shape repeatedly. Therefore, it may be advantageous that the portion having the low degree of the deformation resistance has a high degree of the restoration than the portion having a high degree of the deformation resistance.

The degree of deformation resistance of the tray with respect to the external force may be less than that of the tray case with respect to the external force, or the rigidity of the tray may be less than that of the tray case. The tray assembly allows the tray to be deformed by the external force, while the tray case surrounding the tray is configured to reduce the deformation. For example, the tray assembly may be configured so that at least a portion of the tray is surrounded by the tray case. In this case, when a pressure is applied to the tray assembly while the water inside the ice making cell is solidified and expanded, at least a portion of the tray may be allowed to be deformed, and the other part of the tray may be supported by the tray case to restrict the deformation. In addition, when the external force is removed, the degree of restoration of the tray may be greater than that of the tray case, or the elastic modulus of the tray may be greater than that of the tray case. Such a configuration may be configured so that the deformed tray is easily restored.

The degree of deformation resistance of the tray with respect to the external force may be greater than that of the gasket of the refrigerator with respect to the external force, or the rigidity of the tray may be greater than that of the gasket. When the degree of deformation resistance of the tray is low, there may be a limitation that the tray is excessively deformed as the water in the ice making cell defined by the tray is solidified and expanded. Such a deformation of the tray may make it difficult to make the desired type of ice. In addition, the degree of restoration of the tray when the external force is removed may be configured to be less than that of the refrigerator gasket with respect to the external force, or the elastic modulus of the tray is less than that of the gasket.

The degree of deformation resistance of the tray case with respect to the external force may be less than that of the refrigerator case with respect to the external force, or the rigidity of the tray case may be less than that of the refrigerator case. In general, the case of the refrigerator may be made of a metal material including steel. In addition, when the external force is removed, the degree of restoration of the tray case may be greater than that of the refrigerator case with respect to the external force, or the elastic modulus of the tray case is greater than that of the refrigerator case.

The relationship between the transparent ice and the degree of deformation resistance is as follows.

The second region may have different degree of deformation resistance in a direction along the outer circumferential surface of the ice making cell. The degree of deformation resistance of one portion of the second region may be greater than that of the other portion of the second region. Such a configuration may be assisted to induce ice to be made in a direction from the ice making cell defined by the second region to the ice making cell defined by the first region.

The first and second regions defined to contact each other may have different degree of deformation resistances in the direction along the outer circumferential surface of the ice making cell. The degree of deformation resistance of one portion of the second region may be greater than that of one portion of the first region. Such a configuration may be assisted to induce ice to be made in a direction from the ice making cell defined by the second region to the ice making cell defined by the first region.

In this case, as the water is solidified, a volume is expanded to apply a pressure to the tray assembly, which induces ice to be made in the other direction of the second region or in one direction of the first region. The degree of deformation resistance may be a degree that resists to deformation due to the external force. The external force may a pressure applied to the tray assembly in the process of solidifying and expanding water in the ice making cell. The external force may be force in a vertical direction (Z-axis direction) of the pressure. The external force may be force acting in a direction from the ice making cell defined by the second region to the ice making cell defined by the first region.

For example, in the thickness of the tray assembly in the direction of the outer circumferential surface of the ice making cell from the center of the ice making cell, one portion of the second region may be thicker than the other of the second region or thicker than one portion of the first region. One portion of the second region may be a portion at which the tray case is not surrounded. The other portion of the second region may be a portion surrounded by the tray case. One portion of the first region may be a portion at which the tray case is not surrounded. One portion of the second region may be a portion defining the uppermost portion of the ice making cell in the second region. The second region may include a tray and a tray case locally surrounding the tray. As described above, when at least a portion of the second region is thicker than the other part, the degree of deformation resistance of the second region may be improved with respect to an external force. A minimum value of the thickness of one portion of the second region may be greater than that of the thickness of the other portion of the second region or greater than that of one portion of the first region. A maximum value of the thickness of one portion of the second region may be greater than that of the thickness of the other portion of the second region or greater than that of one portion of the first region. When the through-hole is defined in the region, the minimum value represents the minimum value in the remaining regions except for the portion in which the through-hole is defined. An average value of the thickness of one portion of the second region may be greater than that of the thickness of the other portion of the second region or greater than that of one portion of the first region. The uniformity of the thickness of one portion of the second region may be less than that of the thickness of the other portion of the second region or less than that of one of the thickness of the first region.

For another example, one portion of the second region may include a first surface defining a portion of the ice making cell and a deformation resistance reinforcement part extending from the first surface in a vertical direction away from the ice making cell defined by the other of the second region. One portion of the second region may include a first surface defining a portion of the ice making cell and a deformation resistance reinforcement part extending from the first surface in a vertical direction away from the ice making cell defined by the first region. As described above, when at least a portion of the second region includes the deformation resistance reinforcement part, the degree of deformation resistance of the second region may be improved with respect to the external force.

For another example, one portion of the second region may further include a support surface connected to a fixed end of the refrigerator (e.g., the bracket, the storage chamber wall, etc.) disposed in a direction away from the ice making cell defined by the other of the second region from the first surface. One portion of the second region may further include a support surface connected to a fixed end of the refrigerator (e.g., the bracket, the storage chamber wall, etc.) disposed in a direction away from the ice making cell defined by the first region from the first surface. As described above, when at least a portion of the second region includes a support surface connected to the fixed end, the degree of deformation resistance of the second region may be improved with respect to the external force.

For another example, the tray assembly may include a first portion defining at least a portion of the ice making cell and a second portion extending from a predetermined point of the first portion. At least a portion of the second portion may extend in a direction away from the ice making cell defined by the first region. At least a portion of the second portion may include an additional deformation resistance reinforcement part. At least a portion of the second portion may further include a support surface connected to the fixed end. As described above, when at least a portion of the second region further includes the second portion, it may be advantageous to improve the degree of deformation resistance of the second region with respect to the external force. This is because the additional deformation resistance reinforcement part is disposed at in the second portion, or the second portion is additionally supported by the fixed end.

For another example, one portion of the second region may include a first through-hole. As described above, when the first through-hole is defined, the ice solidified in the ice making cell of the second region is expanded to the outside of the ice making cell through the first through-hole, and thus, the pressure applied to the second region may be reduced. In particular, when water is excessively supplied to the ice making cell, the first through-hole may be contributed to reduce the deformation of the second region in the process of solidifying the water.

One portion of the second region may include a second through-hole providing a path through which the bubbles contained in the water in the ice making cell of the second region move or escape. When the second through-hole is defined as described above, the transparency of the solidified ice may be improved.

In one portion of the second region, a third through-hole may be defined to press the penetrating pusher. This is because it may be difficult for the non-penetrating type pusher to press the surface of the tray assembly so as to remove the ice when the degree of deformation resistance of the second region increases. The first, second, and third through-holes may overlap each other. The first, second, and third through-holes may be defined in one through-hole.

One portion of the second region may include a mounting part on which the ice separation heater is disposed. The induction of the ice in the ice making cell defined by the second region in the direction of the ice making cell defined by the first region may represent that the ice is first made in the second region. In this case, a time for which the ice is attached to the second region may be long, and the ice separation heater may be required to separate the ice from the second region. The thickness of a portion of the second region of the tray assembly in which the ice separation heater is mounted in the direction of the outer circumferential surface of the ice making cell from the center of the ice making cell may be less than that of the other portion of the second region. This is because the heat supplied by the ice separation heater increases in amount transferred to the ice making cell. The fixed end may be a portion of the wall defining the storage chamber or a bracket.

The relation between the coupling force of the transparent ice and the tray assembly is as follows.

To induce the ice to be made in the ice making cell defined by the second region in the direction of the ice making cell defined by the first region, it may be advantageous to increase in coupling force between the first and second regions arranged to contact each other. In the process of solidifying the water, when the pressure applied to the tray assembly while expanded is greater than the coupling force between the first and second regions, the ice may be made in a direction in which the first and second regions are separated from each other. In the process of solidifying the water, when the pressure applied to the tray assembly while expanded is low, the coupling force between the first and second regions is low, It also has the advantage of inducing the ice to be made so that the ice is made in a direction of the region having the smallest degree of deformation resistance in the first and second regions.

There may be various examples of a method of increasing the coupling force between the first and second regions. For example, after the water supply is completed, the controller may change a movement position of the driver in the first direction to control one of the first and second regions so as to move in the first direction, and then, the movement position of the driver may be controlled to be additionally changed into the first direction so that the coupling force between the first and second regions increases. For another example, since the coupling force between the first and second regions increase, the degree of deformation resistances or the degree of restorations of the first and second regions may be different from each other with respect to the force applied from the driver so that a change of the shape of the ice making cell by the expanding the ice is reduced after the ice making process is started (or after the heater is turned on). For another example, the first region may include a first surface facing the second region. The second region may include a second surface facing the first region. The first and second surfaces may be disposed to contact each other. The first and second surfaces may be disposed to face each other. The first and second surfaces may be disposed to be separated from and coupled to each other. In this case, surface areas of the first surface and the second surface may be different from each other. In this configuration, the coupling force of the first and second regions may increase while reducing breakage of the portion at which the first and second regions contact each other. In addition, there is an advantage of reducing leakage of water supplied between the first and second regions.

The relationship between transparent ice and the degree of restoration is as follows.

The tray assembly may include a first portion that defines at least a portion of the ice making cell and a second portion extending from a predetermined point of the first portion. The second portion is configured to be deformed by the expansion of the ice made and then restored after the ice is removed. The second portion may include a horizontal extension part provided so that the degree of restoration with respect to the horizontal external force of the expanded ice increases. The second portion may include a vertical extension part provided so that the degree of restoration with respect to the vertical external force of the expanded ice increases. Such a configuration may be assisted to induce ice to be made in a direction from the ice making cell defined by the second region to the ice making cell defined by the first region.

The first region may have different degree of restoration in a direction along the outer circumferential surface of the ice making cell. The first region may have different degree of deformation resistance in a direction along the outer circumferential surface of the ice making cell. The degree of restoration of one portion of the first region may be greater than that of the other portion of the first region. Also, the degree of deformation resistance of one portion may be less than that of the other portion. Such a configuration may be assisted to induce ice to be made in a direction from the ice making cell defined by the second region to the ice making cell defined by the first region.

The first and second regions defined to contact each other may have different degree of restoration in the direction along the outer circumferential surface of the ice making cell. Also, the first and second regions may have different degree of deformation resistances in the direction along the outer circumferential surface of the ice making cell. The degree of restoration of one of the first region may be greater than that of one of the second region. Also, the degree of deformation resistance of one of the first region may be greater than that of one of the second region. Such a configuration may be assisted to induce ice to be made in a direction from the ice making cell defined by the second region to the ice making cell defined by the first region.

In this case, as the water is solidified, a volume is expanded to apply a pressure to the tray assembly, which induces ice to be made in one direction of the first region in which the degree of deformation resistance decreases, or the degree of restoration increases. Here, the degree of restoration may be a degree of restoration after the external force is removed. The external force may a pressure applied to the tray assembly in the process of solidifying and expanding water in the ice making cell. The external force may be force in a vertical direction (Z-axis direction) of the pressure. The external force may be force acting in a direction from the ice making cell defined by the second region to the ice making cell defined by the first region.

For example, in the thickness of the tray assembly in the direction of the outer circumferential surface of the ice making cell from the center of the ice making cell, one portion of the first region may be thinner than the other of the first region or thinner than one portion of the second region. One portion of the first region may be a portion at which the tray case is not surrounded. The other portion of the first region may be a portion that is surrounded by the tray case. One portion of the second region may be a portion that is surrounded by the tray case. One portion of the first region may be a portion of the first region that defines the lowermost end of the ice making cell. The first region may include a tray and a tray case locally surrounding the tray.

A minimum value of the thickness of one portion of the first region may be less than that of the thickness of the other portion of the second region or less than that of one of the second region. A maximum value of the thickness of one portion of the first region may be less than that of the thickness of the other portion of the first region or less than that of the thickness of one portion of the second region. When the through-hole is defined in the region, the minimum value represents the minimum value in the remaining regions except for the portion in which the through-hole is defined. An average value of the thickness of one portion of the first region may be less than that of the thickness of the other portion of the first region or may be less than that of one of the thickness of the second region. The uniformity of the thickness of one portion of the first region may be greater than that of the thickness of the other portion of the first region or greater than that of one of the thickness of the second region.

For another example, a shape of one portion of the first region may be different from that of the other portion of the first region or different from that of one portion of the second region. A curvature of one portion of the first region may be different from that of the other portion of the first region or different from that of one portion of the second region. A curvature of one portion of the first region may be less than that of the other portion of the first region or less than that of one portion of the second region. One portion of the first region may include a flat surface. The other portion of the first region may include a curved surface. One portion of the second region may include a curved surface. One portion of the first region may include a shape that is recessed in a direction opposite to the direction in which the ice is expanded. One portion of the first region may include a shape recessed in a direction opposite to a direction in which the ice is made. In the ice making process, one portion of the first region may be modified in a direction in which the ice is expanded or a direction in which the ice is made. In the ice making process, in an amount of deformation from the center of the ice making cell toward the outer circumferential surface of the ice making cell, one portion of the first region is greater than the other portion of the first region. In the ice making process, in the amount of deformation from the center of the ice making cell toward the outer circumferential surface of the ice making cell, one portion of the first region is greater than one portion of the second region.

For another example, to induce ice to be made in a direction from the ice making cell defined by the second region to the ice making cell defined by the first region, one portion of the first region may include a first surface defining a portion of the ice making cell and a second surface extending from the first surface and supported by one surface of the other portion of the first region. The first region may be configured not to be directly supported by the other component except for the second surface. The other component may be a fixed end of the refrigerator.

One portion of the first region may have a pressing surface pressed by the non-penetrating type pusher. This is because when the degree of deformation resistance of the first region is low, or the degree of restoration is high, the difficulty in removing the ice by pressing the surface of the tray assembly may be reduced.

An ice making rate, at which ice is made inside the ice making cell, may affect the making of the transparent ice. The ice making rate may affect the transparency of the made ice. Factors affecting the ice making rate may be an amount of cold and/or heat, which are/is supplied to the ice making cell. The amount of cold and/or heat may affect the making of the transparent ice. The amount of cold and/or heat may affect the transparency of the ice.

In the process of making the transparent ice, the transparency of the ice may be lowered as the ice making rate is greater than a rate at which the bubbles in the ice making cell are moved or collected. On the other hand, if the ice making rate is less than the rate at which the bubbles are moved or collected, the transparency of the ice may increase. However, the more the ice making rate decreases, the more a time taken to make the transparent ice may increase. Also, the transparency of the ice may be uniform as the ice making rate is maintained in a uniform range.

To maintain the ice making rate uniformly within a predetermined range, an amount of cold and heat supplied to the ice making cell may be uniform. However, in actual use conditions of the refrigerator, a case in which the amount of cold is variable may occur, and thus, it is necessary to allow a supply amount of heat to vary. For example, when a temperature of the storage chamber reaches a satisfaction region from a dissatisfaction region, when a defrosting operation is performed with respect to the cooler of the storage chamber, the door of the storage chamber is in a state such as an opened state, the amount of cold is variable. Also, if an amount of water per unit height of the ice making cell is different, when the same cold and heat per unit height is supplied, the transparency per unit height may vary.

To solve this limitation, the controller may control the heater so that when a heat transfer amount between the cold within the storage chamber and the water of the ice making cell increases, the heating amount of transparent ice heater increases, and when the heat transfer amount between the cold within the storage chamber and the water of the ice making cell decreases, the heating amount of transparent ice heater decreases so as to maintain an ice making rate of the water within the ice making cell within a predetermined range that is less than an ice making rate when the ice making is performed in a state in which the heater is turned off.

The controller may control one or more of a cold supply amount of cooler and a heat supply amount of heater to vary according to a mass per unit height of water in the ice making cell. In this case, the transparent ice may be provided to correspond to a change in shape of the ice making cell.

The refrigerator may further include a sensor measuring information on the mass of water per unit height of the ice making cell, and the controller may control one of the cold supply amount of cooler and the heat supply amount of heater based on the information inputted from the sensor.

The refrigerator may include a storage part in which predetermined driving information of the cooler is recorded based on information on mass per unit height of the ice making cell, and the controller may control the cold supply amount of cooler to be changed based on the information.

The refrigerator may include a storage part in which predetermined driving information of the heater is recorded based on information on mass per unit height of the ice making cell, and the controller may control the heat supply amount of heater to be changed based on the information. For example, the controller may control at least one of the cold supply amount of cooler or the heat supply amount of heater to vary according to a predetermined time based on the information on the mass per unit height of the ice making cell. The time may be a time when the cooler is driven or a time when the heater is driven to make ice. For another example, the controller may control at least one of the cold supply amount of cooler or the heat supply amount of heater to vary according to a predetermined temperature based on the information on the mass per unit height of the ice making cell. The temperature may be a temperature of the ice making cell or a temperature of the tray assembly defining the ice making cell.

When the sensor measuring the mass of water per unit height of the ice making cell is malfunctioned, or when the water supplied to the ice making cell is insufficient or excessive, the shape of the ice making water is changed, and thus the transparency of the made ice may decrease. To solve this limitation, a water supply method in which an amount of water supplied to the ice making cell is precisely controlled is required. Also, the tray assembly may include a structure in which leakage of the tray assembly is reduced to reduce the leakage of water in the ice making cell at the water supply position or the ice making position. Also, it is necessary to increase the coupling force between the first and second tray assemblies defining the ice making cell so as to reduce the change in shape of the ice making cell due to the expansion force of the ice during the ice making. Also, it is necessary o dec ease in leakage in the tray assembly, precisely supply of water and increase in coupling force between the first and second tray assemblies so as to make ice having a shape that is close to the tray shape.

The degree of supercooling of the water inside the ice making cell may affect the making of the transparent ice. The degree of supercooling of the water may affect the transparency of the made ice.

To make the transparent ice, it may be desirable to design the degree of supercooling to be lowered and thereby to maintain a predetermined range of temperature inside an ice making cell. This is because the supercooled liquid has a characteristic in which the solidification rapidly occurs from a time point at which the supercooling is terminated. In this case, the transparency of the ice may decrease.

In the process of solidifying the liquid, the controller of the refrigerator may control the supercooling release part to operate so as to reduce a degree of supercooling of the liquid if the time required for reaching the specific temperature below the freezing point after the temperature of the liquid reaches the freezing point is less than a reference value. After reaching the freezing point, it is seen that the temperature of the liquid is cooled below the freezing point as the supercooling occurs, and no solidification occurs.

An example of the supercooling release part may include an electrical spark generating part. When the spark is supplied to the liquid, the degree of supercooling of the liquid may be reduced. Another example of the supercooling release part may include a driver applying external force so that the liquid moves. The driver may allow the container to move in at least one direction among X, Y, or Z axes or to rotate about at least one axis among X, Y, or Z axes. When kinetic energy is supplied to the liquid, the degree of supercooling of the liquid may be reduced. Further another example of the supercooling release part may include a part supplying the liquid to the container. After supplying the liquid having a first volume less than that of the container, when a predetermined time has elapsed or the temperature of the liquid reaches a certain temperature below the freezing point, the controller of the refrigerator may control an amount of liquid to additionally supply the liquid having a second volume greater than the first volume. When the liquid is divided and supplied to the container as described above, the liquid supplied first may be solidified to act as freezing nucleus, and thus, the degree of supercooling of the liquid to be supplied may be further reduced.

The more the degree of heat transfer of the container containing the liquid increase, the more the degree of supercooling of the liquid may increase. The more the degree of heat transfer of the container containing the liquid decrease, the more the degree of supercooling of the liquid may decrease.

The structure and method of heating the ice making cell in addition to the degree of heat transfer of the tray assembly may affect the making of the transparent ice. As described above, the tray assembly may include a first region and a second region, which define an outer circumferential surface of the ice making cell. For example, each of the first and second regions may be a portion of one tray assembly. For another example, the first region may be a first tray assembly. The second region may be a second tray assembly.

The cold supplied to the ice making cell and the heat supplied to the ice making cell have opposite properties. To increase the ice making rate and/or improve the transparency of the ice, the design of the structure and control of the cooler and the heater, the relationship between the cooler and the tray assembly, and the relationship between the heater and the tray assembly may be very important.

For a constant amount of cold supplied by the cooler and a constant amount of heat supplied by the heater, it may be advantageous for the heater to be arranged to locally heat the ice making cell so as to increase the ice making rate of the refrigerator and/or to increase the transparency of the ice. As the heat transmitted from the heater to the ice making cell is reduced toward an area other than the area on which the heater is disposed, the ice making rate may be improved. As the heater heats only a portion of the ice making cell, the bubbles may be moved or collected to an area adjacent to the heater in the ice making cell, thereby increasing the transparency of the ice.

When the amount of heat supplied by the heater to the ice making cell is large, the bubbles in the water may be moved or collected in the portion to which the heat is supplied, and thus, the made ice may increase in transparency. However, if the heat is uniformly supplied to the outer circumferential surface of the ice making cell, the ice making rate of the ice may decrease. Therefore, as the heater locally heats a portion of the ice making cell, it is possible to increase the transparency of the made ice and minimize the decrease of the ice making rate.

The heater may be disposed to contact one side of the tray assembly. The heater may be disposed between the tray and the tray case. The heat transfer through the conduction may be advantageous for locally heating the ice making cell.

At least a portion of the other side at which the heater does not contact the tray may be sealed with a heat insulation material. Such a configuration may reduce that the heat supplied from the heater is transferred toward the storage chamber.

The tray assembly may be configured so that the heat transfer from the heater toward the center of the ice making cell is greater than that of from the heater in the circumference direction of the ice making cell.

The heat transfer of the tray toward the center of the ice making cell in the tray may be greater than the a heat transfer from the tray case to the storage chamber, or the thermal conductivity of the tray may be greater than that of the tray case. Such a configuration may induce the increase in heat transmitted from the heater to the ice making cell via the tray. In addition, it is possible to reduce the heat of the heater is transferred to the storage chamber via the tray case.

The heat transfer of the tray toward the center of the ice making cell in the tray may be less than that of the refrigerator case toward the storage chamber from the outside of the refrigerator case (for example, an inner case or an outer case), or the thermal conductivity of the tray may be less than that of the refrigerator case. This is because the more the heat or thermal conductivity of the tray increases, the more the supercooling of the water accommodated in the tray may increase. The more the degree of supercooling of the water increase, the more the water may be rapidly solidified at the time point at which the supercooling is released. In this case, a limitation may occur in which the transparency of the ice is not uniform or the transparency decreases. In general, the case of the refrigerator may be made of a metal material including steel.

The heat transfer of the tray case in the direction from the storage chamber to the tray case may be greater than the that of the heat insulation wall in the direction from the outer space of the refrigerator to the storage chamber, or the thermal conductivity of the tray case may be greater than that of the heat insulation wall (for example, the insulation material disposed between the inner and outer cases of the refrigerator). Here, the heat insulation wall may represent a heat insulation wall that partitions the external space from the storage chamber. If the degree of heat transfer of the tray case is equal to or greater than that of the heat insulation wall, the rate at which the ice making cell is cooled may be excessively reduced.

The first region may be configured to have a different degree of heat transfer in a direction along the outer circumferential surface. The degree of heat transfer of one portion of the first region may be less than that of the other portion of the first region. Such a configuration may be assisted to reduce the heat transfer transferred through the tray assembly from the first region to the second region in the direction along the outer circumferential surface.

The first and second regions defined to contact each other may be configured to have a different degree of heat transfer in the direction along the outer circumferential surface. The degree of heat transfer of one portion of the first region may be configured to be less than the degree of heat transfer of one portion of the second region. Such a configuration may be assisted to reduce the heat transfer transferred through the tray assembly from the first region to the second region in the direction along the outer circumferential surface. In another aspect, it may be advantageous to reduce the heat transferred from the heater to one portion of the first region to be transferred to the ice making cell defined by the second region. As the heat transmitted to the second region is reduced, the heater may locally heat one portion of the first region. Thus, it may be possible to reduce the decrease in ice making rate by the heating of the heater. In another aspect, the bubbles may be moved or collected in the region in which the heater is locally heated, thereby improving the transparency of the ice. The heater may be a transparent ice heater.

For example, a length of the heat transfer path from the first region to the second region may be greater than that of the heat transfer path in the direction from the first region to the outer circumferential surface from the first region. For another example, in a thickness of the tray assembly in the direction of the outer circumferential surface of the ice making cell from the center of the ice making cell, one portion of the first region may be thinner than the other portion of the first region or thinner than one portion of the second region. One portion of the first region may be a portion at which the tray case is not surrounded. The other portion of the first region may be a portion that is surrounded by the tray case. One portion of the second region may be a portion that is surrounded by the tray case. One portion of the first region may be a portion of the first region that defines the lowest end of the ice making cell. The first region may include a tray and a tray case locally surrounding the tray.

As described above, when the thickness of the first region is thin, the heat transfer in the direction of the center of the ice making cell may increase while reducing the heat transfer in the direction of the outer circumferential surface of the ice making cell. For this reason, the ice making cell defined by the first region may be locally heated.

A minimum value of the thickness of one portion of the first region may be less than that of the thickness of the other portion of the second region or less than that of one of the second region. A maximum value of the thickness of one portion of the first region may be less than that of the thickness of the other portion of the first region or less than that of the thickness of one portion of the second region. When the through-hole is defined in the region, the minimum value represents the minimum value in the remaining regions except for the portion in which the through-hole is defined. An average value of the thickness of one portion of the first region may be less than that of the thickness of the other portion of the first region or may be less than that of a thickness of one portion the second region. The uniformity of the thickness of one portion of the first region may be greater than that of the thickness of the other portion of the first region or greater than that of one of the thickness of one portion of the second region.

For example, the tray assembly may include a first portion defining at least a portion of the ice making cell and a second portion extending from a predetermined point of the first portion. The first region may be defined in the first portion. The second region may be defined in an additional tray assembly that may contact the first portion. At least a portion of the second portion may extend in a direction away from the ice making cell defined by the second region. In this case, the heat transmitted from the heater to the first region may be reduced from being transferred to the second region.

The structure and method of cooling the ice making cell in addition to the degree of cold transfer of the tray assembly may affect the making of the transparent ice. As described above, the tray assembly may include a first region and a second region, which define an outer circumferential surface of the ice making cell. For example, each of the first and second regions may be a portion of one tray assembly. For another example, the first region may be a first tray assembly. The second region may be a second tray assembly.

For a constant amount of cold supplied by the cooler and a constant amount of heat supplied by the heater, it may be advantageous to configure the cooler so that a portion of the ice making cell is more intensively cooled to increase the ice making rate of the refrigerator and/or increase the transparency of the ice. The more the cold supplied to the ice making cell by the cooler increases, the more the ice making rate may increase. However, as the cold is uniformly supplied to the outer circumferential surface of the ice making cell, the transparency of the made ice may decrease. Therefore, as the cooler more intensively cools a portion of the ice making cell, the bubbles may be moved or collected to other regions of the ice making cell, thereby increasing the transparency of the made ice and minimizing the decrease in ice making rate.

The cooler may be configured so that the amount of cold supplied to the second region differs from that of cold supplied to the first region so as to allow the cooler to more intensively cool a portion of the ice making cell. The amount of cold supplied to the second region by the cooler may be greater than that of cold supplied to the first region.

For example, the second region may be made of a metal material having a high cold transfer rate, and the first region may be made of a material having a cold transfer rate less than that of the metal.

For another example, to increase the degree of cold transfer transmitted from the storage chamber to the center of the ice making cell through the tray assembly, the second region may vary in degree of cold transfer toward the central direction. The degree of cold transfer of one portion of the second region may be greater than that of the other portion of the second region. A through-hole may be defined in one portion of the second region. At least a portion of the heat absorbing surface of the cooler may be disposed in the through-hole. A passage through which the cold air supplied from the cooler passes may be disposed in the through-hole. The one portion may be a portion that is not surrounded by the tray case. The other portion may be a portion surrounded by the tray case. One portion of the second region may be a portion defining the uppermost portion of the ice making cell in the second region. The second region may include a tray and a tray case locally surrounding the tray. As described above, when a portion of the tray assembly has a high cold transfer rate, the supercooling may occur in the tray assembly having a high cold transfer rate. As described above, designs may be needed to reduce the degree of the supercooling.

Hereinafter, a specific embodiment of the refrigerator according to an embodiment will be described with reference to the drawings.

Figure 1A:
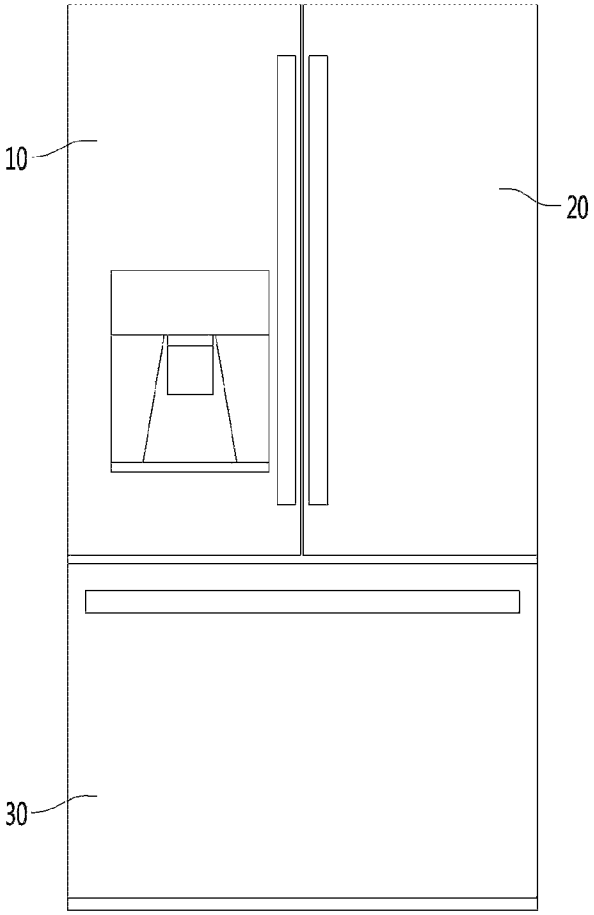

FIG. 1 is a front view of a refrigerator according to an embodiment.

Referring to FIG. 1, a refrigerator according to an embodiment may include a cabinet 14 including a storage chamber and a door that opens and closes the storage chamber. The storage chamber may include a refrigerating compartment 18 and a freezing compartment 32. The refrigerating compartment 18 is disposed at an upper side, and the freezing compartment 32 is disposed at a lower side. Each of the storage chamber may be opened and closed individually by each door. For another example, the freezing compartment may be disposed at the upper side and the refrigerating compartment may be disposed at the lower side. Alternatively, the freezing compartment may be disposed at one side of left and right sides, and the refrigerating compartment may be disposed at the other side.

The freezing compartment 32 may be divided into an upper space and a lower space, and a drawer 40 capable of being withdrawn from and inserted into the lower space may be provided in the lower space.

The door may include a plurality of doors 10, 20, 30 for opening and closing the refrigerating compartment 18 and the freezing compartment 32. The plurality of doors 10, 20, and 30 may include some or all of the doors 10 and 20 for opening and closing the storage chamber in a rotatable manner and the door 30 for opening and closing the storage chamber in a sliding manner. The freezing compartment 32 may be provided to be separated into two spaces even though the freezing compartment 32 is opened and closed by one door 30. In this embodiment, the freezing compartment 32 may be referred to as a first storage chamber, and the refrigerating compartment 18 may be referred to as a second storage chamber.

The freezing compartment 32 may be provided with an ice maker 200 capable of making ice. The ice maker 200 may be disposed, for example, in an upper space of the freezing compartment 32. An ice bin 600 in which the ice made by the ice maker 200 falls to be stored may be disposed below the ice maker 200. A user may take out the ice bin 600 from the freezing compartment 32 to use the ice stored in the ice bin 600. The ice bin 600 may be mounted on an upper side of a horizontal wall that partitions an upper space and a lower space of the freezing compartment 32 from each other. Although not shown, the cabinet 14 is provided with a duct supplying cold air to the ice maker 200 (not shown). The duct guides the cold air heat-exchanged with a refrigerant flowing through the evaporator to the ice maker 200. For example, the duct may be disposed behind the cabinet 14 to discharge the cold air toward a front side of the cabinet 14. The ice maker 200 may be disposed at a front side of the duct. Although not limited, a discharge hole of the duct may be provided in one or more of a rear wall and an upper wall of the freezing compartment 32.

Although the above-described ice maker 200 is provided in the freezing compartment 32, a space in which the ice maker 200 is disposed is not limited to the freezing compartment 32. For example, the ice maker 200 may be disposed in various spaces as long as the ice maker 200 receives the cold air. Therefore, hereinafter, the ice maker 200 will be described as being disposed in a storage chamber.

Figure 2:
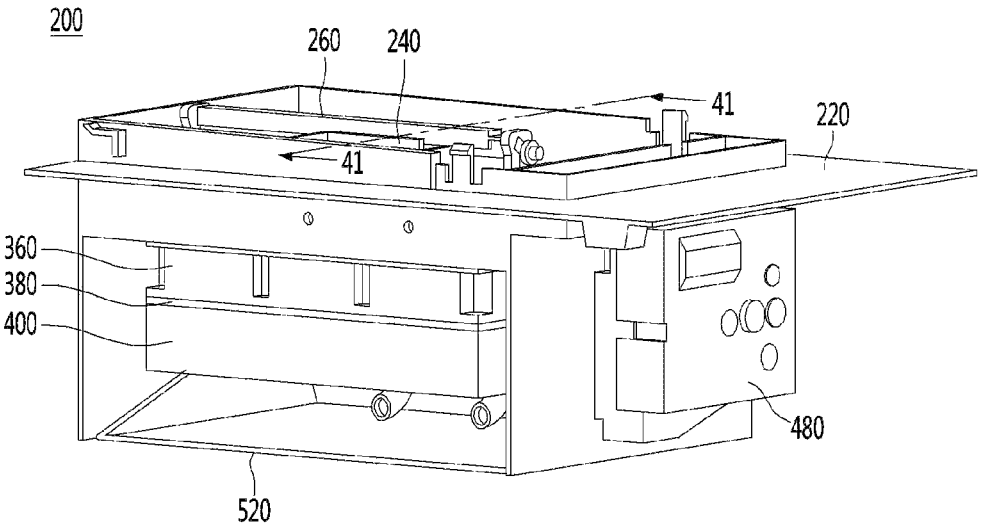
FIG. 2 is a perspective view of an ice maker according to an embodiment.
Figure 3:
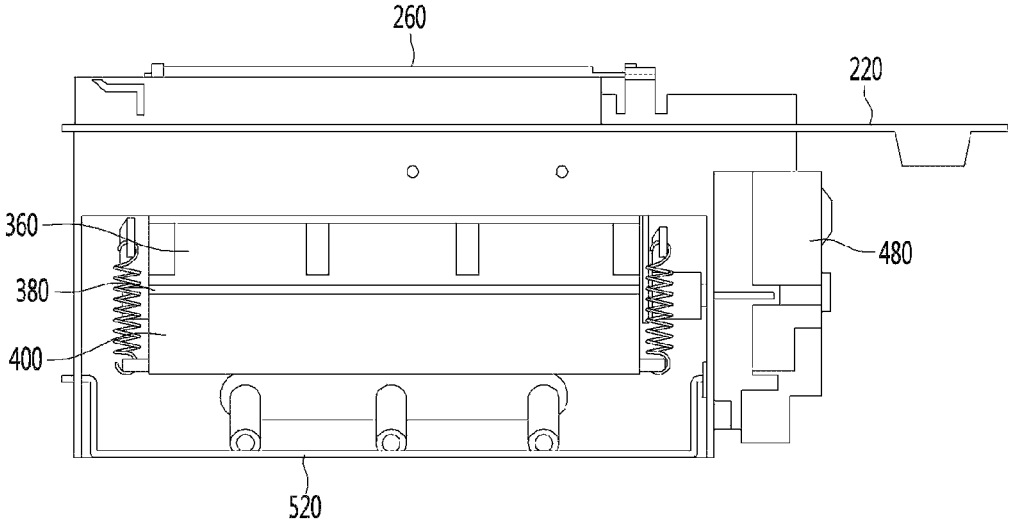
FIG. 3 is a front view of the ice maker of FIG. 2.
Figure 4:
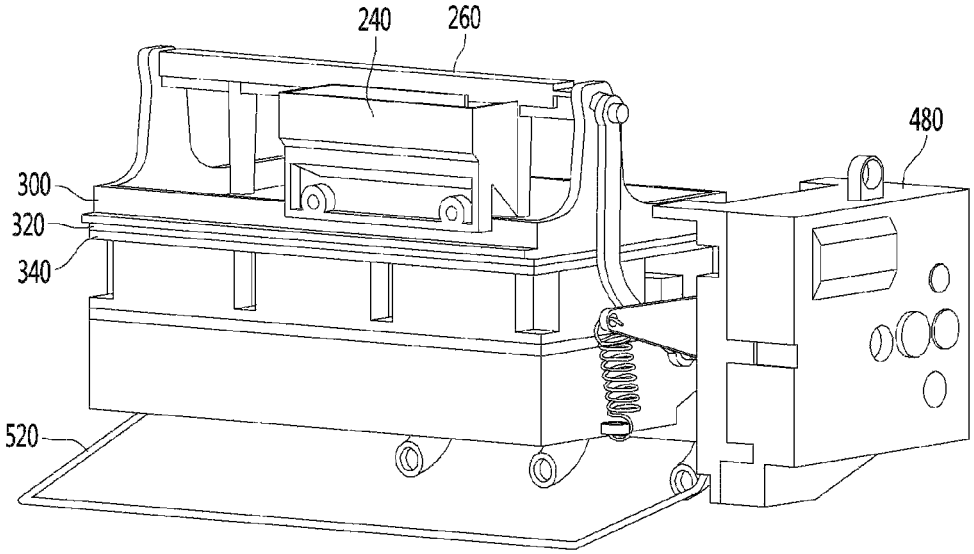
FIG. 4 is a perspective view illustrating a state in which a bracket is removed from the ice maker of FIG. 3.
Figure 5:
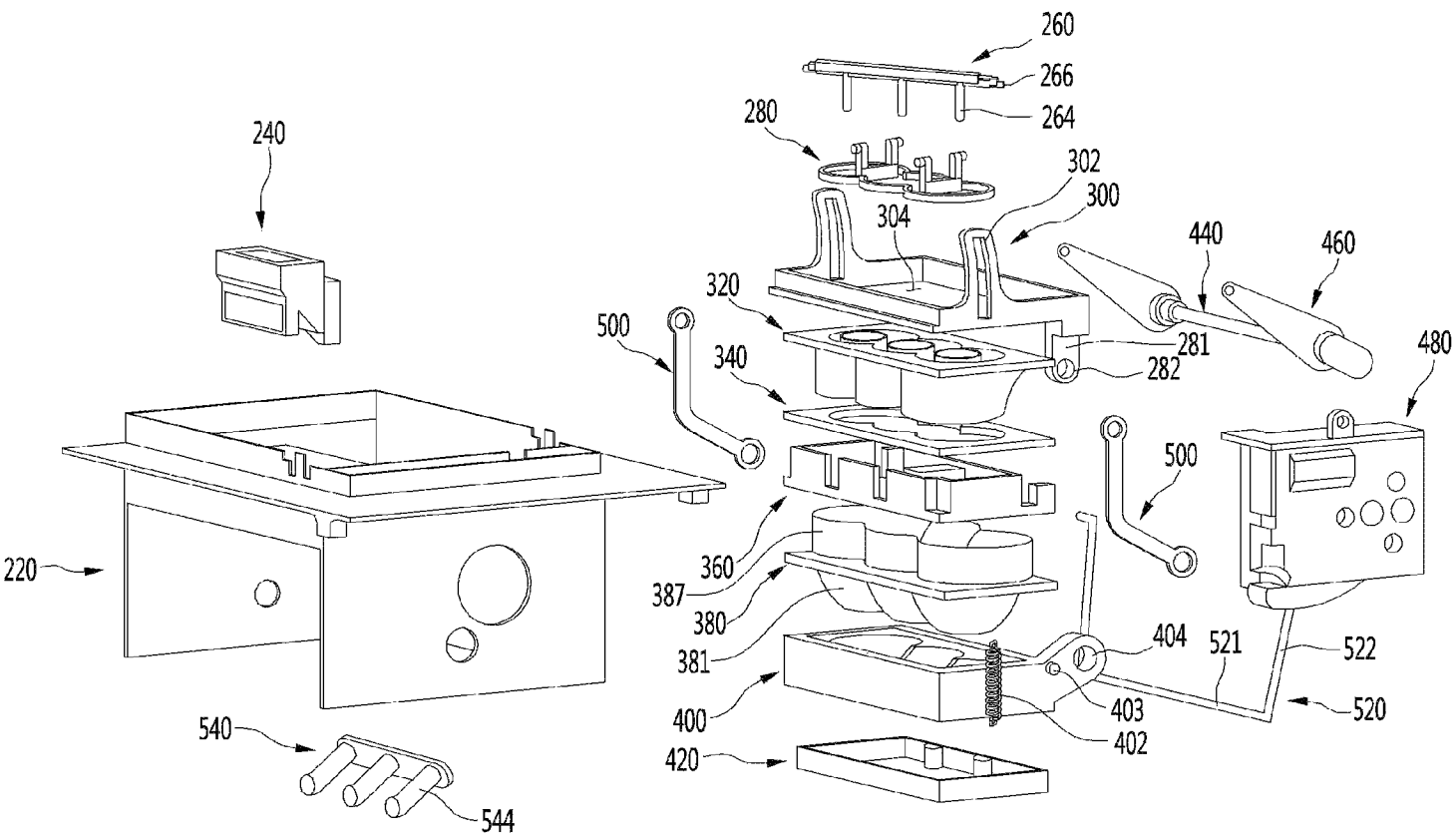
FIG. 5 is an exploded perspective view of the ice maker according to an embodiment.

FIG. 2 is a perspective view of the ice maker according to an embodiment, and FIG. 3 is a front view of the ice maker of FIG. 2. FIG. 4 is a perspective view illustrating a state in which a bracket is removed from the ice maker of FIG. 3, and FIG. 5 is an exploded perspective view of the ice maker according to an embodiment.

Referring to FIGS. 2 to 5, each component of the ice maker 200 may be provided inside or outside the bracket 220, and thus, the ice maker 200 may constitute one assembly.

The ice maker 200 may include a first tray assembly and a second tray assembly. The first tray assembly may include a first tray 320, a first tray case, or all of the first tray 320 and a first tray case. The second tray assembly may include a second tray 380, a second tray case, or all of the second tray 380 and a second tray case. The bracket 220 may define at least a portion of a space that accommodates the first tray assembly and the second tray assembly.

The bracket 220 may be supported on a wall defining a storage chamber. The bracket 220 may be installed at, for example, the upper wall of the freezing compartment 32. The bracket 220 may be provided with a water supply part 240. The water supply part 240 may guide water supplied from the upper side to the lower side of the water supply part 240. A water supply pipe (not shown) to which water is supplied may be installed above the water supply part 240.

The water supplied to the water supply part 240 may move downward. The water supply part 240 may prevent the water discharged from the water supply pipe from dropping from a high position, thereby preventing the water from splashing. Since the water supply part 240 is disposed below the water supply pipe, the water may be guided downward without splashing up to the water supply part 240, and an amount of splashing water may be reduced even if the water moves downward due to the lowered height.

Figure 49:
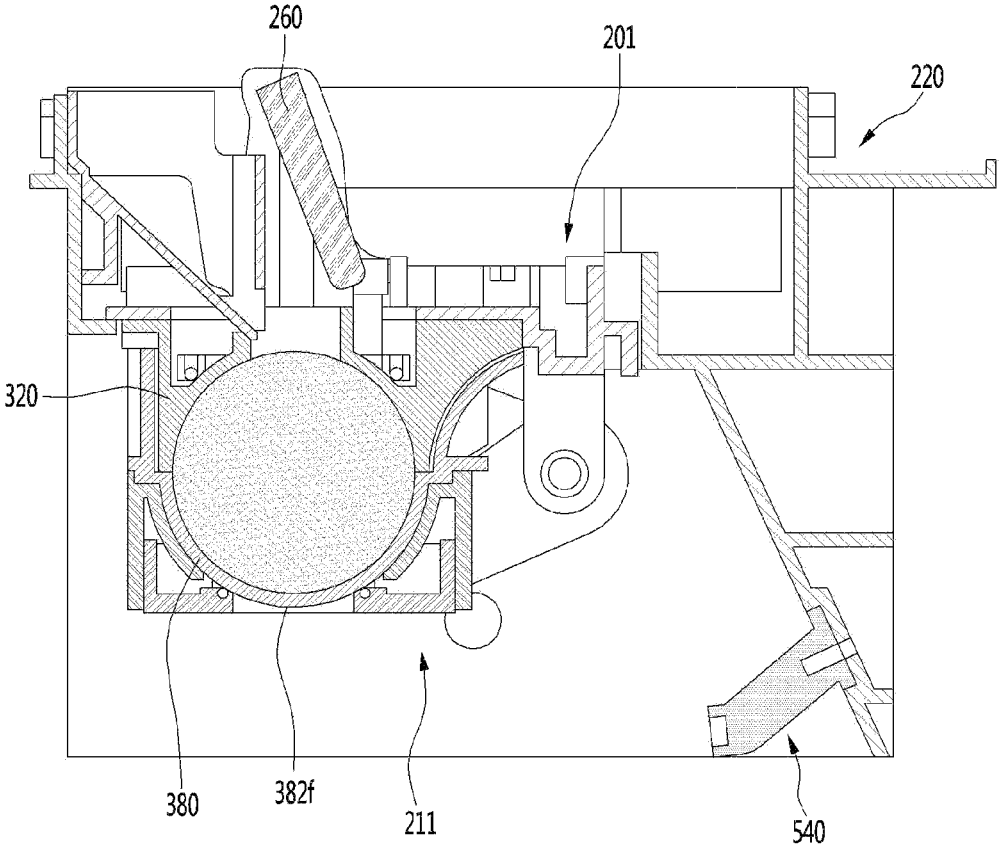
FIG. 49 is a view illustrating a state in which a pressing part of the second tray is deformed in a state in which ice making is complete.

The ice maker 200 may include an ice making cell 320*a* (as shown in FIG. 49) in which water is phase-changed into ice by the cold air. The first tray 320 may define at least a portion of the ice making cell 320*a*. The second tray 380 may define the other portion of the ice making cell 320*a*. The second tray 380 may include a second tray 380 defining the other portion of the ice making cell 320*a*. The second tray 380 may be disposed to be relatively movable with respect to the first tray 320. The second tray 380 may linearly rotate or rotate. Hereinafter, the rotation of the second tray 380 will be described as an example.

For example, in an ice making process, the second tray 380 may move with respect to the first tray 320 so that the first tray 320 and the second tray 380 contact each other. When the first tray 320 and the second tray 380 contact each other, the complete ice making cell 320*a* may be defined. On the other hand, the second tray 380 may move with respect to the first tray 320 during the ice making process after the ice making is completed, and the second tray 380 may be spaced apart from the first tray 320. In this embodiment, the first tray 320 and the second tray 380 may be arranged in a vertical direction in a state in which the ice making cell 320*a* is formed. Accordingly, the first tray 320 may be referred to as an upper tray, and the second tray 380 may be referred to as a lower tray.

A plurality of ice making cells 320*a* may be defined by the first tray 320 and the second tray 380. Hereinafter, in the drawing, three ice making cells 320*a* are provided as an example.

When water is cooled by cold air while water is supplied to the ice making cell 320*a*, ice having the same or similar shape as that of the ice making cell 320*a* may be made. In this embodiment, for example, the ice making cell 320*a* may be provided in a spherical shape or a shape similar to a spherical shape. The ice making cell 320*a* may have a rectangular parallelepiped shape or a polygonal shape.

For example, the first tray case may include the first tray supporter 340 and the first tray cover 300. The first tray supporter 340 and the first tray cover 300 may be integrally provided or coupled to each other with each other after being manufactured in separate configurations. For example, at least a portion of the first tray cover 300 may be disposed above the first tray 320. At least a portion of the first tray supporter 340 may be disposed under the first tray 320. The first tray cover 300 may be manufactured as a separate part from the bracket 220 and then may be coupled to the bracket 220 or integrally formed with the bracket 220. That is, the first tray case may include the bracket 220.

The ice maker 200 may further include a first heater case 280. An ice separation heater (see 290 of FIG. 42) may be installed in the first heater case 280. The heater case 280 may be integrally formed with the first tray cover 300 or may be separately formed.

The ice separation heater 290 may be disposed at a position adjacent to the first tray 320. The ice separation heater 290 may be, for example, a wire type heater. For example, the ice separation heater 290 may be installed to contact the first tray 320 or may be disposed at a position spaced a predetermined distance from the first tray 320. In some case, the ice separation heater 290 may supply heat to the first tray 320, and the heat supplied to the first tray 320 may be transferred to the ice making cell 320*a*. The first tray cover 300 may be provided to correspond to a shape of the ice making cell 320*a* of the first tray 320 and may contact a lower portion of the first tray 320.

The ice maker 200 may include a first pusher 260 separating the ice during an ice separation process. The first pusher 260 may receive power of the driver 480 to be described later. The first tray cover 300 may be provided with a guide slot 302 guiding movement of the first pusher 260. The guide slot 302 may be provided in a portion extending upward from the first tray cover 300. A guide connection part of the first pusher 260 to be described later may be inserted into the guide slot 302. Thus, the guide connection part may be guided along the guide slot 302.

The first pusher 260 may include at least one pushing bar 264. For example, the first pusher 260 may include a pushing bar 264 provided with the same number as the number of ice making cells 320*a*, but is not limited thereto. The pushing bar 264 may push out the ice disposed in the ice making cell 320*a* during the ice separation process. For example, the pushing bar 264 may be inserted into the ice making cell 320*a* through the first tray cover 300. Therefore, the first tray cover 300 may be provided with an opening 304 (or through-hole) through which a portion of the first pusher 260 passes.

The first pusher 260 may be coupled to a pusher link 500. In this case, the first pusher 260 may be coupled to the pusher link 500 so as to be rotatable. Therefore, when the pusher link 500 moves, the first pusher 260 may also move along the guide slot 302.

The second tray case may include, for example, a second tray cover 360 and a second tray supporter 400. The second tray cover 360 and the second tray supporter 400 may be integrally formed or coupled to each other with each other after being manufactured in separate configurations. For example, at least a portion of the second tray cover 360 may be disposed above the second tray 380. At least a portion of the second tray supporter 400 may be disposed below the second tray 380. The second tray supporter 400 may be disposed at a lower side of the second tray to support the second tray 380.

For example, at least a portion of the wall defining a second cell 381*a* of the second tray 380 may be supported by the second tray supporter 400. A spring 402 may be connected to one side of the second tray supporter 400. The spring 402 may provide elastic force to the second tray supporter 400 to maintain a state in which the second tray 380 contacts the first tray 320.

The second tray 380 may include a circumferential wall 387 surrounding a portion of the first tray 320 in a state of contacting the first tray 320. The second tray cover 360 may cover at least a portion of the circumferential wall 387.

The ice maker 200 may further include a second heater case 420. A transparent ice heater 430 to be described later may be installed in the second heater case 420. The second heater case 420 may be integrally formed with the second tray supporter 400 or may be separately provided to be coupled to the second tray supporter 400.

The ice maker 200 may further include a driver 480 that provides driving force. The second tray 380 may relatively move with respect to the first tray 320 by receiving the driving force of the driver 480. The first pusher 260 may move by receiving the driving force of the driving force 480. A through-hole 282 may be defined in an extension part 281 extending downward in one side of the first tray cover 300. A through-hole 404 may be defined in the extension part 403 extending in one side of the second tray supporter 400. At least a portion of the through-hole 404 may be disposed at a position higher than a horizontal line passing through a center of the ice making cell 320*a*.

The ice maker 200 may further include a shaft 440 (or a rotation shaft) that passes through the through-holes 282 and 404 together. A rotation arm 460 may be provided at each of both ends of the shaft 440. The shaft 440 may rotate by receiving rotational force from the driver 480. One end of the rotation arm 460 may be connected to one end of the spring 402, and thus, a position of the rotation arm 460 may move to an initial value by restoring force when the spring 402 is tensioned.

The driver 480 may include a motor and a plurality of gears. A full ice detection lever 520 may be connected to the driver 480. The full ice detection lever 520 may also rotate by the rotational force provided by the driver 480.

The full ice detection lever 520 may have a 'C' shape as a whole. For example, the full ice detection lever 520 may include a first lever 521 and a pair of second levers 522 extending in a direction crossing the first lever 521 at both ends of the first lever 521. One of the pair of second levers 522 may be coupled to the driver 480, and the other may be coupled to the bracket 220 or the first tray cover 300. The full ice detection lever 520 may rotate to detect ice stored in the ice bin 600.

The driver 480 may further include a cam that rotates by the rotational power of the motor. The ice maker 200 may further include a sensor that senses the rotation of the cam. For example, the cam is provided with a magnet, and the sensor may be a hall sensor detecting magnetism of the magnet during the rotation of the cam. The sensor may output first and second signals that are different outputs according to whether the sensor senses a magnet. One of the first signal and the second signal may be a high signal, and the other may be a low signal. The controller 800 to be described later may determine a position of the second tray 380 (or the second tray assembly) based on the type and pattern of the signal outputted from the sensor. That is, since the second tray 380 and the cam rotate by the motor, the position of the second tray 380 may be indirectly determined based on a detection signal of the magnet provided in the cam. For example, a water supply position, an ice making position, and an ice separation position, which will be described later, may be distinguished and determined based on the signals outputted from the sensor.

The ice maker 200 may further include a second pusher 540. The second pusher 540 may be installed, for example, on the bracket 220. The second pusher 540 may include at least one pushing bar 544. For example, the second pusher 540 may include a pushing bar 544 provided with the same number as the number of ice making cells 320*a*, but is not limited thereto.

The pushing bar 544 may push out the ice disposed in the ice making cell 320*a*. For example, the pushing bar 544 may pass through the second tray supporter 400 to contact the second tray 380 defining the ice making cell 320*a* and then press the contacting second tray 380. The first tray cover 300 may be rotatably coupled to the second tray supporter 400 with respect to the second tray supporter 400 and then be disposed to change in angle about the shaft 440.

In this embodiment, the second tray 380 may be made of a non-metal material. For example, when the second tray 380 is pressed by the second pusher 540, the second tray 380 may be made of a flexible or soft material which is deformable. Although not limited, the second tray 380 may be made of, for example, a silicone material. Therefore, while the second tray 380 is deformed while the second tray 380 is pressed by the second pusher 540, pressing force of the second pusher 540 may be transmitted to ice. The ice and the second tray 380 may be separated from each other by the pressing force of the second pusher 540.

When the second tray 380 is made of the non-metal material and the flexible or soft material, the coupling force or attaching force between the ice and the second tray 380 may be reduced, and thus, the ice may be easily separated from the second tray 380. Also, if the second tray 380 is made of the non-metallic material and the flexible or soft material, after the shape of the second tray 380 is deformed by the second pusher 540, when the pressing force of the second pusher 540 is removed, the second tray 380 may be easily restored to its original shape.

For another example, the first tray 320 may be made of a metal material. In this case, since the coupling force or the attaching force between the first tray 320 and the ice is strong, the ice maker 200 according to this embodiment may include at least one of the ice separation heater 290 or the first pusher 260. For another example, the first tray 320 may be made of a non-metallic material. When the first tray 320 is made of the non-metallic material, the ice maker 200 may include only one of the ice separation heater 290 and the first pusher 260. Alternatively, the ice maker 200 may not include the ice separation heater 290 and the first pusher 260. Although not limited, the first tray 320 may be made of, for example, a silicone material. That is, the first tray 320 and the second tray 380 may be made of the same material.

When the first tray 320 and the second tray 380 are made of the same material, the first tray 320 and the second tray 380 may have different hardness to maintain sealing performance at the contact portion between the first tray 320 and the second tray 380.

In this embodiment, since the second tray 380 is pressed by the second pusher 540 to be deformed, the second tray 380 may have hardness less than that of the first tray 320 to facilitate the deformation of the second tray 380.

Figure 6:
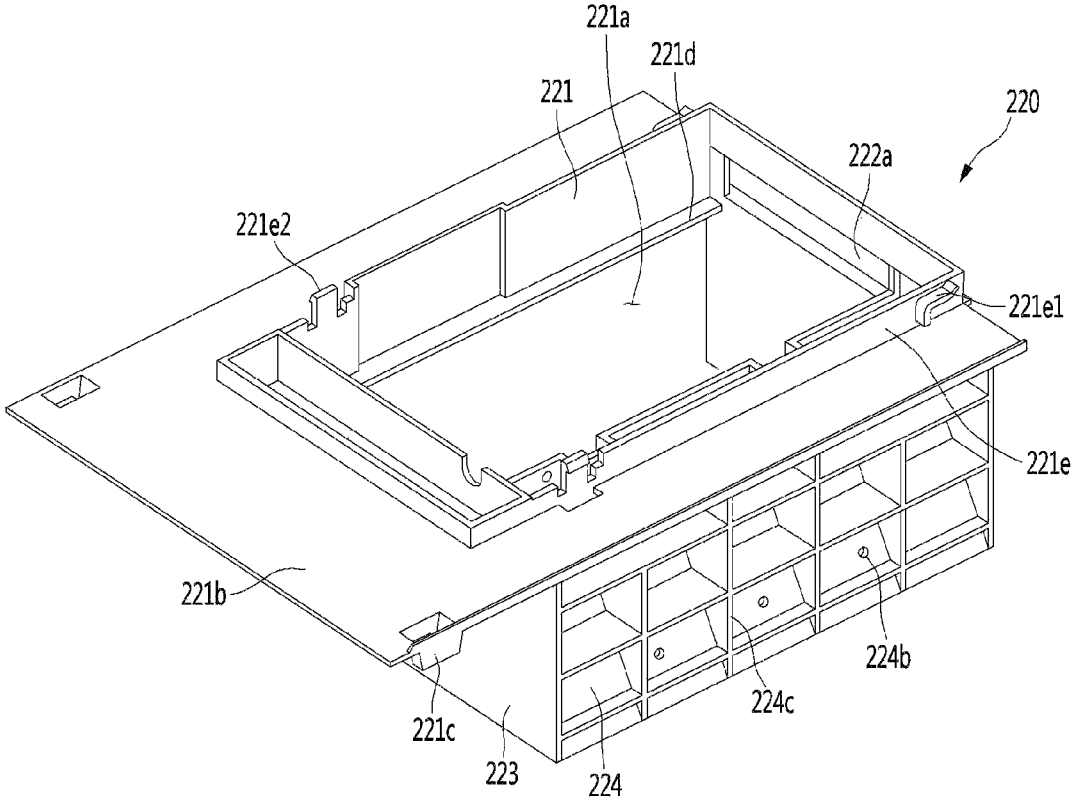
FIGS. 6 and 7 are perspective views of the bracket according to an embodiment.
Figure 7:
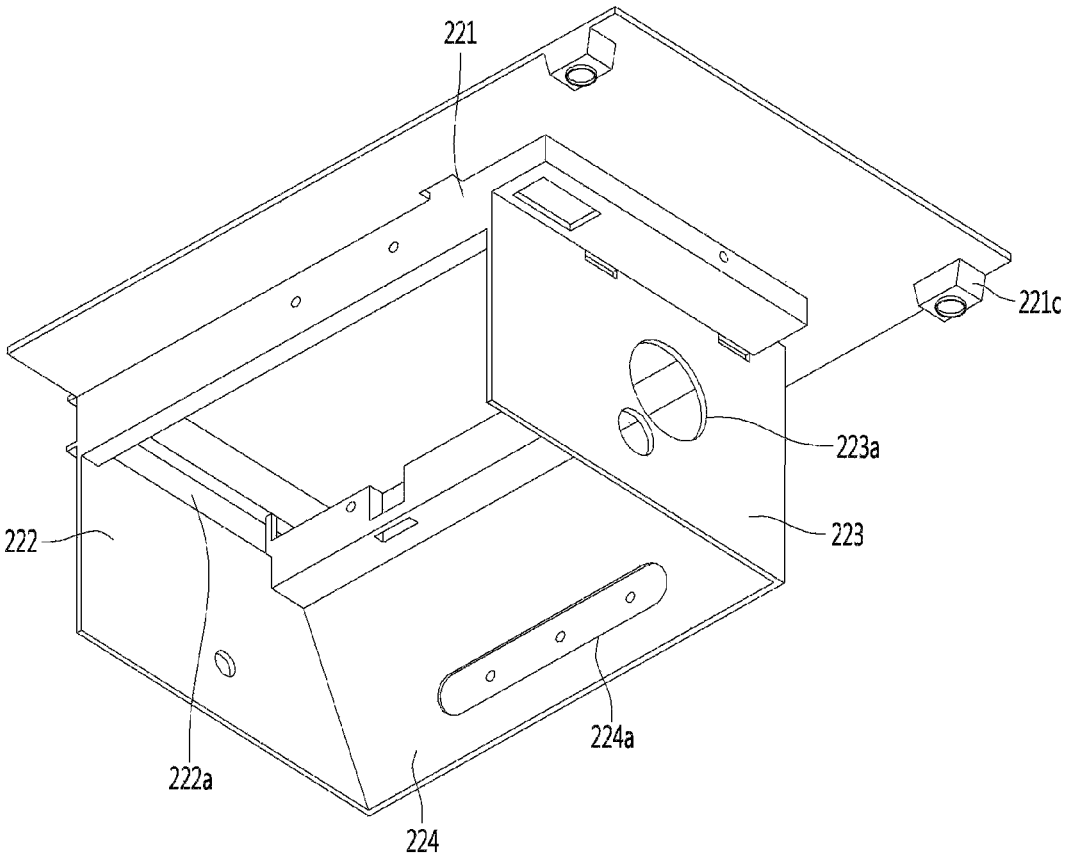

FIGS. 6 and 7 are perspective views of the bracket according to an embodiment.

Referring to FIGS. 6 and 7, the bracket 220 may be fixed to at least one surface of the storage chamber or to a cover member (to be described later) fixed to the storage chamber.

The drawer 40 movable in a forward-and-backward direction may be located below the bracket 220.

The bracket 220 may include a first wall 221 having a through-hole 221*a* defined therein. At least a portion of the first wall 221 may extend in a horizontal direction. The first wall 221 may include a first fixing wall 221*b* to be fixed to one surface of the storage chamber or the cover member. At least a portion of the first fixing wall 221*b* may extend in the horizontal direction. The first fixing wall 221*b* may also be referred to as a horizontal fixing wall. One or more fixing protrusions 221*c* may be provided on the first fixing wall 221*b*. A plurality of fixing protrusions 221*c* may be provided on the first fixing wall 221*b* to firmly fix the bracket 220. The first wall 221 may further include a second fixing wall 221*e* to be fixed to one surface of the storage chamber or the cover member. At least a portion of the second fixing wall 221*e* may extend in a vertical direction. The second fixing wall 221*e* may also be referred to as a vertical fixing wall. The second fixing wall 221*e* may extend upward from the first fixing wall 221*b*. The second fixing wall 221*e* may include a fixing rib 221*e*1 and/or a hook 221*e*2. In this embodiment, the first wall 221 may include at least one of the first fixing wall 221*b* or the second fixing wall 221*e* to fix the bracket 220. The first wall 221 may be provided in a shape in which a plurality of walls are stepped in the vertical direction. In one example, a plurality of walls may be arranged with a height difference in the horizontal direction, and the plurality of walls may be connected by a vertical connection wall. The first wall 221 may further include a support wall 221*d* supporting the first tray assembly. At least a portion of the support wall 221*d* may extend in the horizontal direction. The support wall 221*d* may be disposed at the same height as the first fixing wall 221*b* or disposed at a different height. In FIG. 6, for example, the support wall 221*d* is disposed at a position lower than that of the first fixing wall 221*b*.

The bracket 220 may further include a second wall 222 having a through-hole 222*a* through which cold air generated by a cooling part passes. The second wall 222 may extend from the first wall 221. At least a portion of the second wall 222 may extend in the vertical direction. At least a portion of the through-hole 222*a* may be disposed at a position higher than that of the support wall 221*d*. In FIG. 6, for example, the lowermost end of the through-hole 222*a* is disposed at a position higher than that of the support wall 221*d*.

The bracket 220 may further include a third wall 223 on which the driver 480 is installed. The third wall 223 may extend from the first wall 221. At least a portion of the third wall 223 may extend in the vertical direction. At least a portion of the third wall 223 may be disposed to face the second wall 222 while being spaced apart from the second wall 222. At least a portion of the ice making cell 320*a* may be disposed between the second wall 222 and the third wall 223. Alternatively, the driver 480 may be installed on the third wall 223 so that the third wall 223 is disposed between the second wall 222 and the driver 480. In this case, a shaft hole 223*a* through which a shaft of the motor constituting the driver 480 passes may be defined in the third wall 223. FIG. 7 illustrates that the shaft hole 223*a* is defined in the third wall 223.

The bracket 220 may further include a fourth wall 224 to which the second pusher 540 is fixed. The fourth wall 224 may extend from the first wall 221. The fourth wall 224 may connect the second wall 222 to the third wall 223. The fourth wall 224 may be inclined at an angle with respect to the horizontal line and the vertical line. For example, the fourth wall 224 may be inclined in a direction away from the shaft hole 223*a* from the upper side to the lower side. The fourth wall 224 may extend in a direction away from a vertical center line passing through the center of the ice making cell 320*a* from the upper side to the lower side.

The fourth wall 224 may be provided with a mounting groove 224*a* in which the second pusher 540 is mounted. The mounting groove 224*a* may be provided with a coupling hole 224*b* through which a coupling part coupled to the second pusher 540 passes.

The second tray 380 and the second pusher 540 may contact each other while the second tray assembly rotates while the second pusher 540 is fixed to the fourth wall 224. Ice may be separated from the second tray 380 while the second pusher 540 presses the second tray 380. When the second pusher 540 presses the second tray 380, the ice also presses the second pusher 540 before the ice is separated from the second tray 380. Force for pressing the second pusher 540 may be transmitted to the fourth wall 224. Since the fourth wall 224 is provided in a thin plate shape, a strength reinforcement member 224*c* may be provided on the fourth wall 224 to prevent the fourth wall 224 from being deformed or broken. For example, the strength reinforcement member 224*c* may include ribs disposed in a lattice form. That is, the strength reinforcement member 224*c* may include a first rib extending in the first direction and a second rib extending in a second direction crossing the first direction.

The degree of deformation resistance of an upper portion of a place, in which the second pusher 540 is located, of the strength reinforcement member 224*c* may be greater than that of a lower portion of the place, in which the second pusher is located.

In this embodiment, two or more of the first to fourth walls 221 to 224 may define a space in which the first and second tray assemblies are disposed.

It should be noted that the names of the walls configuring the bracket 220 are exemplary and the terms distinguishing between the walls are not limited.

Figure 8:
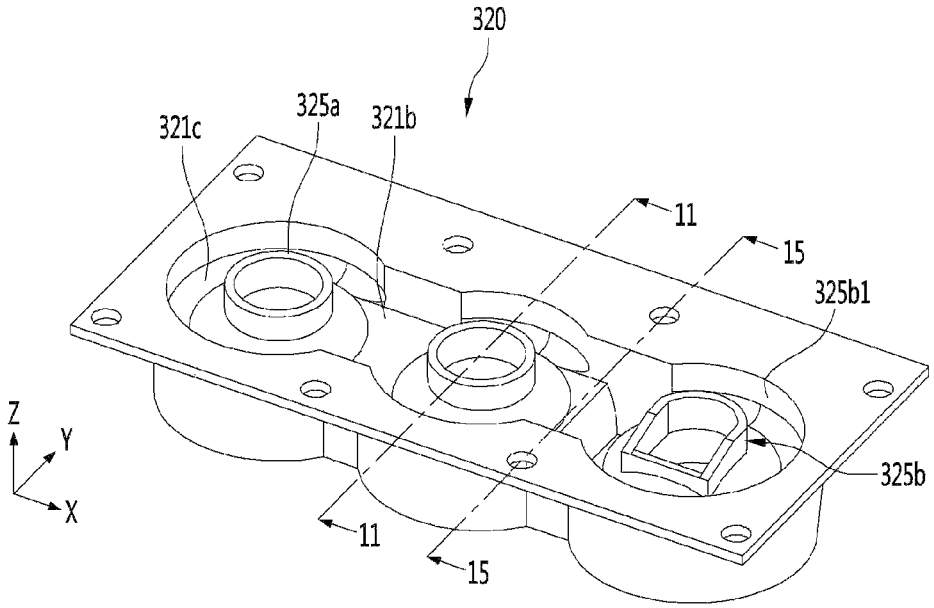
FIG. 8 is a perspective view of a first tray when viewed from an upper side.
Figure 9:
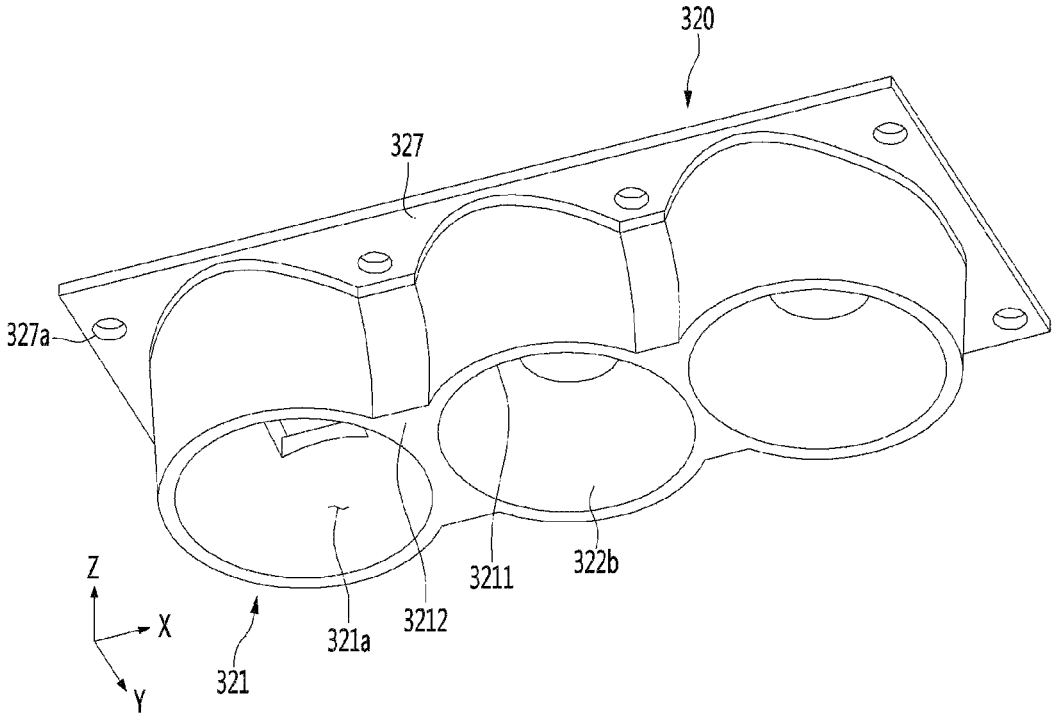
FIG. 9 is a perspective view of the first tray when viewed from a lower side.
Figure 10:
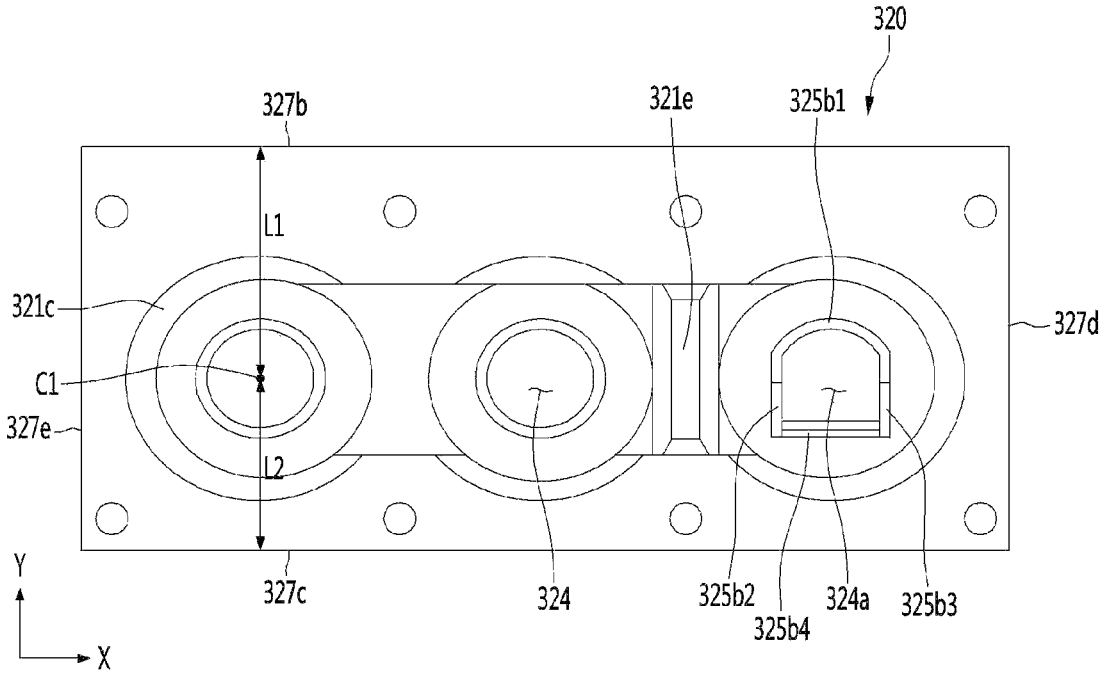
FIG. 10 is a plan view of the first tray.
Figure 11:
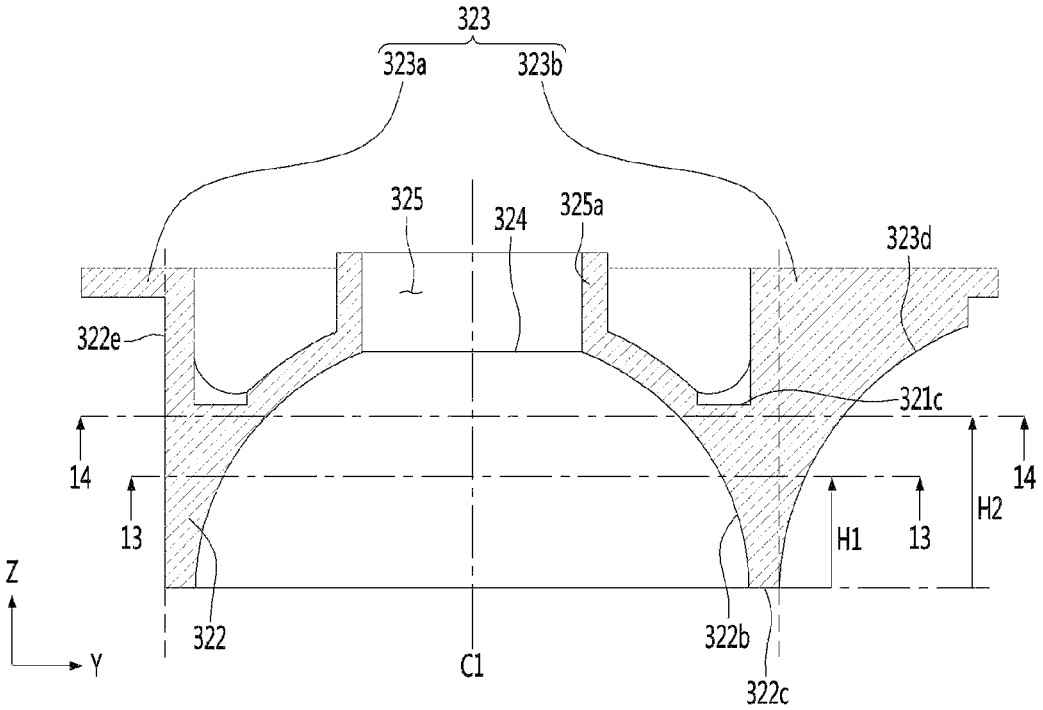
FIG. 11 is a cross-sectional view taken along line 11-11 of FIG. 8.

FIG. 8 is a perspective view of the first tray when viewed from an upper side, and FIG. 9 is a perspective view of the first tray when viewed from a lower side. FIG. 10 is a plan view of the first tray. FIG. 11 is a cross-sectional view taken along line 11-11 of FIG. 8.

Referring to FIGS. 8 to 10, the first tray 320 may define a first cell 321*a* that is a portion of the ice making cell 320*a*. The first tray 320 may include a first tray wall 321 defining a portion of the ice making cell 320*a*.

For example, the first tray 320 may define a plurality of first cells 321*a*. For example, the plurality of first cells 321*a* may be arranged in a line. The plurality of first cells 321*a* may be arranged in an X-axis direction in FIG. 9. For example, the first tray wall 321 may define the plurality of first cells 321*a*.

The first tray wall 321 may include a plurality of first cell walls 3211 that respectively define the plurality of first cells 321*a*, and a connector 3212 connecting the plurality of first cell walls 3211 to each other. The first tray wall 321 may be a wall extending in the vertical direction. The first tray 320 may include an opening 324. The opening 324 may communicate with the first cell 321*a*. The opening 324 may allow the cold air to be supplied to the first cell 321*a*. The opening 324 may allow water for making ice to be supplied to the first cell 321*a*. The opening 324 may provide a passage through which a portion of the first pusher 260 passes. For example, in the ice separation process, a portion of the first pusher 260 may be inserted into the ice making cell 320*a* through the opening 324. The first tray 320 may include a plurality of openings 324 corresponding to the plurality of first cells 321*a*. One of the plurality of openings 324 may provide a passage of the cold air, a passage of the water, and a passage of the first pusher 260. In the ice making process, the bubbles may escape through the opening 324.

The first tray 320 may include a case accommodation part 321*b*. For example, a portion of the first tray wall 321 may be recessed downward to provide the case accommodation part 321*b*. At least a portion of the case accommodation part 321*b* may be disposed to surround the opening 324. A bottom surface of the case accommodation part 321*b* may be disposed at a position lower than that of the opening 324.

The first tray 320 may further include an auxiliary storage chamber 325 communicating with the ice making cell 320*a*. For example, the auxiliary storage chamber 325 may store water overflowed from the ice making cell 320*a*. The ice expanded in a process of phase-changing the supplied water may be disposed in the auxiliary storage chamber 325. That is, the expanded ice may pass through the opening 324 and be disposed in the auxiliary storage chamber 325. The auxiliary storage chamber 325 may be defined by a storage chamber wall 325*a*. The storage chamber wall 325*a* may extend upwardly around the opening 324. The storage chamber wall 325*a* may have a cylindrical shape or a polygonal shape. Substantially, the first pusher 260 may pass through the opening 324 after passing through the storage chamber wall 325*a*. The storage chamber wall 325*a* may define the auxiliary storage chamber 325 and also reduce deformation of the periphery of the opening 324 in the process in which the first pusher 260 passes through the opening 324 during the ice separation process. When the first tray 320 defines a plurality of first cells 321*a*, at least one 325*b* of the plurality of storage chamber walls 325*a* may support the water supply part 240. The storage chamber wall 325*b* supporting the water supply part 240 may have a polygonal shape. For example, the storage chamber wall 325*b* may include a round part rounded in a horizontal direction and a plurality of straight portions. For example, the storage chamber wall 325*b* may include a round wall 325*b*1, a pair of straight walls 325*b*2 and 325*b*3 extending side by side from both ends of the round wall 325*b*1, and a connection wall 325*b*4 connecting the pair of straight walls 325*b*2 to each other. The connection wall 325*b*4 may be a rounded wall or a straight wall. An upper end of the connection wall 325*b*4 may be disposed at a position lower than that of an upper end of the remaining walls 325*b*1, 325*b*2, and 325*b*3. The connection wall 325*b*4 may support the water supply part 240. An opening 324*a* corresponding to the storage chamber wall 325*b* supporting the water supply part 240 may also be defined in the same shape as the storage chamber wall 325*b*.

The first tray 320 may further include a heater accommodation part 321*c*. The ice separation heater 290 may be accommodated in the heater accommodation part 321*c*. The ice separation heater 290 may contact a bottom surface of the heater accommodation part 321*c*. The heater accommodation part 321*c* may be provided on the first tray wall 321 as an example. The heater accommodation part 321*c* may be recessed downward from the case accommodation part 321*b*. The heater accommodation part 321*c* may be disposed to surround the periphery of the first cell 321*a*. For example, at least a portion of the heater accommodation part 321*c* may be rounded in the horizontal direction. The bottom surface of the heater accommodating portion 321*c* may be disposed at a position lower than that of the opening 324.

The first tray 320 may include a first contact surface 322*c* contacting the second tray 380. The bottom surface of the heater accommodating portion 321*c* may be disposed between the opening 324 and the first contact surface 322*c*. At least a portion of the heater accommodation part 321*c* may be disposed to overlap the ice making cell 320*a* (or the first cell 321*a*) in a vertical direction.

The first tray 320 may further include a first extension wall 327 extending in the horizontal direction from the first tray wall 321. For example, the first extension wall 327 may extend in the horizontal direction around an upper end of the first tray wall 321. One or more first coupling holes 327*a* may be provided in the first extension wall 327. Although not limited, the plurality of first coupling holes 327*a* may be arranged in one or more axes of the X axis and the Y axis. An upper end of the storage chamber wall 325*b* may be disposed at the same height or higher than a top surface of the first extension wall 327.

Referring to FIG. 10, the first extension wall 327 may include a first edge line 327*b* and a second edge line 327*c*, which are spaced apart from each other in a Y direction with respect to a central line C1 (or the vertical central line) in the Z axis direction in the ice making cell 320*a*. In this specification, the "central line" is a line passing through a volume center of the ice making cell 320*a* or a center of gravity of water or ice in the ice making cell 320*a* regardless of the axial direction. The first edge line 327*b* and the second edge line 327*c* may be parallel to each other. A distance L1 from the central line C1 to the first edge line 327*b* is longer than a distance L2 from the central line C1 to the first edge line 327*b*.

The first extension wall 327 may include a third edge line 327*d* and a fourth edge line 327*e*, which are spaced apart from each other in the X direction in the ice making cell 320*a*. The third edge line 327*d* and the fourth edge line 327*e* may be parallel to each other. A length of each of the third edge line 327*d* and the fourth edge line 327*e* may be shorter than a length of each of the first edge line 327*b* and the second edge line 327*c*.

The length of the first tray 320 in the X-axis direction may be referred to as a length of the first tray, the length of the first tray 320 in the Y-axis direction may be referred to as a width of the first tray, and the length of the first tray 320 in the Z-axis direction may be referred to as a height of the first tray 320.

In this embodiment, an X-Y-axis cutting surface may be a horizontal plane.

When the first tray 320 includes the plurality of first cells 321*a*, the length of the first tray 320 may be longer, but the width of the first tray 320 may be shorter than the length of the first tray 320 to prevent the volume of the first tray 320 from increasing.

Figure 12:
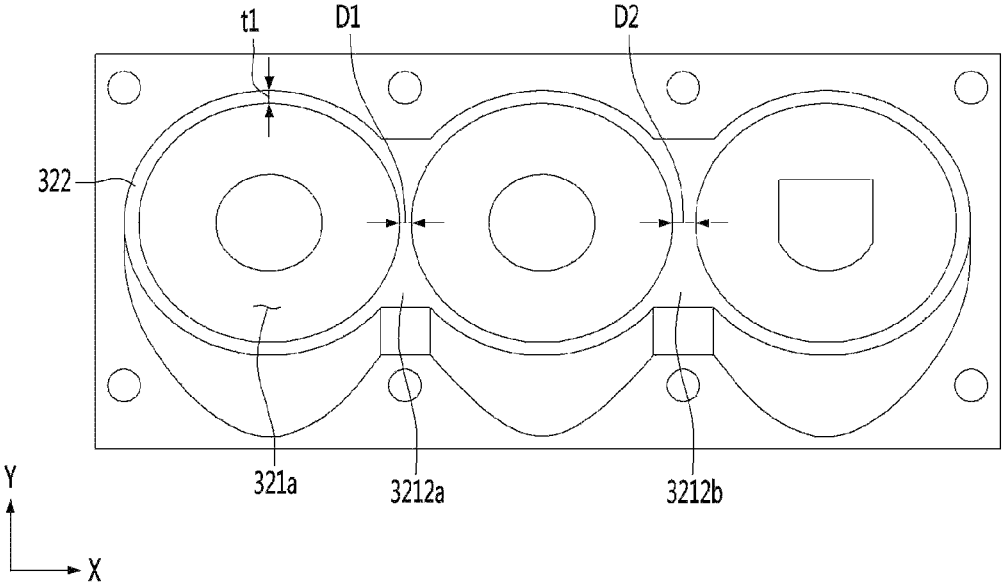
FIG. 12 is a bottom view of the first tray of FIG. 9.
Figure 13:
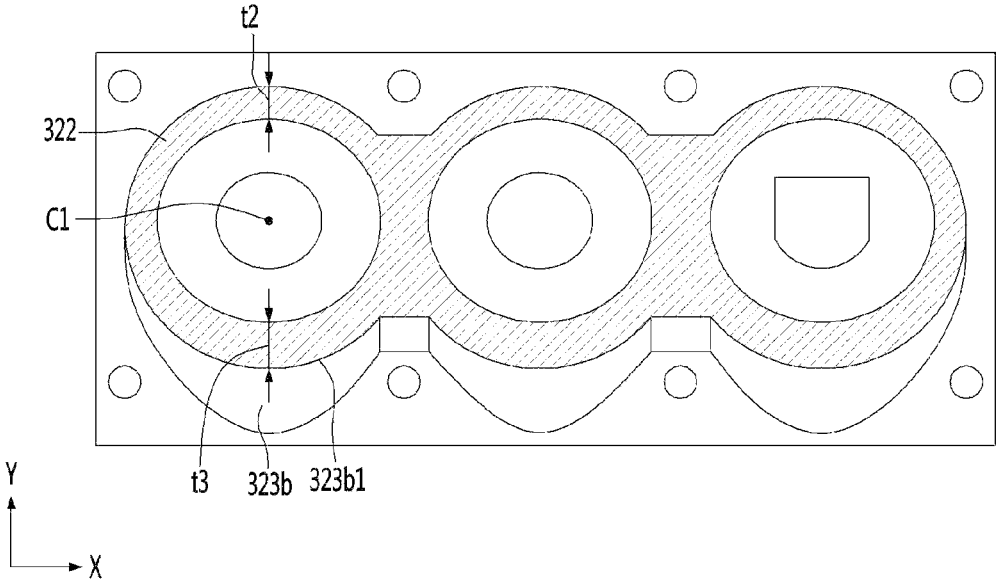
FIG. 13 is a cross-sectional view taken along line 13-13 of FIG. 11.
Figure 14:
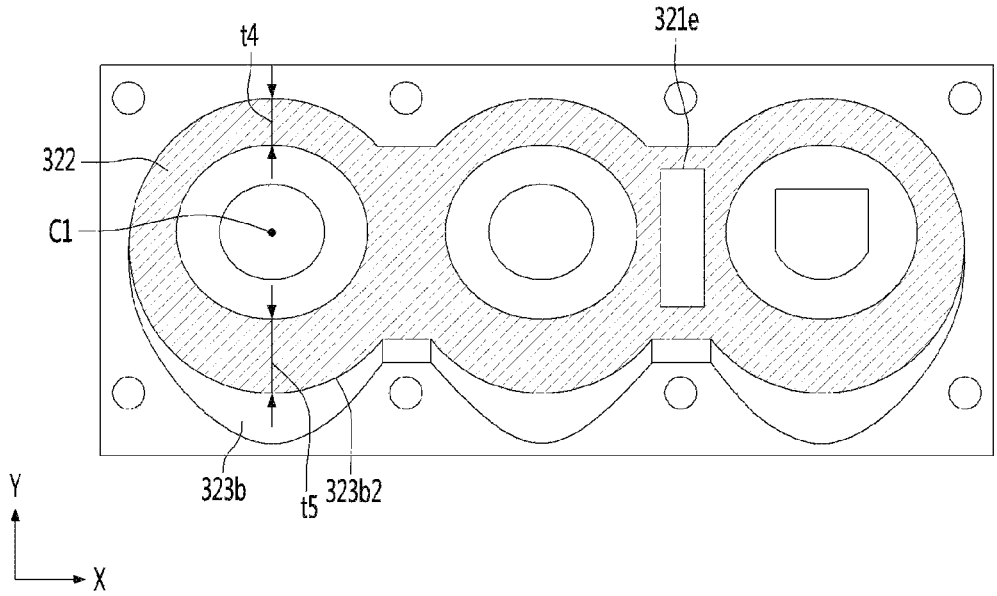
FIG. 14 is a cross-sectional view taken along line 14-14 of FIG. 11.

FIG. 12 is a bottom view of the first tray of FIG. 9, FIG. 13 is a cross-sectional view taken along line 13-13 of FIG. 11, and FIG. 14 is a cross-sectional view taken along line 14-14 of FIG. 11.

Referring to FIGS. 11 to 14, the first tray 320 may include a first portion 322 that defines a portion of the ice making cell 320*a*. For example, the first portion 322 may be a portion of the first tray wall 321. The first portion 322 may include a first cell surface 322*b* (or an outer circumferential surface of the ice making cell) defining the first cell 321*a*. The first cell 321 may be divided into a first region defined close to the transparent ice heater 430 and a second region defined far from the transparent ice heater 430 in the Z axis direction.

The first region may include the first contact surface 322*c*, and the second region may include the opening 324. The first portion 322 may be defined as an area between two dotted lines in FIG. 11. The first portion 322 may include the opening 324. Also, the first portion 322 may include the heater accommodation part 321*c*. In a degree of deformation resistance from the center of the ice making cell 320*a* in the circumferential direction, at least a portion of the upper portion of the first portion 322 is greater than at least a portion of the lower portion. The degree of deformation resistance of at least a portion of the upper portion of the first portion 322 is greater than that of the lowermost end of the first portion 322. The upper and lower portions of the first portion 322 may be divided based on the extension direction of the central line C1. The lowermost end of the first portion 322 is the first contact surface 322*c* contacting the second tray 380.

The first tray 320 may further include a second portion 323 extending from a predetermined point of the first portion 322. The predetermined point of the first portion 322 may be one end of the first portion 322. Alternatively, the predetermined point of the first portion 322 may be one point of the first contact surface 322*c*. A portion of the second portion 323 may be defined by the first tray wall 321, and the other portion of the second portion 323 may be defined by the first extension wall 327. At least a portion of the second portion 323 may extend in a direction away from the transparent ice heater 430. At least a portion of the second portion 323 may extend upward from the first contact surface 322*c*. At least a portion of the second portion 323 may extend in a direction away from the central line C1. For example, the second portion 323 may extend in both directions along the Y axis from the central line C1. The second portion 323 may be disposed at a position higher than or equal to the uppermost end of the ice making cell 320*a*. The uppermost end of the ice making cell 320*a* is a portion at which the opening 324 is defined.

The second portion 323 may include a first extension part 323*a* and a second extension part 323*b*, which extend in different directions with respect to the central line C1. The first tray wall 321 may include one portion of the second extension part 323*b* of each of the first portion 322 and the second portion 323. The first extension wall 327 may include the other portion of each of the first extension part 323*a* and the second extension part 323*b*.

Referring to FIG. 11, the first extension part 323*a* may be disposed at the left side with respect to the central line C1, and the second extension part 323*b* may be disposed at the right side with respect to the central line C1.

The first extension part 323*a* and the second extension part 323*b* may have different shapes based on the central line C1. The first extension part 323*a* and the second extension part 323*b* may be provided in an asymmetrical shape with respect to the central line C1. A length of the second extension part 323*b* in the Y-axis direction may be greater than that of the first extension part 323*a*. Therefore, while the ice is made and grown from the upper side in the ice making process, the degree of deformation resistance of the second extension part 323*b* may increase. The first extension part 323*a* may be disposed closer to an edge part that is disposed at a side opposite to the portion of the second wall 222 or the third wall 223 of the bracket 220, which is connected to the fourth wall 224, than the second extension part 323*b*.

The second extension part 323*b* may be disposed closer to the shaft 440 that provides a center of rotation of the second tray assembly than the first extension part 323*a*. In this embodiment, since the length of the second extension part 323*b* in the Y-axis direction is greater than that of the first extension part 323*a*, the second tray assembly including the second tray 380 contacting the first tray 320 may increase in radius of rotation. When the rotation radius of the second tray assembly increases, centrifugal force of the second tray assembly may increase. Thus, in the ice separation process, separating force for separating the ice from the second tray assembly may increase to improve ice separation performance.

Referring to FIGS. 11 to 14, the thickness of the first tray wall 321 is minimized at a side of the first contact surface 322*c*. At least a portion of the first tray wall 321 may increase in thickness from the first contact surface 322*c* toward the upper side. Since the thickness of the first tray wall 321 increases upward, a portion of the first portion 322 defined by the first tray wall 321 serves as a deformation resistance reinforcement part (or a first deformation resistance reinforcement part). In addition, the second portion 323 extending outward from the first portion 322 serves as a deformation resistance reinforcement part (or a second deformation resistance reinforcement part).

The deformation resistance reinforcement parts may be directly or indirectly supported on the bracket 220. The deformation resistance reinforcement parts may be, for example, connected to the first tray case and supported by the bracket 220. In this case, a portion contacting the deformation resistance reinforcement part of the first tray 320 in the first tray case may also serve a deformation resistance reinforcement part.

Such deformation resistance reinforcement parts may enable ice to be made in a direction from the first cell 321*a* defined by the first tray 320 to the second cell 381*a* defined by the second tray 380 in the ice making process.

FIG. 13 illustrates a thickness of the first tray wall 321 at a first height H1 from the first contact surface 322*c*, and FIG. 14 illustrates a thickness of the first tray wall 321 at a second height H2 from the first contact surface 322*c*.

Each of the thicknesses t2 and t3 of the first tray wall 321 at the first height H1 from the first contact surface 322*c* may be greater than the thickness t1 at the first contact surface 322*c* of the first tray wall 321. The thicknesses t2 and t3 of the first tray wall 321 at the first height H1 from the first contact surface 322*c* may not be constant in the circumferential direction. At the first height H1 from the first contact surface 322*c*, the first tray wall 321 further includes a portion of the second portion 323. Thus, the thickness t3 of the portion at which the second extension part 323*b* is disposed may be greater than the thickness t2 on the opposite side of the second extension part 323*b* with respect to the central line C1. The thicknesses t4 and t5 of the first tray wall 321 at the second height H2 from the first contact surface 322*c* may be greater than the thicknesses t2 and t3 of the first tray 321 at the first height H1 of the first tray wall 321. The thicknesses t4 and t5 of the first tray wall 321 at the second height H2 from the first contact surface 322*c* may not be constant in the circumferential direction. At the second height H2 from the first contact surface 322*c*, the first tray wall 321 further includes a portion of the second portion 323. Thus, the thickness t5 of the portion at which the second extension part 323*b* is disposed may be greater than the thickness t4 on the opposite side of the second extension part 323*b* with respect to the central line C1.

At least a portion of the outer line of the first tray wall 321 may have a non-zero curvature with respect to the X-Y axis cutting surface of the first tray wall 321, and thus, the curvature may vary. In this embodiment, the line represents a straight line having zero curvature. A curvature greater than zero represents a curve.

Referring to FIG. 12, a circumference of an outer line at the first contact surface 322*c* of the first tray wall 321 may have a constant curvature. That is, an amount of change in curvature around the outer line of the first tray wall 321 on the first contact surface 322*c* may be zero.

Referring to FIG. 13, at the first height H1 from the first contact surface 322*c*, an amount of change in curvature of at least a portion of the outer line of the first tray wall 321 may be greater than zero. That is, at the first height H1 from the first contact surface 322*c*, a curvature of at least a portion of the outer line of the first tray wall 321 may vary in the circumferential direction. For example, at the first height H1 from the first contact surface 322*c*, the curvature of the outer line 323*b*1 of the second portion 323 may be greater than that of the outer line of the first portion 322.

Referring to FIG. 14, at the second height H2 from the first contact surface 322*c*, an amount of change in curvature of the outer line of the first tray wall 321 may be greater than zero. That is, at the second height H2 from the first contact surface 322*c*, the curvature of the outer line of the first tray wall 321 may vary in the circumferential direction. For example, at the second height H2 from the first contact surface 322*c*, the curvature of the outer line 323*b*2 of the second portion 323 may be greater than the curvature of the outer line of the first portion 322. A curvature of at least a portion of the outer line 323*b*2 of the second portion 323 at the second height H2 from the first contact surface 322*c* is greater than that of at least a portion of the outer line 323*b*1 of the second portion 323 at the first height H1 from the first contact surface 322*c*.

Referring to FIG. 11, the curvature of the outer line 322*e* of the first extension part 323*a* in the first portion 322 may be zero in the Y-Z axis cutting surface with respect to the central line C1. In the Y-Z axis cutting surface with respect to the central line C1, the curvature of the outer line 323*d* of the second extension part 323*b* of the second portion 323 may be greater than zero. For example, the outer line 323*d* of the second extension part 323*b* uses the shaft 440 as a center of curvature.

Figure 15:
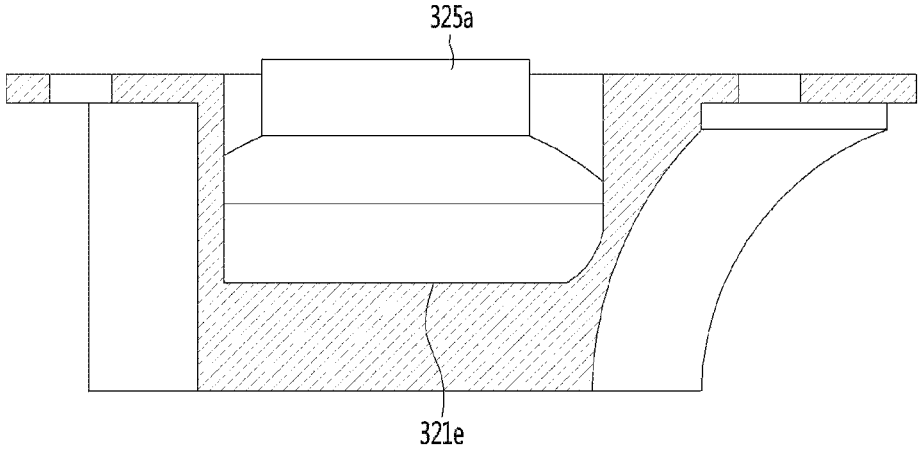
FIG. 15 is a cross-sectional view taken along line 15-15 of FIG. 8.

FIG. 15 is a cross-sectional view taken along line 15-15 of FIG. 8.

Referring to FIGS. 8, 10, and 15, the first tray 320 may further include a sensor accommodation part 321*e* in which the second temperature sensor 700 (or the tray temperature sensor) is accommodated. The second temperature sensor 700 may sense a temperature of water or ice of the ice making cell 320*a*. The second temperature sensor 700 may be disposed adjacent to the first tray 320 to sense the temperature of the first tray 320, thereby indirectly determining the water temperature or the ice temperature of the ice making cell 320*a*. In this embodiment, the water temperature or the ice temperature of the ice making cell 320*a* may be referred to as an internal temperature of the ice making cell 320*a*. The sensor accommodation part 321*e* may be recessed downward from the case accommodation part 321*b*. Here, a bottom surface of the sensor accommodation part 321*e* may be disposed at a position lower than that of the bottom surface of the heater accommodation part 321*c* to prevent the second temperature sensor 700 from interfering with the ice separation heater 290 in a state in which the second temperature sensor 700 is accommodated in the sensor accommodation part 321*e*. Accordingly, the ice separation heater 290 and the second temperature sensor 700 may be located at a position lower than the support surface on which the first tray 320 supports the first tray cover 300. The bottom surface of the sensor accommodating portion 321*e* may be disposed closer to the first contact surface 322*c* of the first tray 320 than the bottom surface of the heater accommodating portion 321*c*. The sensor accommodation part 321*e* may be disposed between two adjacent ice making cells 320*a*. For example, the sensor accommodation part 321*e* may be disposed between two adjacent first cells 321*a*. When the sensor accommodation part 321*e* is disposed between the two ice making cells 320*a*, the second temperature sensor 700 may be easily installed without increasing the volume of the first tray 250. Also, when the sensor accommodation part 321*e* is disposed between the two ice making cells 320*a*, the temperatures of at least two ice making cells 320*a* may be affected. Thus, the temperature sensor may be disposed so that the temperature sensed by the second temperature sensor maximally approaches an actual temperature inside the cell 320*a*.

Referring to FIG. 10, the sensor accommodation part 321*e* may be disposed between the two adjacent first cells 321*a* among the three first cells 321*a* arranged in the X-axis direction. The sensor accommodation part 321*e* may be disposed between the right first cell and the central first cell of both the left and right sides among the three first cells 321*a*. Here, a distance D2 between the right first cell and the central first cell on the first contact surface 322*c* may be greater than that D1 between the central first cell and the left first cell so that a space in which the sensor accommodation part 321*e* is disposed may be secured between the right first cell and the central first cell. The connector 3212 may be provided in plurality to improve the uniformity of the ice making direction between the plurality of ice making cells 320*a*. For example, the connector 3212 may include a first connector 3212*a* and a second connector 3212*b*. The second connector 3212*b* may be disposed far from the through-hole 222*a* of the bracket 220 than the first connector 3212*a*. The first connector 3212*a* may include a first region and a second region having a thicker cross-section than the first region. The ice may be made in the direction from the ice making cell 320*a* defined by the first region to the ice making cell 320*a* defined by the second region. The second connector 3212*b* may include a first region and a second region including a sensor accommodation part 321*e* in which the second temperature sensor 700 is disposed.

Figure 16:
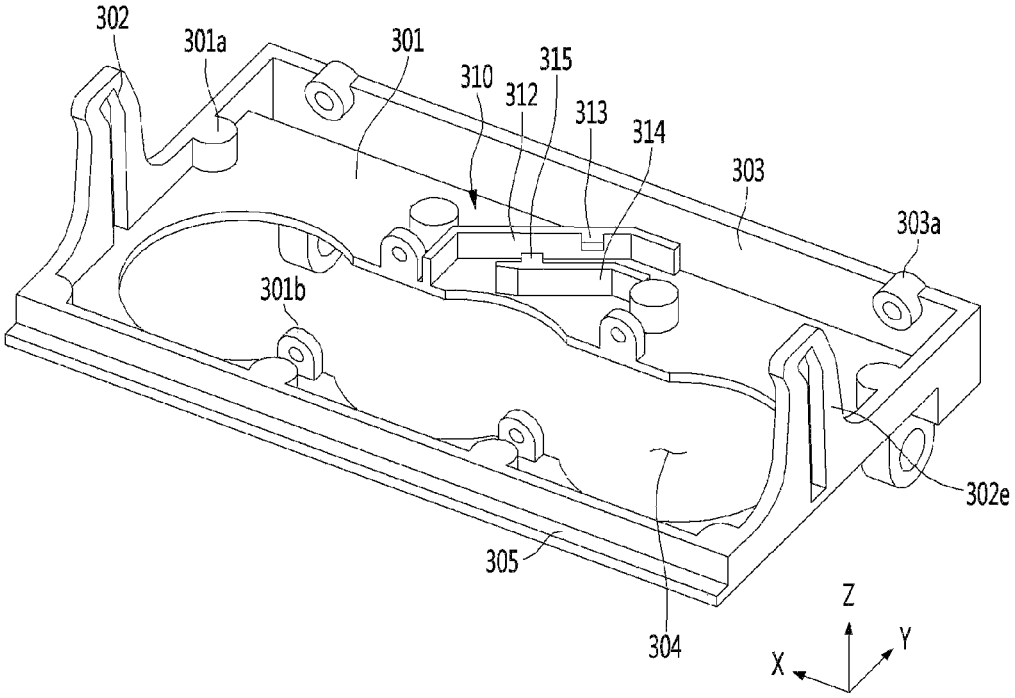
FIG. 16 is a perspective view of the first tray.
Figure 17:
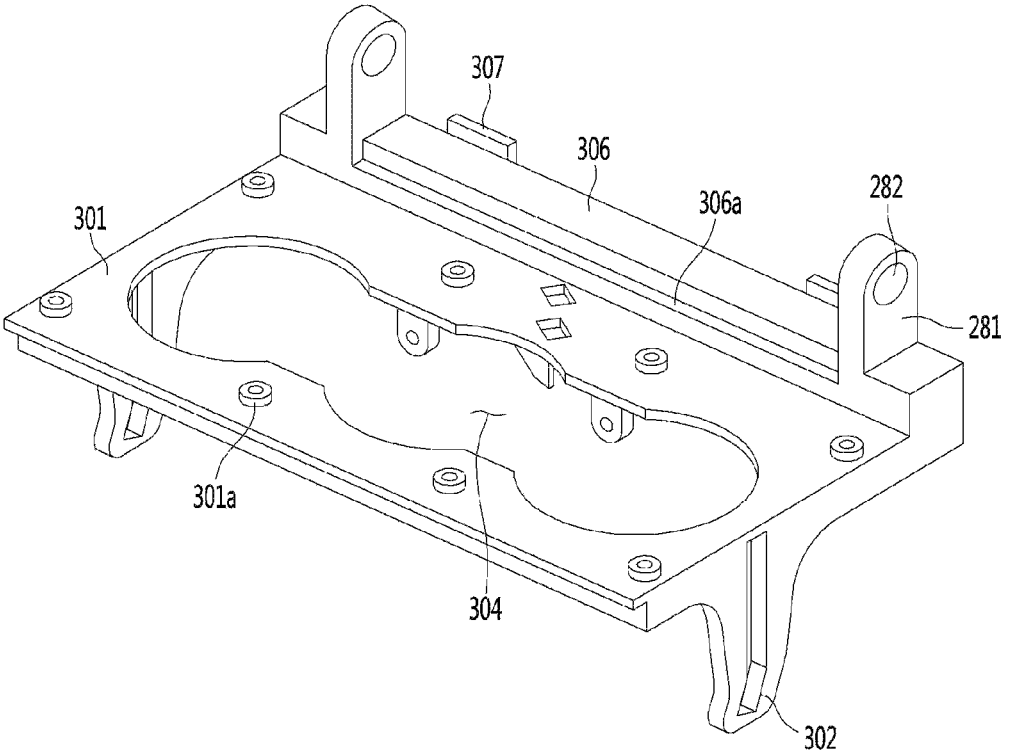
FIG. 17 is a bottom perspective view of a first tray cover.
Figure 18:
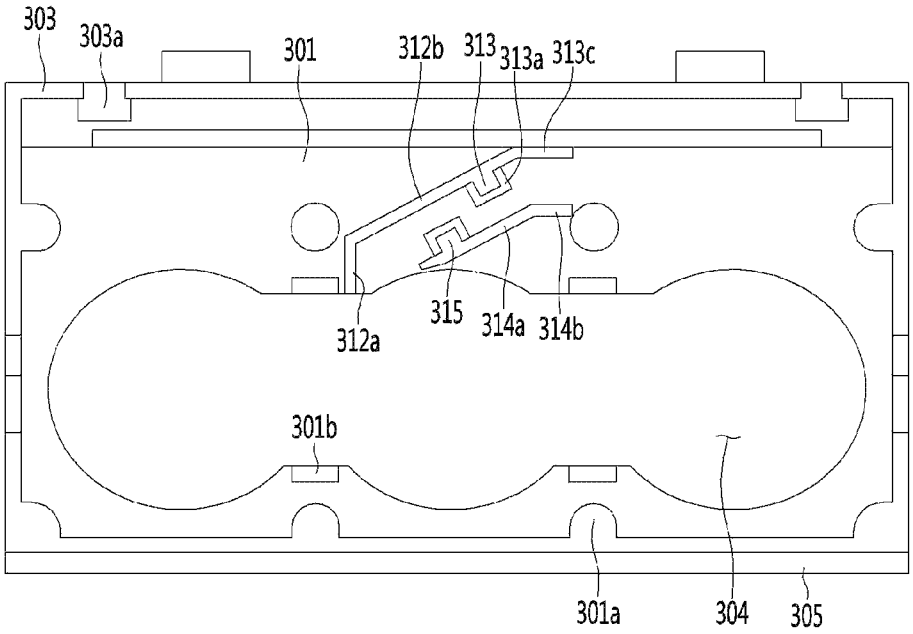
FIG. 18 is a plan view of the first tray cover.
Figure 19:
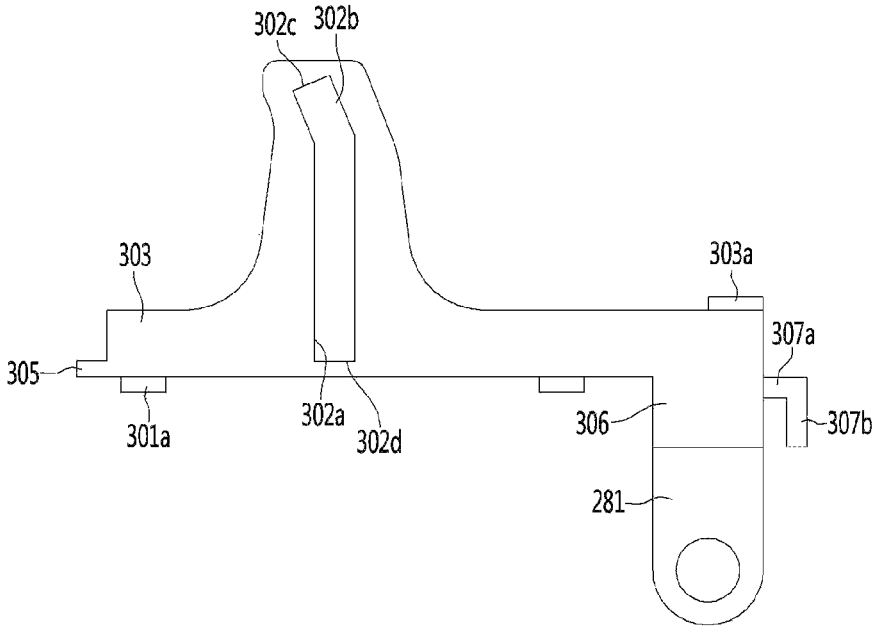
FIG. 19 is a side view of a first tray case.

FIG. 16 is a perspective view of the first tray, FIG. 17 is a bottom perspective view of the first tray cover, FIG. 18 is a plan view of the first tray cover, and FIG. 19 is a side view of the first tray case.

Referring to FIGS. 16 to 19, the first tray cover 300 may include an upper plate 301 contacting the first tray 320.

A bottom surface of the upper plate 301 may be coupled to contact an upper side of the first tray 320. For example, the upper plate 301 may contact at least one of a top surface of the first portion 322 and a top surface of the second portion 323 of the first tray 320. A plate opening 304 (or through-hole) may be defined in the upper plate 301. The plate opening 304 may include a straight portion and a curved portion.

Water may be supplied from the water supply part 240 to the first tray 320 through the plate opening 304. Also, the pushing bar 264 of the first pusher 260 may pass through the plate opening 304 to separate ice from the first tray 320. Also, cold may pass through the plate opening 304 to contact the first tray 320. A first case coupling part 301*b* extending upward may be disposed at a side of the straight portion of the plate opening 304 in the upper plate 301. The first case coupling part 301*b* may be coupled to the first heater case 280.

The first tray cover 300 may further include a circumferential wall 303 extending upward from an edge of the upper plate 301. The circumferential wall 303 may include two pairs of walls facing each other. For example, the pair of walls may be spaced apart from each other in the X-axis direction, and another pair of walls may be spaced apart from each other in the Y-axis direction.

The circumferential walls 303 spaced apart from each other in the Y-axis direction of FIG. 16 may include an extension wall 302*e* extending upward. The extension wall 302*e* may extend upward from a top surface of the circumferential wall 303.

The first tray cover 300 may include a pair of guide slots 302 guiding the movement of the first pusher 260. A portion of the guide slot 302 may be defined in the extension wall 302*e*, and the other portion may be defined in the circumferential wall 303 disposed below the extension wall 302*e*. A lower portion of the guide slot 302 may be defined in the circumferential wall 303.

The guide slot 302 may extend in the Z-axis direction of FIG. 16. The first pusher 260 may be inserted into the guide slot 302 to move. Also, the first pusher 260 may move up and down along the guide slot 302.

The guide slot 302 may include a first slot 302*a* extending perpendicular to the upper plate 301 and a second slot 302*b* that is bent at an angle from an upper end of the first slot 302*a*. Alternatively, the guide slot 302 may include only the first slot 302*a* extending in the vertical direction. The lower end 302*d* of the first slot 302*a* may be disposed lower than the upper end of the circumferential wall 303. Also, the upper end 302*c* of the first slot 302*a* may be disposed higher than the upper end of the circumferential wall 303. The portion bent from the first slot 302*a* to the second slot 302*b* may be disposed at a position higher than the circumferential wall 303. A length of the first slot 302*a* may be greater than that of the second slot 302*b*. The second slot 302*b* may be bent toward the horizontal extension part 305. When the first pusher 260 moves upward along the guide slot 302, the first pusher 260 rotates or is tilted at a predetermined angle in the portion moving along the second slot 302*b*.

When the first pusher 260 rotates, the pushing bar 264 of the first pusher 260 may rotate so that the pushing bar 264 is spaced apart vertically above the opening 324 of the first tray 320.

When the first pusher 260 moves along the second slot 302*b* that is bent and extended, the end of the pushing bar 264 may be spaced apart so as not to contact with water supplied when water is supplied to the pushing bar. Thus, the water may be cooled at the end of 264 to prevent the pushing bar 264 from being inserted into the opening 324 of the first tray 320. The first tray cover 300 may include a plurality of coupling parts 301*a* coupling the first tray 320 to the first tray supporter 340 (see FIG. 20) to be described later. The plurality of coupling parts 301*a* may be disposed on the upper plate 301. The plurality of coupling parts 301*a* may be spaced apart from each other in the X-axis and/or Y-axis directions. The coupling part 301*a* may protrude upward from the top surface of the upper plate 301. For example, a portion of the plurality of coupling parts 301*a* may be connected to the circumferential wall 303.

The coupling part 301*a* may be coupled to a coupling member to fix the first tray 320. The coupling member coupled to the coupling part 301*a* may be, for example, a bolt. The coupling member may pass through the coupling hole 341*a* of the first tray supporter 340 and the first coupling hole 327*a* of the first tray 320 at the bottom surface of the first tray supporter 340 and then be coupled to the coupling part 301*a*.

A horizontal extension part 305 extending horizontally form the circumferential wall 303 may be disposed on one circumferential wall 3030 of the circumferential walls 303 spaced apart from and facing each other in the Y-axis direction of FIG. 16. The horizontal extension part 305 may extend from the circumferential wall 303 in a direction away from the plate opening 304 so as to be supported by the support wall 221*d* of the bracket 220. A plurality of vertical coupling parts 303*a* may be provided on the other one of the circumferential walls 303 spaced apart from and facing each other in the Y-axis direction. The vertical coupling part 303*a* may be coupled to the first wall 221 of the bracket 220. The vertical coupling parts 303*a* may be arranged to be spaced apart from each other in the X-axis direction.

The upper plate 301 may be provided with a lower protrusion 306 protruding downward. The lower protrusion 306 may extend along the length of the upper plate 301 and may be disposed around the circumferential wall 303 of the other of the circumferential walls 303 spaced apart from each other in the Y-axis direction. A step portion 306*a* may be disposed on the lower protrusion 306. The step portion 306*a* may be disposed between a pair of extension parts 281 described later. Thus, when the second tray 380 rotates, the second tray 380 and the first tray cover 300 may not interfere with each other.

The first tray cover 300 may further include a plurality of hooks 307 coupled to the first wall 221 of the bracket 220. For example, the hooks 307 may be provided on the lower protrusion 306. The plurality of hooks 307 may be spaced apart from each other in the X-axis direction. The plurality of hooks 307 may be disposed between the pair of extension parts 281. Each of the hooks 307 may include a first portion 307*a* horizontally extending from the circumferential wall 303 in the opposite direction to the upper plate 301 and a second portion 307*b* bent from an end of the first portion 307*a* to extend vertically downward.

The first tray cover 300 may further include a pair of extension parts 281 to which the shaft 440 is coupled. For example, the pair of extension parts 281 may extend downward from the lower protrusion 306. The pair of extension parts 281 may be spaced apart from each other in the X-axis direction. Each of the extension parts 281 may include a through-hole 282 through which the shaft 440 passes.

The first tray cover 300 may further include an upper wire guide part 310 guiding a wire connected to the ice separation heater 290, which will be described later. The upper wire guide part 310 may, for example, extend upward from the upper plate 301. The upper wire guide part 310 may include a first guide 312 and a second guide 314, which are spaced apart from each other. For example, the first guide 312 and the second guide 314 may extend vertically upward from the upper plate 310.

The first guide 312 may include a first portion 312*a* extending from one side of the plate opening 304 in the Y-axis direction, a second portion 312*b* bent and extending from the first portion 312*a*, and a third portion 312*c* bent from the second portion 312*b* to extend in the X-axis direction. The third portion 312*c* may be connected to one circumferential wall 303. A first protrusion 313 may be disposed on an upper end of the second portion 312*b* to prevent the wire from being separated.

The second guide 314 may include a first extension part 314*a* disposed to face the second portion 312*b* of the first guide 312 and a second extension part 314*b* bent to extend from the first extension part 314*a* and disposed to face the third portion 312*c*. The second portion 312*b* of the first guide 312 and the first extension part 314*a* of the second guide 314 and also the third portion 312*c* of the first guide 312 and the second extension part 314*b* of the second guide 314 may be parallel to each other. A second protrusion 315 may be disposed on an upper end of the first extension part 314*a* to prevent the wire from being separated.

The wire guide slots 313*a* and 315*a* may be defined in the upper plate 310 to correspond to the first and second protrusions 313 and 315, and a portion of the wire may be the wire guide slots 313*a* and 315*a* to prevent the wire from being separated.

Figure 20:
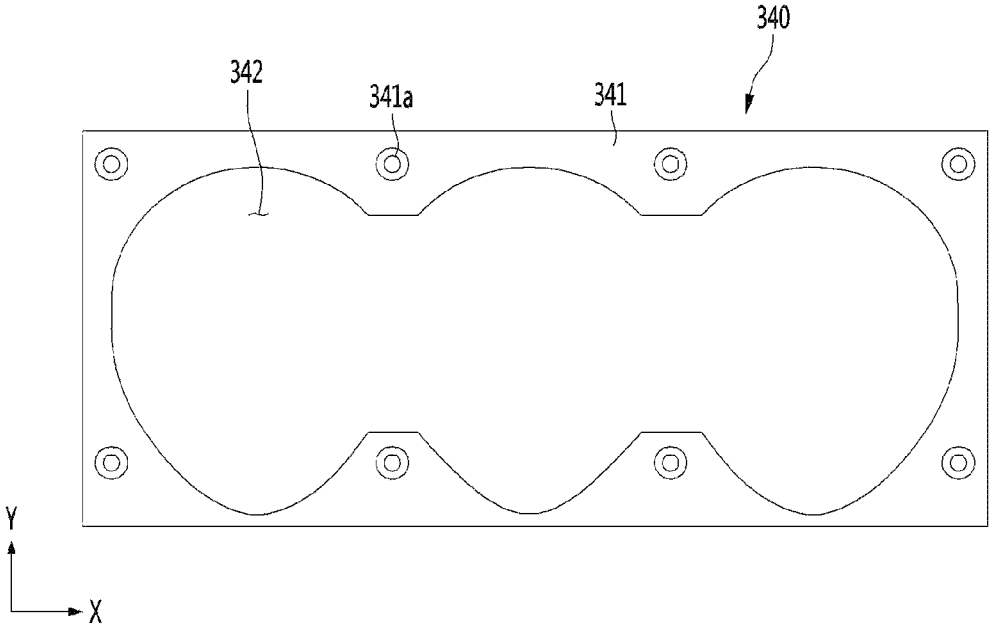
FIG. 20 is a plan view of a first tray supporter.

FIG. 20 is a plan view of a first tray supporter.

Referring to FIG. 20, the first tray supporter 340 may be coupled to the first tray cover 300 to support the first tray 320. The first tray supporter 340 includes a horizontal portion 341 contacting a bottom surface of the upper end of the first tray 320 and an insertion opening 342 through which a lower portion of the first tray 320 is inserted into a center of the horizontal portion 341. The horizontal portion 341 may have a size corresponding to the upper plate 301 of the first tray cover 300. The horizontal portion 341 may include a plurality of coupling holes 341*a* engaged with the coupling parts 301*a* of the first tray cover 300. The plurality of coupling holes 341*a* may be spaced apart from each other in the X-axis and/or Y-axis direction of FIG. 20 to correspond to the coupling part 301*a* of the first tray cover 300.

When the first tray cover 300, the first tray 320, and the first tray supporter 340 are coupled to each other, the upper plate 301 of the first tray cover 300, the first extension wall 327 of the first tray 320, and the horizontal portion 341 of the first tray supporter 340 may sequentially contact each other. The bottom surface of the upper plate 301 of the first tray cover 300 and the top surface of the first extension wall 327 of the first tray 320 may contact each other, and the bottom surface of the first extension wall 327 of the first tray 320 and the top surface of the horizontal part 341 of the first tray supporter 340 may contact each other.

Figure 21:
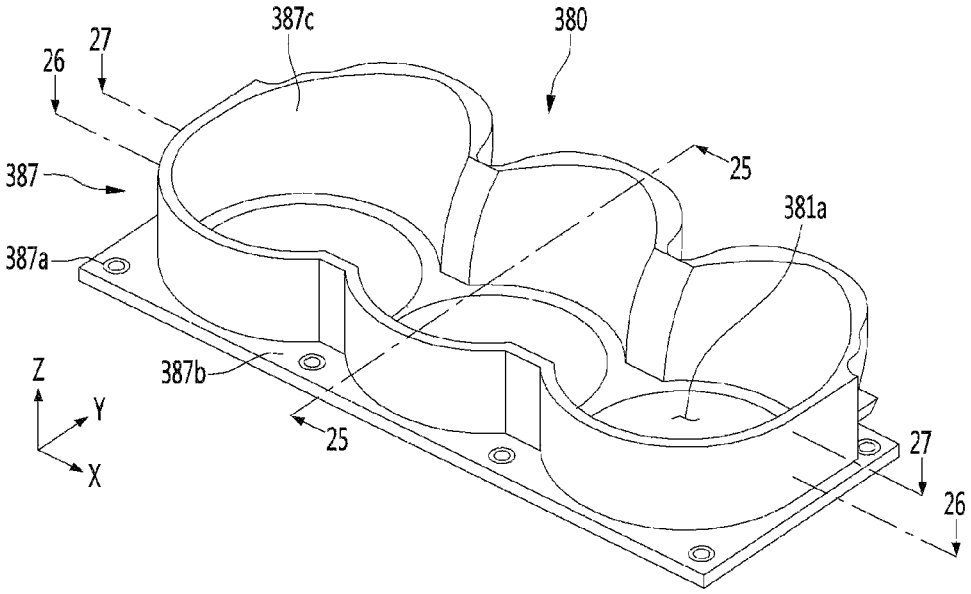
FIG. 21 is a perspective view of a second tray according to an embodiment when viewed from an upper side.
Figure 22:
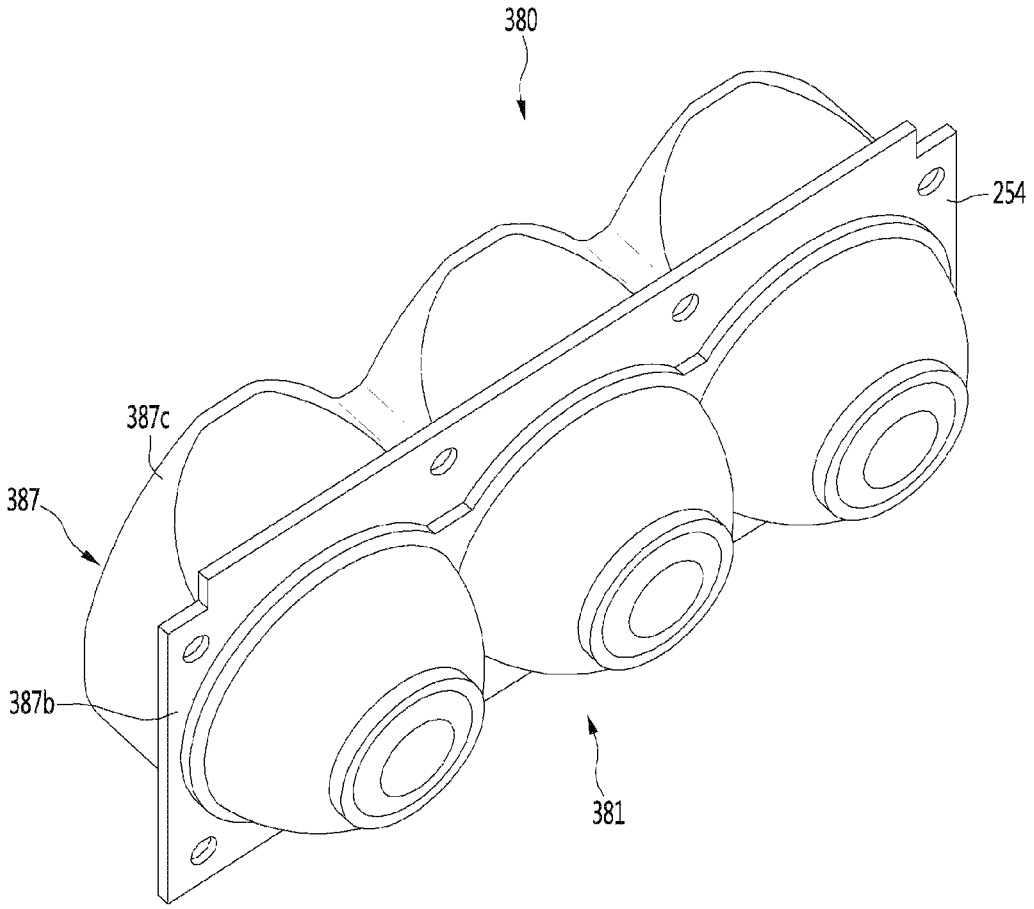
FIG. 22 is a perspective view of the second tray when viewed from a lower side.
Figure 23:
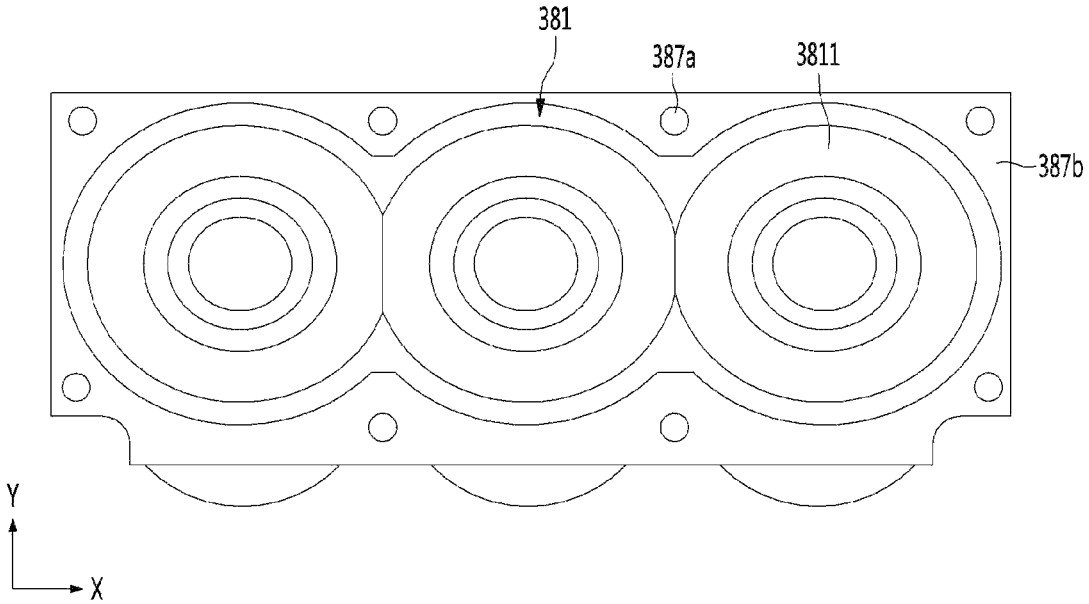
FIG. 23 is a bottom view of the second tray.

FIG. 21 is a perspective view of a second tray according to an embodiment when viewed from an upper side, and FIG. 22 is a perspective view of the second tray when viewed from a lower side. FIG. 23 is a bottom view of the second tray, and FIG. 24 is a plan view of the second tray.

Figure 24:
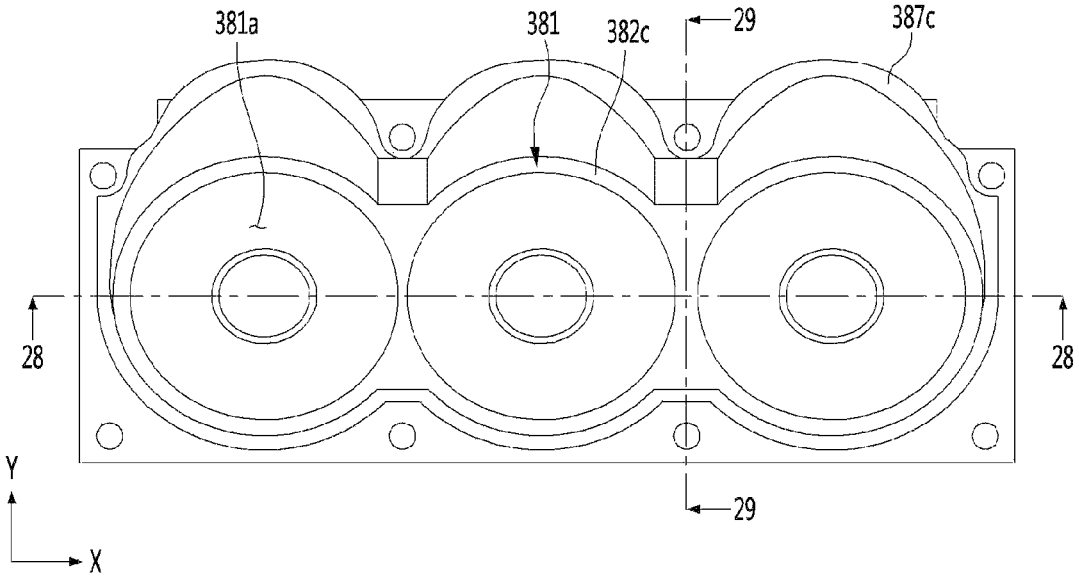
FIG. 24 is a plan view of the second tray.

Referring to FIGS. 21 to 24, the second tray 380 may define a second cell 381*a* which is another portion of the ice making cell 320*a*. The second tray 380 may include a second tray wall 381 defining a portion of the ice making cell 320*a*. For example, the second tray 380 may define a plurality of second cells 381*a*. For example, the plurality of second cells 381*a* may be arranged in a line. Referring to FIG. 24, the plurality of second cells 381*a* may be arranged in the X-axis direction. For example, the second tray wall 381 may define the plurality of second cells 381*a*. The second tray wall 381 may include a plurality of second cell walls 3811 which respectively define the plurality of second cells 381*a*. The two adjacent second cell walls 3811 may be connected to each other.

The second tray 380 may include a circumferential wall 387 extending along a circumference of an upper end of the second tray wall 381. The circumferential wall 387 may be formed integrally with the second tray wall 381 and may extend from an upper end of the second tray wall 381. For another example, the circumferential wall 387 may be provided separately from the second tray wall 381 and disposed around the upper end of the second tray wall 381. In this case, the circumferential wall 387 may contact the second tray wall 381 or be spaced apart from the second tray wall 381. In any case, the circumferential wall 387 may surround at least a portion of the first tray 320. If the second tray 380 includes the circumferential wall 387, the second tray 380 may surround the first tray 320. When the second tray 380 and the circumferential wall 387 are provided separately from each other, the circumferential wall 387 may be integrally formed with the second tray case or may be coupled to the second tray case. For example, one second tray wall may define a plurality of second cells 381*a*, and one continuous circumferential wall 387 may surround the first tray 250.

The circumferential wall 387 may include a first extension wall 387*b* extending in the horizontal direction and a second extension wall 387*c* extending in the vertical direction. The first extension wall 387*b* may be provided with one or more second coupling holes 387*a* to be coupled to the second tray case. The plurality of second coupling holes 387*a* may be arranged in at least one axis of the X axis or the Y axis. The second tray 380 may include a second contact surface 382*c* contacting the first contact surface 322*c* of the first tray 320. The first contact surface 322*c* and the second contact surface 382*c* may be horizontal planes. Each of the first contact surface 322*c* and the second contact surface 382*c* may be provided in a ring shape. When the ice making cell 320*a* has a spherical shape, each of the first contact surface 322*c* and the second contact surface 382*c* may have a circular ring shape.

Figure 25:
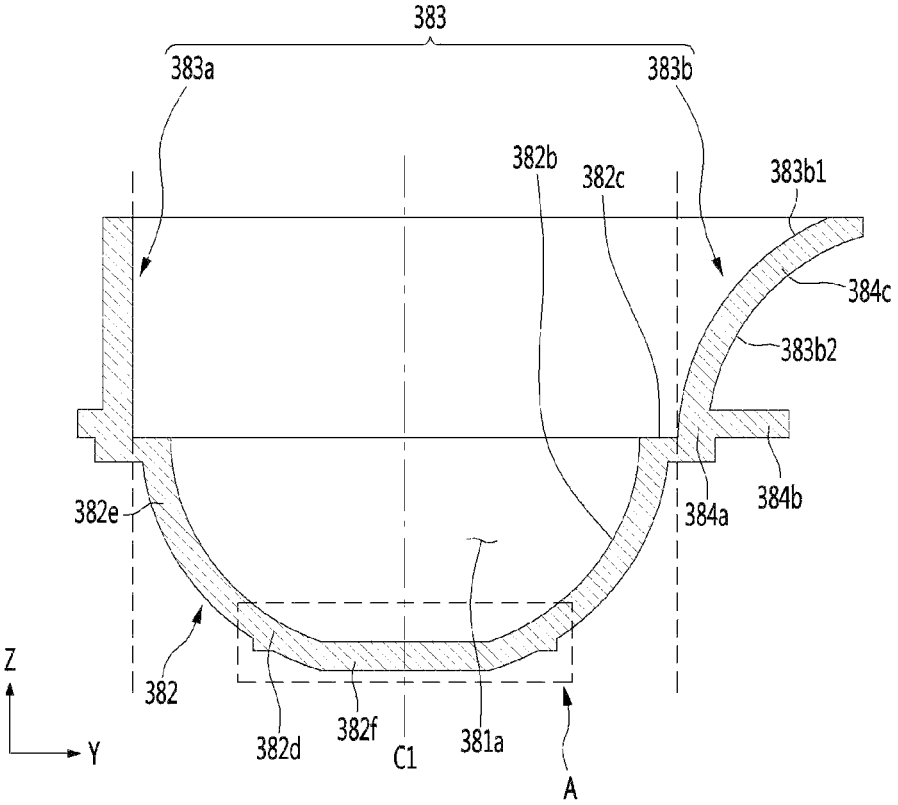
FIG. 25 is a cross-sectional view taken along line 25-25 of FIG. 21.
Figure 26:
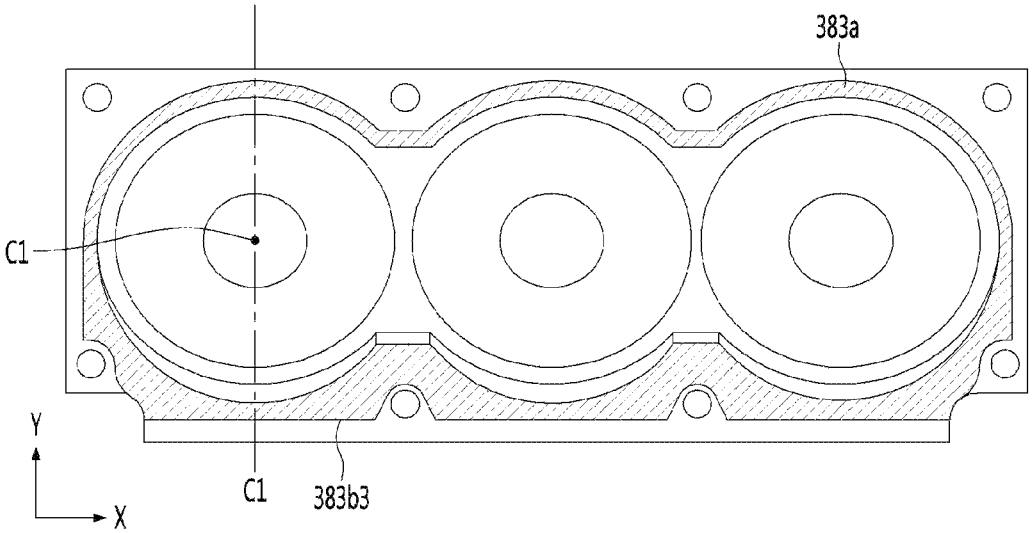
FIG. 26 is a cross-sectional view taken along line 26-26 of FIG. 21.
Figure 27:
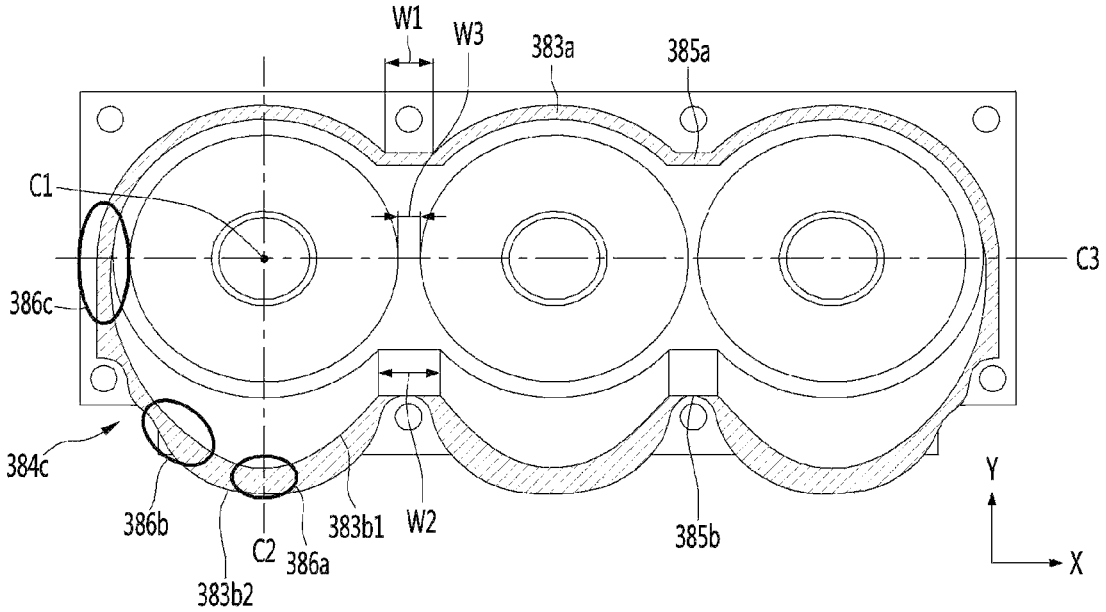
FIG. 27 is a cross-sectional view taken along line 27-27 of FIG. 21.
Figure 28:
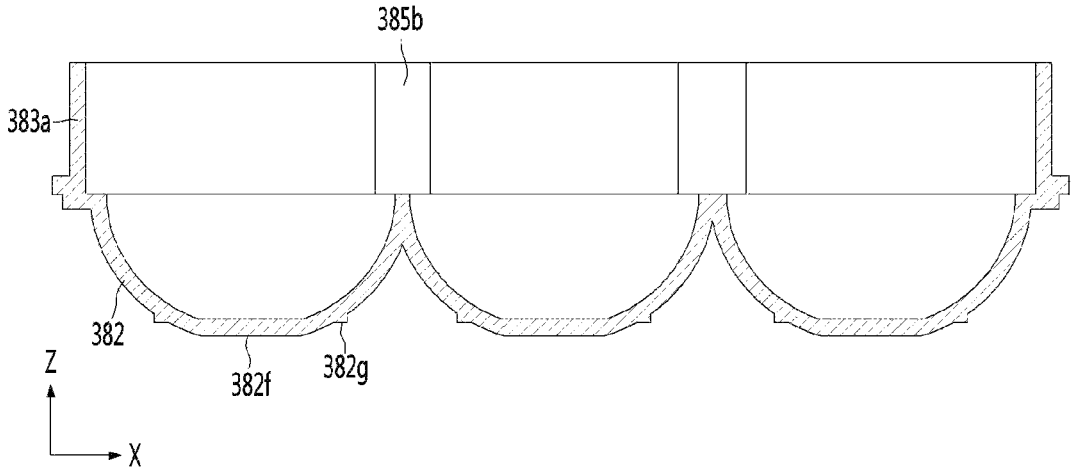
FIG. 28 is a cross-sectional view taken along line 28-28 of FIG. 24.
Figure 29:
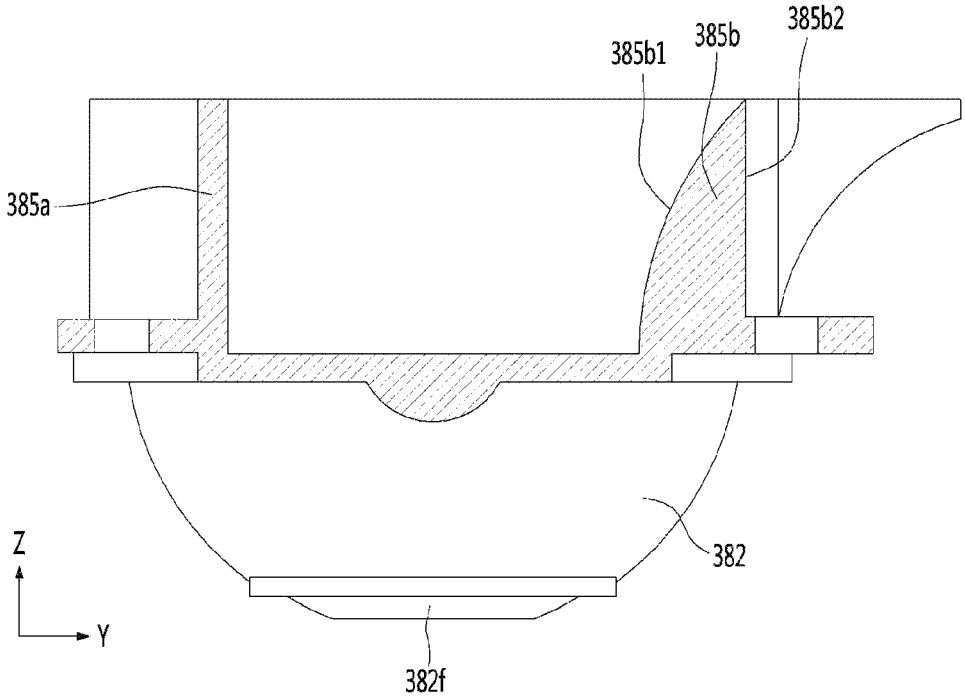
FIG. 29 is a cross-sectional view taken along line 29-29 of FIG. 25.

FIG. 25 is a cross-sectional view taken along line 25-25 of FIG. 21, FIG. 26 is a cross-sectional view taken along line 26-26 of FIG. 21, FIG. 27 is a cross-sectional view taken along line 27-27 of FIG. 21, FIG. 28 is a cross-sectional view taken along line 28-28 of FIG. 2, and FIG. 29 is a cross-sectional view taken along line 29-29 of FIG. 25.

FIG. 25 illustrates a Y-Z cutting surface passing through the central line C1.

Referring to FIGS. 25 to 29, the second tray 380 may include a first portion 382 that defines at least a portion of the ice making cell 320*a*. For example, the first portion 382 may be a portion or the whole of the second tray wall 381.

In this specification, the first portion 322 of the first tray 320 may be referred to as a third portion so as to be distinguished from the first portion 382 of the second tray 380. Also, the second portion 323 of the first tray 320 may be referred to as a fourth portion so as to be distinguished from the second portion 383 of the second tray 380.

The first portion 382 may include a second cell surface 382*b* (or an outer circumferential surface) defining the second cell 381*a* of the ice making cell 320*a*. The first portion 382 may be defined as an area between two dotted lines in FIG. 29. The uppermost end of the first portion 382 is the second contact surface 382*c* contacting the first tray 320.

The second tray 380 may further include a second portion 383. The second portion 383 may reduce transfer of heat, which is transferred from the transparent ice heater 430 to the second tray 380, to the ice making cell 320*a* defined by the first tray 320. That is, the second portion 383 serves to allow the heat conduction path to move in a direction away from the first cell 321*a*. The second portion 383 may be a portion or the whole of the circumferential wall 387. The second portion 383 may extend from a predetermined point of the first portion 382. In the following description, for example, the second portion 383 is connected to the first portion 382. The predetermined point of the first portion 382 may be one end of the first portion 382. Alternatively, the predetermined point of the first portion 382 may be one point of the second contact surface 382*c*. The second portion 383 may include the other end that does not contact one end contacting the predetermined point of the first portion 382. The other end of the second portion 383 may be disposed farther from the first cell 321*a* than one end of the second portion 383.

At least a portion of the second portion 383 may extend in a direction away from the first cell 321*a*. At least a portion of the second portion 383 may extend in a direction away from the second cell 381*a*. At least a portion of the second portion 383 may extend upward from the second contact surface 382*c*. At least a portion of the second portion 383 may extend horizontally in a direction away from the central line C1. A center of curvature of at least a portion of the second portion 383 may coincide with a center of rotation of the shaft 440 which is connected to the driver 480 to rotate.

The second portion 383 may include a first part 384*a* extending from one point of the first portion 382. The second portion 383 may further include a second part 384*b* extending in the same direction as the extending direction with the first part 384*a*. Alternatively, the second portion 383 may further include a third part 384*c* extending in a direction different from the extending direction of the first part 384*a*. Alternatively, the second portion 383 may further include a second part 384*b* and a third part 384*c* branched from the first part 384*a*. For example, the first part 384*a* may extend in the horizontal direction from the first portion 382. A portion of the first part 384*a* may be disposed at a position higher than that of the second contact surface 382*c*. That is, the first part 384*a* may include a horizontally extension part and a vertically extension part. The first part 384*a* may further include a portion extending in the vertical direction from the predetermined point. For example, a length of the third part 384*c* may be greater than that of the second part 384*b*.

The extension direction of at least a portion of the first part 384*a* may be the same as that of the second part 384*b*. The extension directions of the second part 384*b* and the third part 384*c* may be different from each other. The extension direction of the third part 384*c* may be different from that of the first part 384*a*. The third part 384*c* may have a constant curvature based on the Y-Z cutting surface. That is, the same curvature radius of the third part 384*c* may be constant in the longitudinal direction. The curvature of the second part 384*b* may be zero. When the second part 384*b* is not a straight line, the curvature of the second part 384*b* may be less than that of the third part 384*c*. The curvature radius of the second part 384*b* may be greater than that of the third part 384*c*.

At least a portion of the second portion 383 may be disposed at a position higher than or equal to that of the uppermost end of the ice making cell 320*a*. In this case, since the heat conduction path defined by the second portion 383 is long, the heat transfer to the ice making cell 320*a* may be reduced. A length of the second portion 383 may be greater than the radius of the ice making cell 320*a*. The second portion 383 may extend up to a point higher than the center of rotation C4 of the shaft 440. For example, the second portion 383 may extend up to a point higher than the uppermost end of the shaft 440.

The second portion 383 may include a first extension part 383*a* extending from a first point of the first portion 382 and a second extension part 383*b* extending from a second point of the first portion 382 so that transfer of the heat of the transparent ice heater 430 to the ice making cell 320*a* defined by the first tray 320 is reduced. For example, the first extension part 383*a* and the second extension part 383*b* may extend in different directions with respect to the central line C1.

Referring to FIG. 25, the first extension part 383*a* may be disposed at the left side with respect to the central line C1, and the second extension part 383*b* may be disposed at the right side with respect to the central line C1. The first extension part 383*a* and the second extension part 383*b* may have different shapes based on the central line C1. The first extension part 383*a* and the second extension part 383*b* may be provided in an asymmetrical shape with respect to the central line C1. A length (horizontal length) of the second extension part 383*b* in the Y-axis direction may be longer than the length (horizontal length) of the first extension part 383*a*. The first extension part 383*a* may be disposed closer to an edge part that is disposed at a side opposite to the portion of the second wall 222 or the third wall 223 of the bracket 220, which is connected to the fourth wall 224, than the second extension part 383*b*. The second extension part 383*b* may be disposed closer to the shaft 440 that provides a center of rotation of the second tray assembly than the first extension part 383*a*.

In this embodiment, a length of the second extension part 383*b* in the Y-axis direction may be greater than that of the first extension part 383*a*. In this case, the heat conduction path may increase while reducing the width of the bracket 220 relative to the space in which the ice maker 200 is installed. Since the length of the second extension part 383*b* in the Y-axis direction is greater than that of the first extension part 383*a*, the second tray assembly including the second tray 380 contacting the first tray 320 may increase in radius of rotation. When the rotation radius of the second tray assembly increases centrifugal force of the second tray assembly may increase. Thus, in the ice separation process, separating force for separating the ice from the second tray assembly may increase to improve ice separation performance. The center of curvature of at least a portion of the second extension part 383*b* may be a center of curvature of the shaft 440 which is connected to the driver 480 to rotate.

A distance between an upper portion of the first extension part 383*a* and an upper portion of the second extension part 383*b* may be greater than that between a lower portion of the first extension part 383*a* and a lower portion of the second extension part 383*b* with respect to the Y-Z cutting surface passing through the central line C1. For example, a distance between the first extension part 383*a* and the second extension part 383*b* may increase upward.

Each of the first extension part 383*a* and the third extension part 383*b* may include first to third parts 384*a*, 384*b*, and 384*c*.

In another aspect, the third part 384*c* may also be described as including the first extension part 383*a* and the second extension part 383*b* extending in different directions with respect to the central line C1.

At least a portion of the X-Y cutting surface of the second extension part 383*b* has a curvature greater than zero, and also, the curvature may vary. A first horizontal area 386*a* including a point at which a first extension part C2 passing through the central line C1 in the Y-axis direction and the second extension part 383*b* meet each other may have a curvature different from that of a second horizontal area 386*b* of the second extension part 383*b*, which is spaced apart from the first horizontal area 386*a*. For example, the curvature of the first horizontal area 386*a* may be greater than that of the second horizontal area 386*b*. In the second horizontal area 386*b*, the curvature of the first horizontal area 386*a* may be maximized.

A third horizontal area 386*c* including a point at which a second extension part C3 passing through the central line C1 in the X-axis direction and the second extension part 383*b* meet each other may have a curvature different from that of the second horizontal area 386*b* of the second extension part 383*b*, which is spaced apart from the third horizontal area 386*c*. The curvature of the second horizontal area 386*b* may be greater than that of the third horizontal area 386*c*. In the second extension part 383*b*, the curvature of the third horizontal area 386*c* may be minimized.

The second extension part 383*b* may include an inner line 383*b*1 and an outer line 383*b*2. A curvature of the inner line 383*b*1 may be greater than zero with respect to the X-Y cutting surface. A curvature of the outer line 383*b*2 may be equal to or greater than zero.

The second extension part 383*b* may be divided into an upper portion and a lower portion in a height direction. An amount of change in curvature of the inner line 383*b*1 of the upper portion of the second extension part 383*b* may be greater than zero with respect to the X-Y cutting surface. An amount of change in curvature of the inner line 383*b*1 of the lower portion of the second extension part 383*b* may be greater than zero. The maximum curvature change amount of the inner line 383*b*1 of the upper portion of the second extension part 383*b* may be greater than that of the inner line 383*b*1 of the lower portion of the second extension part 383*b*. An amount of change in curvature of the outer line 383*b*2 of the upper portion of the second extension part 383*b* may be greater than zero with respect to the X-Y cutting surface. An amount of change in curvature of the outer line 383*b*2 of the lower portion of the second extension part 383*b* may be greater than zero. The minimum curvature change amount of the outer line 383*b*2 of the upper portion of the second extension part 383*b* may be greater than that of the outer line 383*b*2 of the lower portion of the second extension part 383*b*. The outer line of the lower portion of the second extension part 383*b* may include a straight portion 383*b*3. The third part 384*c* may include a plurality of first extension parts 383*a* and a plurality of second extension parts 383*b*, which correspond to the plurality of ice making cells 320*a*.

The third part 384*c* may include a first connection part 385*a* connecting two adjacent first extension parts 383*a* to each other. The third part 384*c* may include a second connection part 385*b* connecting two adjacent second extension parts 383*b* to each other. In this embodiment, when the ice maker includes three ice making cells 320*a*, the third part 384*c* may include two first connection parts 385*a*.

As described above, widths (which are lengths in the X-axis direction) W1 of the two first connection parts 385*a* may be different from each other according to the formation of the sensor accommodation part 321*e*. For example, the second connection part 385*b* may include an inner line 385*b*1 and an outer line 385*b*2. In this embodiment, when the ice maker includes three ice making cells 320*a*, the third part 384*c* may include two second connection parts 385*b*.

As described above, widths (which are lengths in the X-axis direction) W2 of the two second connection parts 385*b* may be different from each other according to the formation of the sensor accommodation part 321*e*. Here, the width of the second connection part 385*b* disposed close to the second temperature sensor 700 among the two second connection parts 385*b* may be larger than that of the remaining second connection part 385*b*. The width W1 of the first connection part 385*a* may be larger than the width W3 of the connection part of two adjacent ice making cells 320*a*. The width W2 of the second connection part 385*b* may be larger than the width W3 of the connection part of two adjacent ice making cells 320*a*.

The first portion 382 may have a variable radius in the Y-axis direction. The first portion 382 may include a first region 382*d* (see region A in FIG. 25) and a second region 382*e*. The curvature of at least a portion of the first region 382*d* may be different from that of at least a portion of the second region 382*e*. The first region 382*d* may include the lowermost end of the ice making cell 320*a*. The second region 382*e* may have a diameter greater than that of the first region 382*d*. The first region 382*d* and the second region 382*e* may be divided vertically.

The transparent ice heater 430 may contact the first region 382*d*. The first region 382*d* may include a heater contact surface 382*g* contacting the transparent ice heater 430. The heater contact surface 382*g* may be, for example, a horizontal plane. The heater contact surface 382*g* may be disposed at a position higher than that of the lowermost end of the first portion 382.

The second region 382*e* may include the second contact surface 382*c*. The first region 382*d* may have a shape recessed in a direction opposite to a direction in which ice is expanded in the ice making cell 320*a*. A distance from the center of the ice making cell 320*a* to the second region 382*e* may be less than that from the center of the ice making cell 320*a* to the portion at which the shape recessed in the first region 382*d* is disposed. For example, the first region 382*d* may include a pressing part 382*f* that is pressed by the second pusher 540 during the ice separation process. When pressing force of the second pusher 540 is applied to the pressing part 382*f*, the pressing part 382*f* is deformed, and thus, ice is separated from the first portion 382. When the pressing force applied to the pressing part 382*f* is removed, the pressing part 382*f* may return to its original shape. The central line C1 may pass through the first region 382*d*. For example, the central line C1 may pass through the pressing part 382*f*. The heater contact surface 382*g* may be disposed to surround the pressing part 382*f*. The heater contact surface 382*g* may be disposed at a position higher than that of the lowermost end of the pressing part 382*f*. At least a portion of the heater contact surface 382*g* may be disposed to surround the central line C1. Accordingly, at least a portion of the transparent ice heater 430 contacting the heater contact surface 382*g* may be disposed to surround the central line C1. Therefore, the transparent ice heater 430 may be prevented from interfering with the second pusher 540 while the second pusher 540 presses the pressing part 382*f*. A distance from the center of the ice making cell 320*a* to the pressing part 382*f* may be different from that from the center of the ice making cell 320*a* to the second region 382*e*.

Figure 30:
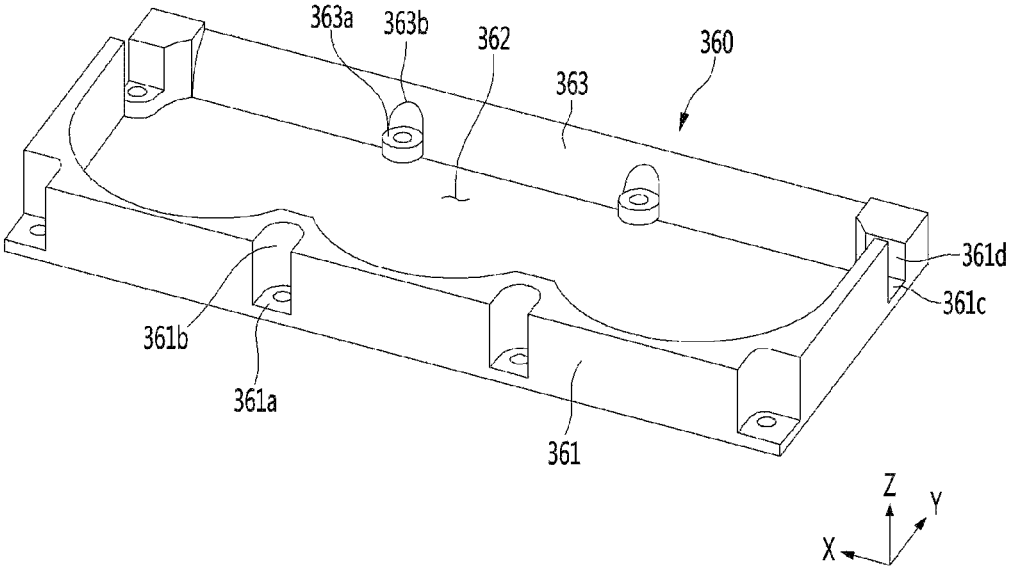
FIG. 30 is a perspective view of a second tray cover.
Figure 35A:
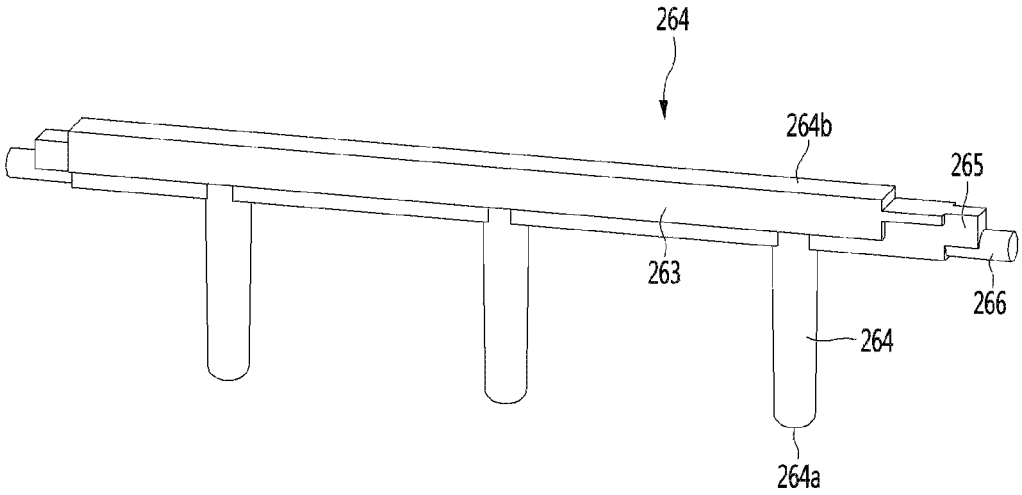
FIGS. 35A and 35B are views of a first pusher according to an embodiment.
Figure 35B:
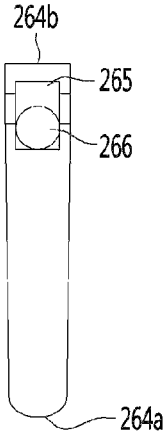

FIG. 30 is a perspective view of the second tray cover, and FIG. 35 is a plan view of the second tray cover.

Figure 31:
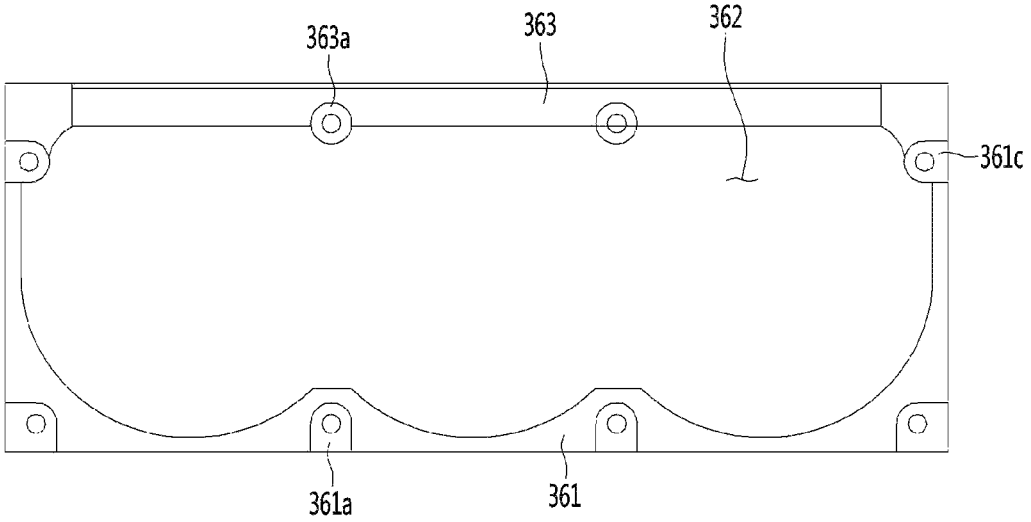
FIG. 31 is a plan view of the second tray cover.

Referring to FIGS. 30 and 31, the second tray cover 360 includes an opening 362 (or through-hole) into which a portion of the second tray 380 is inserted. For example, when the second tray 380 is inserted below the second tray cover 360, a portion of the second tray 380 may protrude upward from the second tray cover 360 through the opening 362.

The second tray cover 360 may include a vertical wall 361 and a curved wall 363 surrounding the opening 362. The vertical wall 361 may define three surfaces of the second tray cover 360, and the curved wall 363 may define the other surface of the second tray cover 360. The vertical wall 361 may be a wall extending vertically upward, and the curved wall 363 may be a wall rounded away from the opening 362 upward. The vertical walls 361 and the curved walls 363 may be provided with a plurality of coupling parts 361*a*, 361*c*, and 363*a* to be coupled to the second tray 380 and the second tray supporter 400. The vertical wall 361 and the curved wall 363 may further include a plurality of coupling grooves 361*b*, 361*d*, and 363*b* corresponding to the plurality of coupling parts 361*a*, 361*c*, and 363*a*. A coupling member may be inserted into the plurality of coupling parts 361*a*, 361*c*, and 363*a* to pass through the second tray 380 and then be coupled to the coupling parts 401*a*, 401*b*, and 401*c* of the second tray supporter 400. Here, the coupling part may protrude upward from the vertical wall 361 and the curved wall 363 through the plurality of coupling grooves 361*b*, 361*d*, and 363*b* to prevent an interference with other components.

A plurality of first coupling parts 361*a* may be provided on the wall facing the curved wall 363 of the vertical wall 361. The plurality of first coupling parts 361*a* may be spaced apart from each other in the X-axis direction of FIG. 30. A first coupling groove 361*b* corresponding to each of the first coupling parts 361*a* may be provided. For example, the first coupling groove 361*b* may be defined by recessing the vertical wall 361, and the first coupling part 361*a* may be provided in the recessed portion of the first coupling groove 361*b*.

The vertical wall 361 may further include a plurality of second coupling parts 361*c*. The plurality of second coupling parts 361*c* may be provided on the vertical walls 361 that are spaced apart from each other in the X-axis direction. The plurality of second coupling parts 361*c* may be disposed closer to the first coupling parts 361*a* than the third coupling parts 363*a*, which will be described later. This is done for preventing the interference with the extension 403 of the second tray supporter 400 when being coupled to a second tray supporter 400 that will be described later. For example, the vertical wall 361 in which the plurality of second coupling parts 361*c* are disposed may further include a second coupling groove 361*d* defined by spacing portions except for the second coupling parts 361*c* apart from each other. The curved wall 363 may be provided with a plurality of third coupling parts 363*a* to be coupled to the second tray 380 and the second tray supporter 400. For example, the plurality of third coupling parts 363*a* may be spaced apart from each other in the X-axis direction of FIG. 34. The curved wall 363 may be provided with a third coupling groove 363*b* corresponding to each of the third coupling parts 363*a*. For example, the third coupling groove 363*b* may be defined by vertically recessing the curved wall 363, and the third coupling part 363*a* may be provided in the recessed portion of the third coupling groove 363*b*.

The second tray cover 360 may support at least a portion of the second portion 383 of the second tray 380. For example, the second tray cover 360 may support the first extension part 383*a* and the second extension part 383*b* of the second portion 383.

Figure 32:
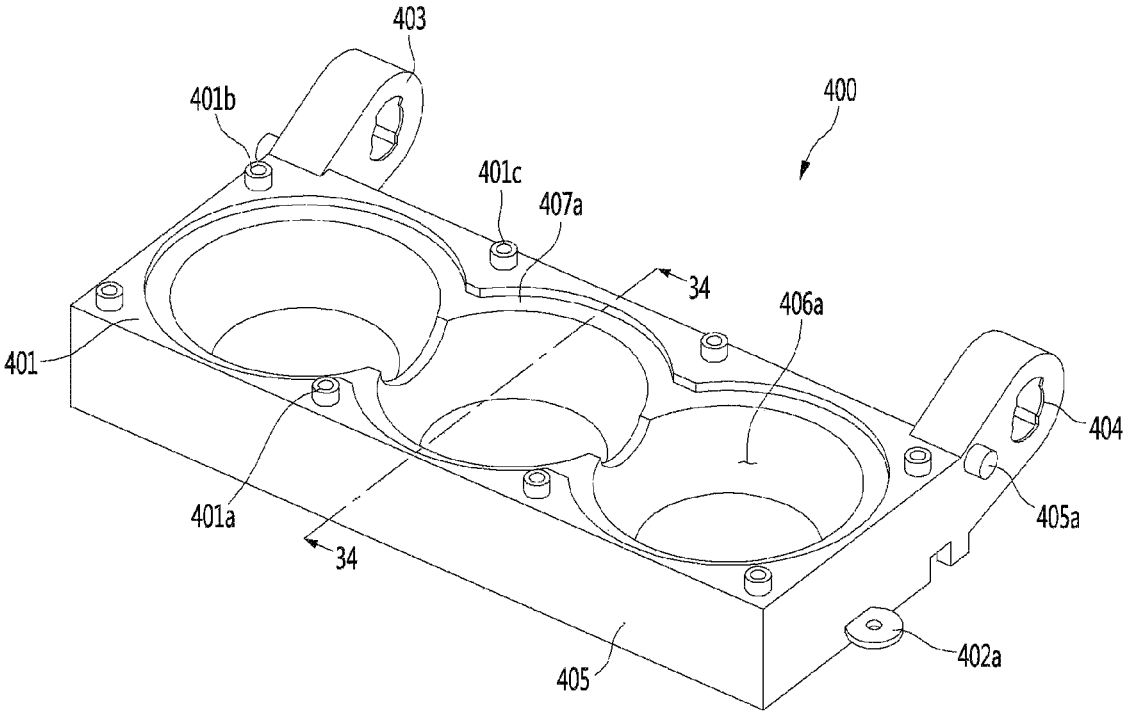
FIG. 32 is a top perspective view of a second tray supporter.
Figure 33:
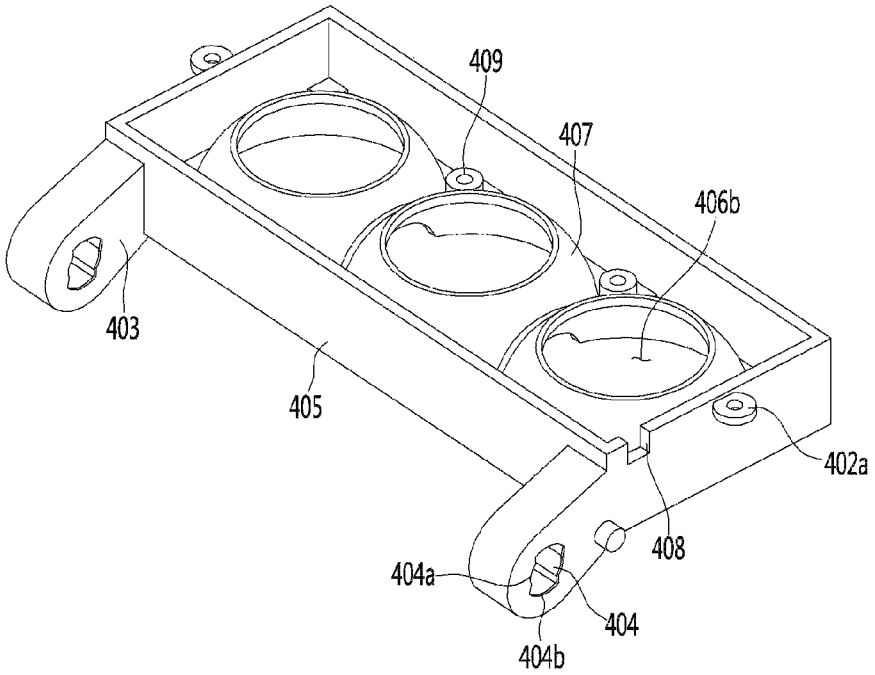
FIG. 33 is a bottom perspective view of the second tray supporter.
Figure 34:
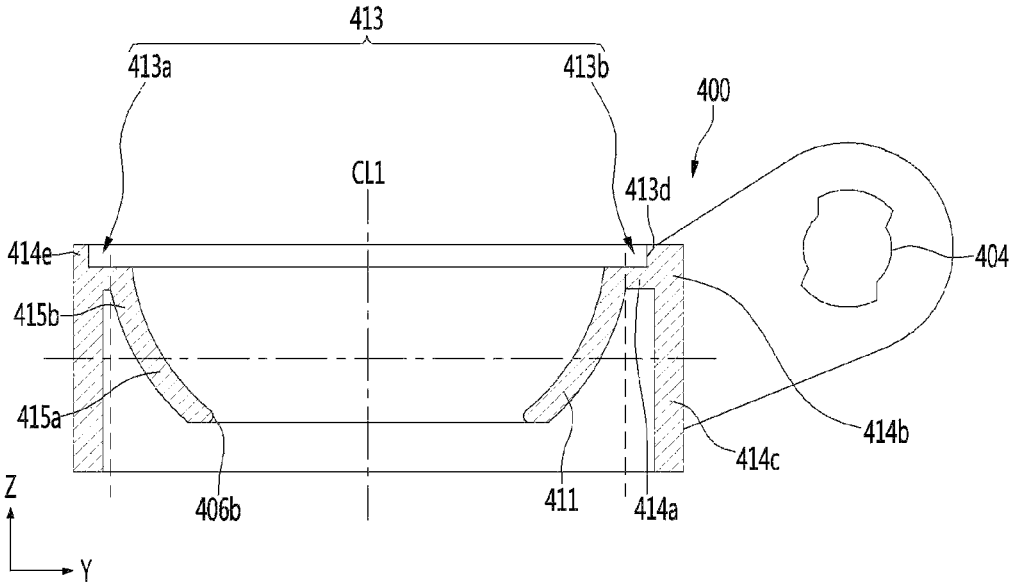
FIG. 34 is a cross-sectional view taken along line 34-34 of FIG. 32.

FIG. 32 is a top perspective view of a second tray supporter, and FIG. 33 is a bottom perspective view of the second tray supporter. FIG. 34 is a cross-sectional view taken along line 34-34 of FIG. 32.

Referring to FIGS. 32 to 34, the second tray supporter 400 may include a support body 407 on which a lower portion of the second tray 380 is seated. The support body 407 may include an accommodation space 406*a* in which a portion of the second tray 380 is accommodated. The accommodation space 406*a* may be defined corresponding to the first portion 382 of the second tray 380, and a plurality of accommodation spaces 406*a* may be provided.

The support body 407 may include a lower opening 406*b* (or a through-hole) through which a portion of the second pusher 540 passes. For example, three lower openings 406*b* may be provided in the support body 407 to correspond to the three accommodation spaces 406*a*. A portion of the lower portion of the second tray 380 may be exposed by the lower opening 406*b*. At least a portion of the second tray 380 may be disposed in the lower opening 406*b*. A portion of the second tray 380 may contact the support body 404 by the lower opening 406*b*. In the first portion 382 of the second tray 380 defining the ice making cell, a surface area of the area contacting the support body 407 may be greater than that of the non-contact area.

A top surface 407*a* of the support body 407 may extend in the horizontal direction. The second tray supporter 400 may include a lower plate 401 that is stepped with the top surface 407*a* of the support body 407. The lower plate 401 may be disposed at a position higher than that of the top surface 407*a* of the support body 407.

The lower plate 401 may include a plurality of coupling parts 401*a*, 401*b*, and 401*c* to be coupled to the second tray cover 360. The second tray 380 may be inserted and coupled between the second tray cover 360 and the second tray supporter 400. For example, the second tray 380 may be disposed below the second tray cover 360, and the second tray 380 may be accommodated above the second tray supporter 400. The first extension wall 387*b* of the second tray 380 may be coupled to the coupling parts 361*a*, 361*b*, and 361*c* of the second tray cover 360 and the coupling parts 401*a*, 401*b*, and 401*c* of the second tray supporter 400. The plurality of first coupling parts 401*a* may be spaced apart from each other in the X-axis direction of FIG. 32. Also, the first coupling part 401*a* and the second and third coupling parts 401*b* and 401*c* may be spaced apart from each other in the Y-axis direction. The third coupling part 401*c* may be disposed farther from the first coupling part 401*a* than the second coupling part 401*b*.

The second tray supporter 400 may further include a vertical extension wall 405 extending vertically downward from an edge of the lower plate 401. One surface of the vertical extension wall 405 may be provided with a pair of extension parts 403 coupled to the shaft 440 to allow the second tray 380 to rotate.

The pair of extension parts 403 may be spaced apart from each other in the X-axis direction of FIG. 32. Also, each of the extension parts 403 may further include a through-hole 404. The shaft 440 may pass through the through-hole 404, and the extension part 281 of the first tray cover 300 may be disposed inside the pair of extension parts 403. The through-hole 404 may further include a central portion 404*a* and an extension hole 404*b* extending symmetrically to the central portion 404*a*.

The second tray supporter 400 may further include a spring coupling part 402*a* to which a spring 402 is coupled. The spring coupling part 402*a* may provide a ring to be hooked with a lower end of the spring 402. One of the walls spaced apart from and facing each other in the X-axis direction of the vertical extension wall 405 is provided with a guide hole 408 guiding the transparent ice heater 430 to be described later or the wire connected to the transparent ice heater 430.

The second tray supporter 400 may further include a link connection part 405*a* to which the pusher link 500 is coupled. For example, the link connection part 405*a* may protrude from the vertical extension wall 405 in the X-axis direction. The link connection part 405*a* may be disposed on an area between the center line CL1 and the through-hole 404 with respect to FIG. 34. The bottom surface of the lower plate 401 may be further provided with a plurality of second heater coupling parts 409 coupled to the second heater case 420. The plurality of second heater coupling parts 409 may be arranged to be spaced apart from each other in the X-axis direction and/or the Y-axis direction.

Referring to FIG. 34, the second tray supporter 400 may include a first portion 411 supporting the second tray 380 defining at least a portion of the ice making cell 320*a*. In FIG. 34, the first portion 411 may be an area between two dotted lines. For example, the support body 407 may define the first portion 411. The second tray supporter 400 may further include a second portion 413 extending from a predetermined point of the first portion 411.

The second portion 413 may reduce transfer of heat, which is transfer from the transparent ice heater 430 to the second tray supporter 400, to the ice making cell 320*a* defined by the first tray assembly. At least a portion of the second portion 413 may extend in a direction away from the first cell 321*a* defined by the first tray 320. The direction away from the first cell 321*a* may be a horizontal direction passing through the center of the ice making cell 320*a*. The direction away from the first cell 321*a* may be a downward direction with respect to a horizontal line passing through the center of the ice making cell 320*a*.

The second portion 413 may include a first part 414*a* extending in the horizontal direction from the predetermined point and a second part 414*b* extending in the same direction as the first part 414*a*. The second portion 413 may include a first part 414*a* extending in the horizontal direction from the predetermined point, and a third part 414*c* extending in a direction different from that of the first part 414*a*. The second portion 413 may include a first part 414*a* extending in the horizontal direction from the predetermined point, and a second part 414*b* and a third part 414*c*, which are branched from the first part 414*a*.

A top surface 407*a* of the support body 407 may provide, for example, the first part 414*a*. The first part 414*a* may further include a fourth part 414*d* extending in the vertical line direction. The lower plate 401 may provide, for example, the fourth part 414*d*. The vertical extension wall 405 may provide, for example, the third part 414*c*. A length of the third part 414*c* may be greater than that of the second part 414*b*. The second part 414*b* may extend in the same direction as the first part 414*a*. The third part 414*c* may extend in a direction different from that of the first part 414*a*. The second portion 413 may be disposed at the same height as the lowermost end of the first cell 321*a* or extend up to a lower point. The length of the second portion 413 may be greater than the radius of the ice making cell 320*a*. In this case, the length of the second portion 413 may be lengthened, thereby increasing a heat transfer path.

The second portion 413 may include a first extension part 413*a* and a second extension part 413*b*. The first extension part 413*a* may extend from a first point of the first portion 411, and the second extension part 413*b* may extend from a second point of the first portion 411. The first extension part 413 and the second extension part 413*b* may be disposed opposite to each other with respect to the center line C1 of the ice making cell 320*a* or the center line CL1 corresponding to the center line C1. Referring to FIG. 34, the first extension part 413*a* may be disposed at a left side with respect to the center line CL1, and the second extension part 413*b* may be disposed at a right side with respect to the center line CL1.

The first extension part 413*a* and the second extension part 413*b* may have different shapes with respect to the center line CL1. The first extension part 413*a* and the second extension part 413*b* may have shapes that are asymmetrical to each other with respect to the center line CL1. A length of the second extension part 413*b* may be greater than that of the first extension part 413*a* in the horizontal direction. That is, a length of the thermal conductivity of the second extension 413*b* is greater than that of the first extension part 413*a*. When the length of the second extension part 413*b* in the horizontal direction increases, the rotation radius of the second tray assembly increases. When the rotation radius of the second tray assembly increases, centrifugal force of the second tray assembly may increase and thus ice separation force for separating ice from the second tray assembly in the ice separation process may increase, thereby improving ice separation performance.

The first extension part 413*a* may be disposed closer to an edge part that is disposed at a side opposite to the portion of the second wall 222 or the third wall 223 of the bracket 220, which is connected to the fourth wall 224, than the second extension part 413*b*. The second extension part 413*b* may be disposed closer to the shaft 440 that provides a center of rotation of the second tray assembly than the first extension part 413*a*. When the length of the second extension part 413*b* in the Y-axis direction is less than that of the first extension part 413*a*, it is possible to prevent the first extension part 413*a* from interfering with the bracket 220 in the rotation process. A center of curvature of at least a portion of the second extension part 413*b* may coincide with a center of rotation of the shaft 440 which is connected to the driver 480 to rotate. Accordingly, it is possible to prevent the second extension part 413*a* from interfering with the neighboring configuration in the rotation process of the second tray assembly. The first extension part 413*a* may include a portion 414*e* extending upwardly with respect to the horizontal line. The portion 414*e* may surround, for example, a portion of the second tray 380. Accordingly, coupling force of the first tray assembly and the second tray assembly may increase, thereby increasing water leakage prevention effect.

In another aspect, the second tray supporter 400 may include a first region 415*a* including the lower opening 406*b* and a second region 415*b* having a shape corresponding to the ice making cell 320*a* to support the second tray 380. For example, the first region 415*a* and the second region 415*b* may be divided vertically. In FIG. 34, for example, the first region 415*a* and the second region 415*b* are divided by a dashed-dotted line extending in the horizontal direction. The first region 415*a* may support the second tray 380.

The controller controls the ice maker to allow the second pusher 540 to move from a first point outside the ice making cell 320*a* to a second point inside the second tray supporter 400 via the lower opening 406*b*.

A degree of deformation resistance of the second tray supporter 400 may be greater than that of the second tray 380. A degree of restoration of the second tray supporter 400 may be less than that of the second tray 380.

In another aspect, the second tray supporter 400 includes a first region 415*a* including a lower opening 406*b* and a second region 415*b* disposed farther from the transparent ice heater 430 than the first region 415*a*.

In the second tray supporter 400, the first portion 411 may include the first region 415*a* and the second region 415*b*.

From the viewpoint of the second tray case, the first portion 411 of the second tray supporter 400 may correspond to the first portion of the second tray case, and the second portion 413 of the second tray supporter 400 may correspond to the second portion of the second tray case. In addition, the second tray cover 360 may correspond to the third portion of the second tray case.

The transparent ice heater 430 will be described in detail.

The controller 800 according to this embodiment may control the transparent ice heater 430 so that heat is supplied to the ice making cell 320*a* in at least partial section while cold air is supplied to the ice making cell 320*a* to make the transparent ice.

An ice making rate may be delayed so that bubbles dissolved in water within the ice making cell 320*a* may move from a portion at which ice is made toward liquid water by the heat of the transparent ice heater 430, thereby making transparent ice in the ice maker 200. That is, the bubbles dissolved in water may be induced to escape to the outside of the ice making cell 320*a* or to be collected into a predetermined position in the ice making cell 320*a*.

When a cold air supply part 900 to be described later supplies cold air to the ice making cell 320*a*, if the ice making rate is high, the bubbles dissolved in the water inside the ice making cell 320*a* may be frozen without moving from the portion at which the ice is made to the liquid water, and thus, transparency of the ice may be reduced.

On the contrary, when the cold air supply part 900 supplies the cold air to the ice making cell 320*a*, if the ice making rate is low, the above limitation may be solved to increase in transparency of the ice. However, there is a limitation in which an making time increases.

Accordingly, the transparent ice heater 430 may be disposed at one side of the ice making cell 320*a* so that the heater locally supplies heat to the ice making cell 320*a*, thereby increasing in transparency of the made ice while reducing the ice making time.

When the transparent ice heater 430 is disposed on one side of the ice making cell 320*a*, the transparent ice heater 430 may be made of a material having thermal conductivity less than that of the metal to prevent heat of the transparent ice heater 430 from being easily transferred to the other side of the ice making cell 320*a*.

Alternatively, at least one of the first tray 320 and the second tray 380 may be made of a resin including plastic so that the ice attached to the trays 320 and 380 is separated in the ice making process.

At least one of the first tray 320 or the second tray 380 may be made of a flexible or soft material so that the tray deformed by the pushers 260 and 540 is easily restored to its original shape in the ice separation process.

The transparent ice heater 430 may be disposed at a position adjacent to the second tray 380. The transparent ice heater 430 may be, for example, a wire type heater. For example, the transparent ice heater 430 may be installed to contact the second tray 380 or may be disposed at a position spaced a predetermined distance from the second tray 380. For another example, the second heater case 420 may not be separately provided, but the transparent heater 430 may be installed on the second tray supporter 400. In some cases, the transparent ice heater 430 may supply heat to the second tray 380, and the heat supplied to the second tray 380 may be transferred to the ice making cell 320*a*.

<First Pusher>

FIG. 38 is a view of the first pusher according to an embodiment, wherein FIG. 38(*a*) is a perspective view of the first pusher, and FIG. 38(*b*) is a side view of the first pusher.

Referring to FIG. 38, the first pusher 260 may include a pushing bar 264. The pushing bar 264 may include a first edge 264*a* on which a pressing surface pressing ice or a tray in the ice separation process is disposed and a second edge 264*b* disposed at a side opposite to the first edge 264*a*. For example, the pressing surface may be flat or curved surface.

The pushing bar 264 may extend in the vertical direction and may be provided in a straight line shape or a curved shape in which at least a portion of the pushing bar 264 is rounded. A diameter of the pushing bar 264 is less than that of the opening 324 of the first tray 320. Accordingly, the pushing bar 264 may be inserted into the ice making cell 320*a* through the opening 324. Thus, the first pusher 260 may be referred to as a penetrating type passing through the ice making cell 320*a*.

When the ice maker includes a plurality of ice making cells 320*a*, the first pusher 260 may include a plurality of pushing bars 264. Two adjacent pushing bars 264 may be connected to each other by the connection part 263. The connection part 263 may connect upper ends of the pushing bars 264 to each other. Thus, the second edge 264*a* and the connection part 263 may be prevented from interfering with the first tray 320 while the pushing bar 264 is inserted into the ice making cell 320*a*.

The first pusher 260 may include a guide connection part 265 passing through the guide slot 302. For example, the guide connection part 265 may be provided at each of both sides of the first pusher 260. A vertical cross-section of the guide connection part 265 may have a circular, oval, or polygonal shape. The guide connection part 265 may be disposed in the guide slot 302. The guide connection part 265 may move in a longitudinal direction along the guide slot 302 in a state of being disposed in the guide slot 302. For example, the guide connection part 265 may move in the vertical direction. Although the guide slot 302 has been described as being provided in the first tray cover 300, it may be alternatively provided in the wall defining the bracket 220 or the storage chamber.

The guide connection part 265 may further include a link connection part 266 to be coupled to the pusher link 260. The link connection part 266 may be disposed at a position lower than that of the second edge 264*b*. The link connection part 266 may be provided in a cylindrical shape so that the link connection part 266 rotates in the state in which the link connection part 266 is coupled to the pusher link 500.

Figure 36:
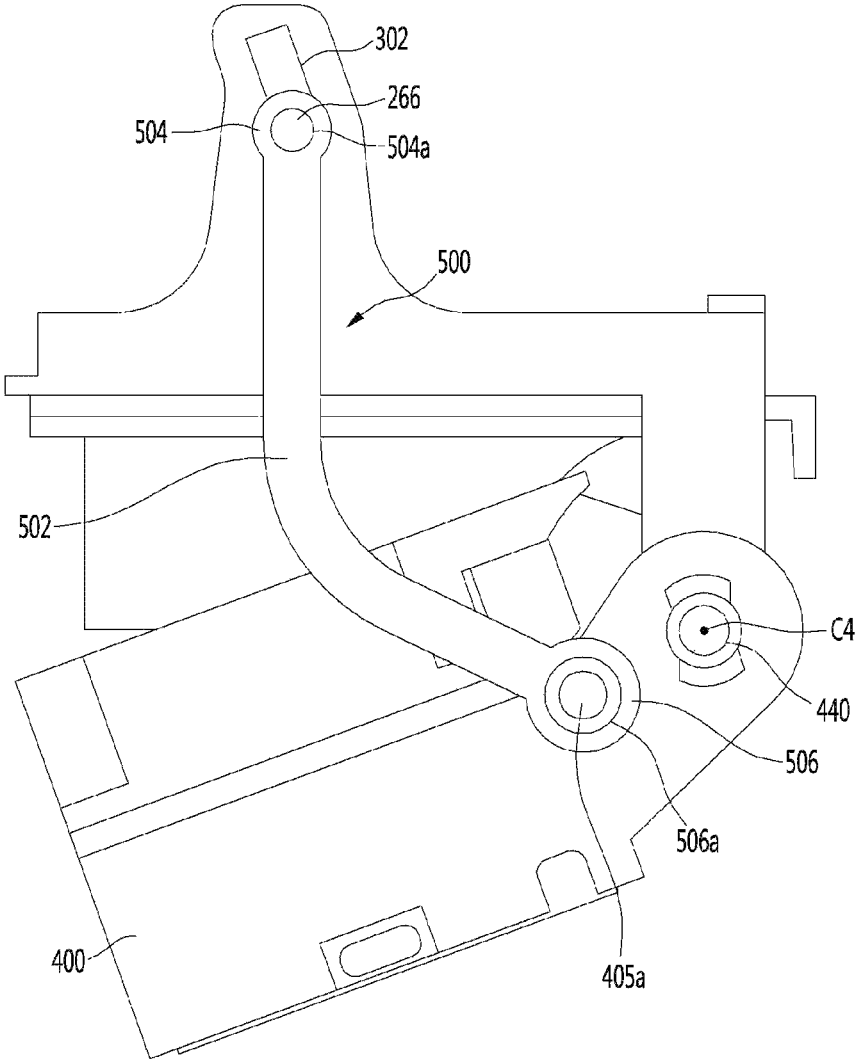
FIG. 36 is a view illustrating a state in which the first pusher is connected to a second tray assembly by a link.

FIG. 36 is a view illustrating a state in which the first pusher is connected to the second tray assembly by the link.

Referring to FIG. 36, the pusher link 500 may connect the first pusher 500 to the second tray assembly. For example, the pusher link 500 may be connected to the first pusher 260 and the second tray case.

The pusher link 500 may include a link body 502. The link body 502 may have a rounded shape. As the link body 502 is provided in a round shape, the pusher link 500 may allow the first pusher 260 to rotate and also to vertically move while the second tray assembly rotates.

The pusher link 500 may include a first connection part 504 provided at one end of the link body 502 and a second connection part 506 provided at the other end of the link body 502. The first connection part 504 may include a first coupling hole 504*a* to which the link connection part 266 is coupled. The link connection part 266 may be connected to the first connection part 504 after passing through the guide slot 302. The second connection part 506 may be coupled to the second tray supporter 400. The second connection part 506 may include a second coupling hole 506*a* to which the link connection part 405*a* provided on the second tray supporter 400 is coupled. The second connection part 506 may be connected to the second tray supporter 400 at a position spaced apart from the rotation center C4 of the shaft 440 or the rotation center C4 of the second tray assembly. Therefore, according to this embodiment, the pusher link 500 connected to the second tray assembly rotates together by the rotation of the second tray assembly. While the pusher link 500 rotates, the first pusher 260 connected to the pusher link 500 moves vertically along the guide slot 302. The pusher link 500 may serve to convert rotational force of the second tray assembly into vertical movement force of the first pusher 260. Accordingly, the first pusher 260 may also be referred to as a movable pusher.

Figure 37:
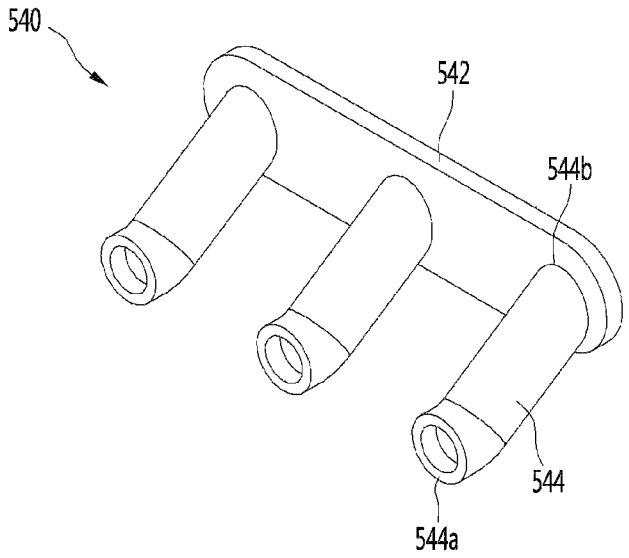
FIG. 37 is a perspective view of a second pusher according to an embodiment.
Figure 38A:
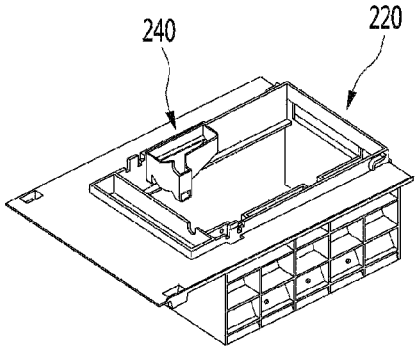
FIGS. 38A to 40 are views illustrating an assembly process of an ice maker according to an embodiment.
Figure 38B:
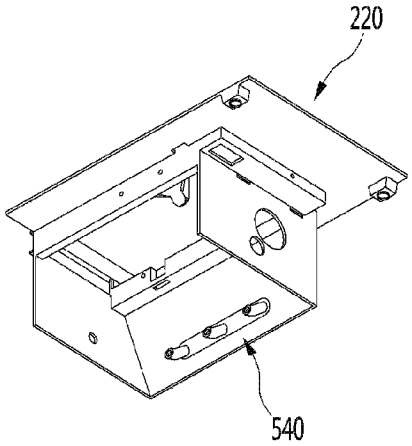
Figure 38C:
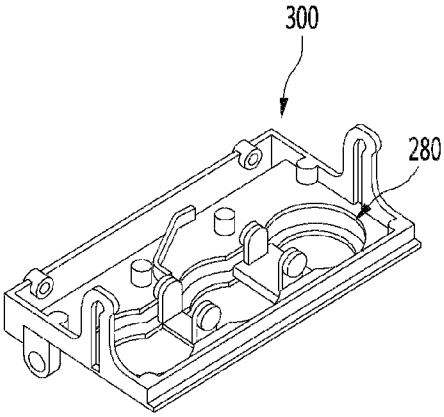
Figure 38D:
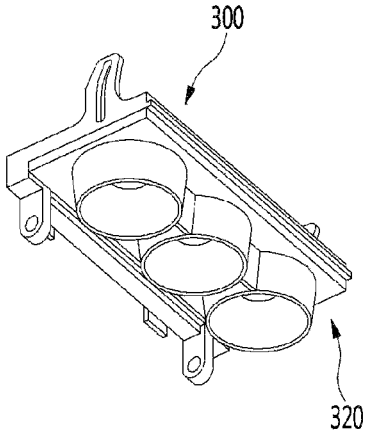
Figure 39A:
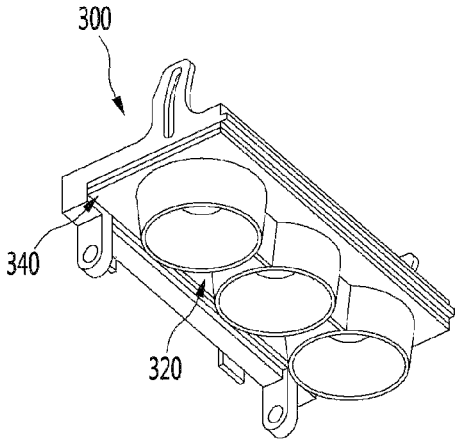
Figure 39B:
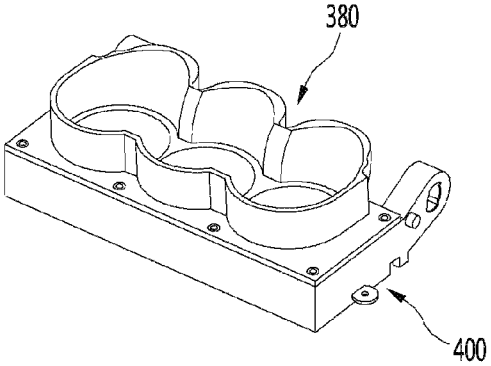
Figure 39C:
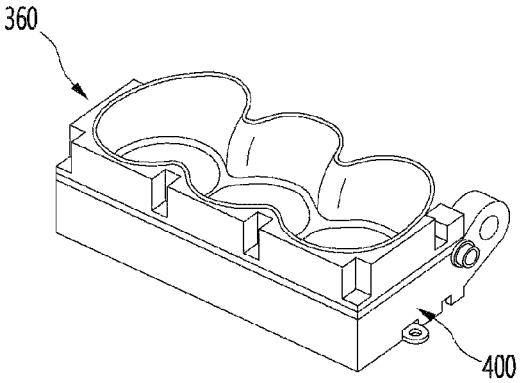
Figure 39D:
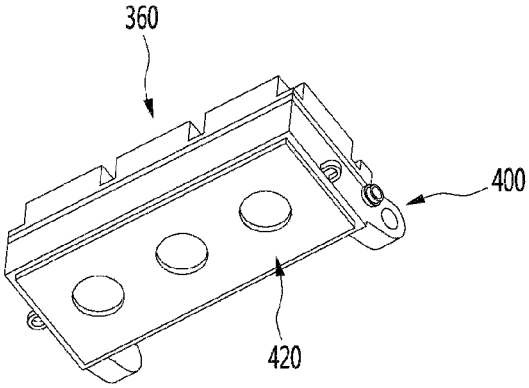

FIG. 37 is a perspective view of the second pusher according to an embodiment.

Referring to FIG. 37, the second pusher 540 according to this embodiment may include a pushing bar 544. The pushing bar 544 may include a first edge 544*a* on which a pressing surface pressing the second tray 380 is disposed and a second edge 544*b* disposed at a side opposite to the first edge 544*a*.

The pushing bar 544 may have a curved shape to increase in time taken to press the second tray 380 without interfering with the second tray 380 that rotates in the ice separation process. The first edge 544*a* may be a plane and include a vertical surface or an inclined surface. The second edge 544*b* may be coupled to the fourth wall 224 of the bracket 220, or the second edge 544*b* may be coupled to the fourth wall 224 of the bracket 220 by the coupling plate 542. The coupling plate 542 may be seated in the mounting groove 224*a* defined in the fourth wall 224 of the bracket 220.

When the ice maker 200 includes the plurality of ice making cells 320*a*, the second pusher 540 may include a plurality of pushing bars 544. The plurality of pushing bars 544 may be connected to the coupling plate 542 while being spaced apart from each other in the horizontal direction. The plurality of pushing bars 544 may be integrally formed with the coupling plate 542 or coupled to the coupling plate 542. The first edge 544*a* may be disposed to be inclined with respect to the center line C1 of the ice making cell 320*a*. The first edge 544*a* may be inclined in a direction away from the center line C1 of the ice making cell 320*a* from an upper end toward a lower end. An angle of the inclined surface defined by the first edge 544*a* with respect to the vertical line may be less than that of the inclined surface defined by the second edge 544*b*.

The direction in which the pushing bar 544 extends from the center of the first edge 544*a* toward the center of the second edge 544*b* may include at least two directions. For example, the pushing bar 544 may include a first portion extending in a first direction and a second portion extending in a direction different from the second portion. At least a portion of the line connecting the center of the second edge 544*b* to the center of the first edge 544*a* along the pushing bar 544 may be curved. The first edge 544*a* and the second edge 544*b* may have different heights. The first edge 544*a* may be disposed to be inclined with respect to the second edge 544*b*.

Figure 40:
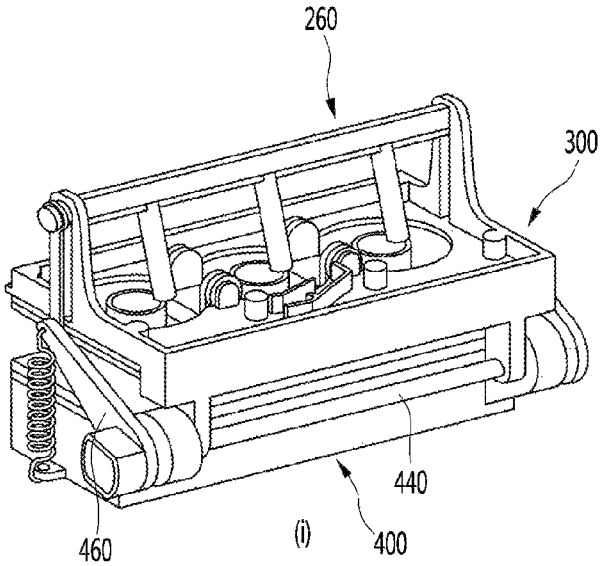

FIGS. 38 to 40 are views illustrating an assembly process of the ice maker according to an embodiment.

FIGS. 38 to 40 are views sequentially illustrating an assembling process, i.e., illustrating a process of coupling components to each other.

First, the first tray assembly and the second tray assembly may be assembled.

To assemble the first tray assembly, the ice separation heater 290 may be coupled to the first heater case 280, and the first heater case 280 may be assembled to the first tray case. For example, the first heater case may be assembled to the first tray cover 300. Alternatively, when the first heater case 280 is integrally formed with the first tray cover 300, the ice separation heater 290 may be coupled to the first tray cover 300. The first tray 320 and the first tray case may be coupled to each other. For example, the first tray cover 300 is disposed above the first tray 320, the first tray supporter 340 may be disposed below the first tray 320, and then the coupling member is used to couple the first tray cover 300, the first tray 320, and the first tray supporter 340 to each other. To assemble the second tray assembly, the transparent ice heater 430 and the second heater case 420 may be coupled to each other. The second heater case 420 may be coupled to the second tray case. For example, the second heater case 420 may be coupled to the second tray supporter 400. Alternatively, when the second heater case 420 is integrally formed with the second tray supporter 400, the transparent ice heater 430 may be coupled to the second tray supporter 400.

The second tray 380 and the second tray case may be coupled to each other. For example, the second tray cover 360 is disposed above the second tray 380, the second tray supporter 400 may be disposed below the second tray 380, and then the coupling member is used to couple the second tray cover 360, the second tray 380, and the second tray supporter 400 to each other.

The assembled first tray assembly and the second tray assembly may be aligned in a state of contacting each other.

The power transmission part connected to the driver 480 may be coupled to the second tray assembly. For example, the shaft 440 may pass through the pair of extension parts 403 of the second tray assembly. The shaft 440 may also pass through the extension part 281 of the first tray assembly. That is, the shaft 440 may simultaneously pass through the extension part 281 of the first tray assembly and the extension part 403 of the second tray assembly. In this case, a pair of extension parts 281 of the first tray assembly may be disposed between the pair of extension parts 403 of the second tray assembly. The rotation arm 460 may be connected to the shaft 440. The spring may be connected to the rotation arm 460 and the second tray assembly. The first pusher 260 may be connected to the second tray assembly by the pusher link 500. The first pusher 260 may be connected to the pusher link 500 in a state in which the first pusher 260 is disposed to be movable in the first tray assembly. One end of the pusher link 500 may be connected to the first pusher 260, and the other end may be connected to the second tray assembly. The first pusher 260 may be disposed to contact the first tray case.

The assembled first tray assembly may be installed on the bracket 220. For example, the first tray assembly may be coupled to the bracket 220 in a state in which the first tray assembly is disposed in the through-hole 221*a* of the first wall 221. For another example, the bracket 220 and the first tray cover may be integrally formed. Then, the first tray assembly may be assembled by coupling the bracket 220 to which the first tray cover is integrated, the first tray 320, and the first tray supporter to each other.

A water supply part 240 may be coupled to the bracket 220. For example, the water supply part 240 may be coupled to the first wall 221. The driver 480 may be mounted on the bracket 220. For example, the driver 480 may be mounted to the third wall 223.

Figure 41:
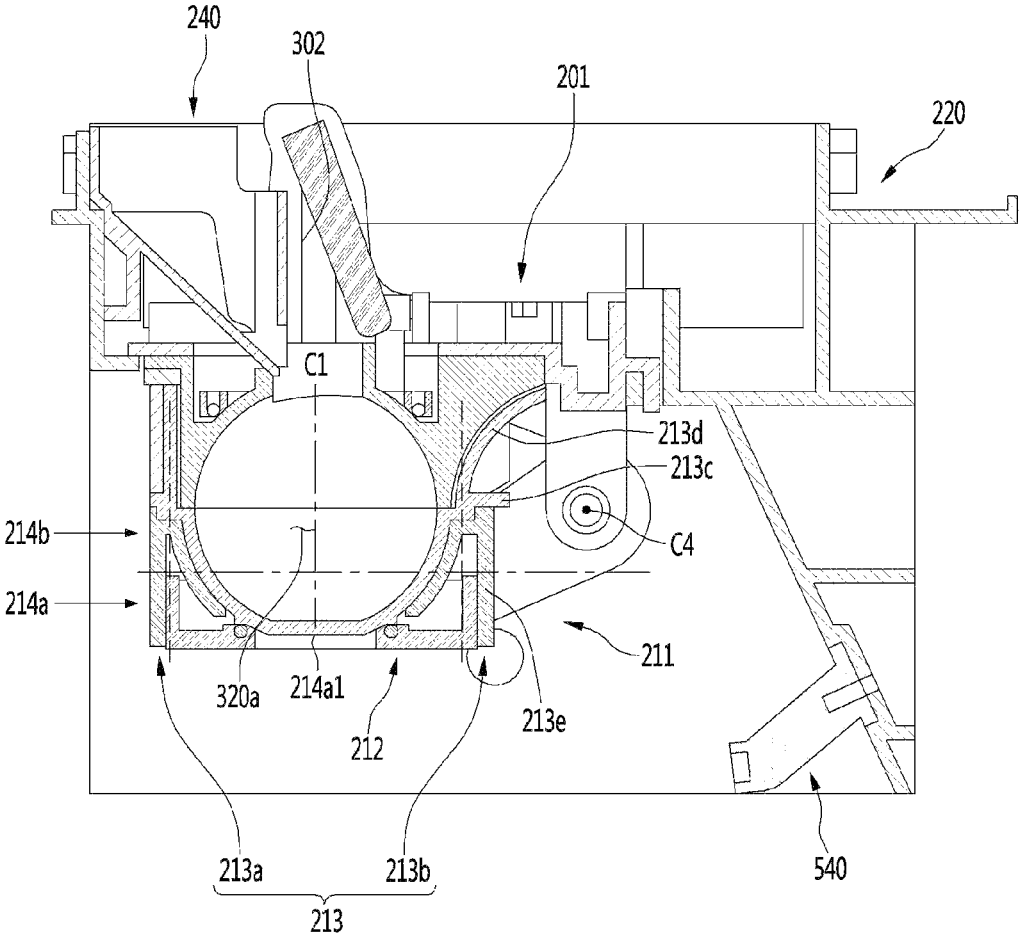
FIG. 41 is a cross-sectional view taken along line 41-41 of FIG. 2.

FIG. 41 is a cross-sectional view taken along line 41-41 of FIG. 2.

Referring to FIG. 41, the ice maker 200 may include a first tray assembly 201 and a second tray assembly 211, which are connected to each other.

The first tray assembly 201 may include a first portion defining at least a portion of the ice making cell 320*a* and a second portion connected to a predetermined point of the first portion.

The first portion of the first tray assembly 201 may include the first portion 322 of the first tray 320, and the second portion of the first tray assembly 201 may include the second portion 322 of the first tray 320. Accordingly, the first tray assembly 201 includes deformation resistance reinforcement parts of the first tray 320. The first tray assembly 201 may include a first region and a second region located farther from the transparent ice heater 430 than the first region. The first region of the first tray assembly 201 may include the first region of the first tray 320, and the second region of the first tray assembly 201 may include the second region of the first tray 320.

The second tray assembly 211 may include a first portion 212 defining at least a portion of the ice making cell 320*a* and a second portion 213 extending from a predetermined point of the first portion 212. The second portion 213 may reduce transfer of heat from the transparent ice heater 430 to the ice making cell 320*a* defined by the first tray assembly 201. The first portion 212 may be an area disposed between two dotted lines in FIG. 41.

The predetermined point of the first portion 212 may be an end of the first portion 212 or a point at which the first tray assembly 201 and the second tray assembly 211 meet each other. At least a portion of the first portion 212 may extend in a direction away from the ice making cell 320*a* defined by the first tray assembly 201. At least two portions of the second portion 213 may be branched to reduce heat transfer in the direction extending to the second portion 213. A portion of the second portion 213 may extend in the horizontal direction passing through the center of the ice making cell 320*a*. A portion of the second portion 213 may extend in an upward direction with respect to a horizontal line passing through the center of the ice making chamber 320*a*.

The second portion 213 includes a first part 213*c* extending in the horizontal direction passing through the center of the ice making cell 320*a*, a second part 213*d* extending upward with respect to the horizontal line passing through the center of the ice making cell 320*a*, a third part 213*e* extending downward.

The first portion 212 may have different degree of heat transfer in a direction along the outer circumferential surface of the ice making cell 320*a* to reduce transfer of heat, which is transferred from the transparent ice heater 430 to the second tray assembly 211, to the ice making cell 320*a* defined by the first tray assembly 201. The transparent ice heater 430 may be disposed to heat both sides of the first portion 212 with respect to the lowermost end of the first portion 212.

The first portion 212 may include a first region 214*a* and a second region 214*b*. In FIG. 41, the first region 214*a* and the second region 214*b* are divided by a dashed-dotted line extending in the horizontal direction. The second region 214*b* may be a region defined above the first region 214*a*. The degree of heat transfer of the second region 214*b* may be greater than that of the first region 214*a*.

The first region 214*a* may include a portion at which the transparent ice heater 430 is disposed. That is, the transparent ice heater 430 may be disposed in the first region 214*a*. The lowermost end 214*a*1 of the ice making cell 320*a* in the first region 214*a* may have a heat transfer rate less than that of the other portion of the first region 214*a*. The second region 214*b* may include a portion in which the first tray assembly 201 and the second tray assembly 211 contact each other. The first region 214*a* may provide a portion of the ice making cell 320*a*. The second region 214*b* may provide the other portion of the ice making cell 320*a*. The second region 214*b* may be disposed farther from the transparent ice heater 430 than the first region 214*a*.

Part of the first region 214*a* may have the degree of heat transfer less than that of the other part of the first region 214*a* to reduce transfer of heat, which is transferred from the transparent ice heater 430 to the first region 214*a*, to the ice making cell 320*a* defined by the second region 214*b*. To make ice in the direction from the ice making cell 320*a* defined by the first region 214*a* to the ice making cell 320*a* defined by the second region 214*b*, a portion of the first region 214*a* may have a degree of deformation resistance less than that of the other portion of the first region 214*a* and a degree of restoration greater than that of the other portion of the first region 214*a*.

A portion of the first region 214*a* may be thinner than the other portion of the first region 214*a* in the thickness direction from the center of the ice making cell 320*a* to the outer circumferential surface direction of the ice making cell 320*a*. For example, the first region 214*a* may include a second tray case surrounding at least a portion of the second tray 380 and at least a portion of the second tray 380.

An average cross-sectional area or average thickness of the first tray assembly 201 may be greater than that of the second tray assembly 211 with respect to the Y-Z cutting surface. A maximum cross-sectional area or maximum thickness of the first tray assembly 201 may be greater than that of the second tray assembly 211 with respect to the Y-Z cutting surface. A minimum cross-sectional area or minimum thickness of the first tray assembly 201 may be greater than that of the second tray assembly 211 with respect to the Y-Z cutting surface. Uniformity of a minimum cross-sectional area or minimum thickness of the first tray assembly 201 may be greater than that of the second tray assembly 211.

The rotation center C4 may be eccentric with respect to a line bisecting the length in the Y-axis direction of the bracket 220. The ice making cell 320*a* may be eccentric with respect to a line bisecting a length in the Y-axis direction of the bracket 220. The rotation center C4 may be disposed closer to the second pusher 540 than to the ice making cell 320*a*.

The second portion 213 may include a first extension part 213*a* and a second extension part 323*b*, which are disposed at sides opposite to each other with respect to the central line C1. The first extension part 213*a* may be disposed at a left side of the center line C1 in FIG. 41, and the second extension part 213*b* may be disposed at a right side of the center line C1 in FIG. 41.

The water supply part 240 may be disposed close to the first extension part 213*a*. The first tray assembly 201 may include a pair of guide slots 302, and the water supply part 240 may be disposed in a region between the pair of guide slots 302. A length of the guide slot 302 may be greater than a sum of a radius of the ice making cell 320*a* and a height of the auxiliary storage chamber 325.

Figure 42:
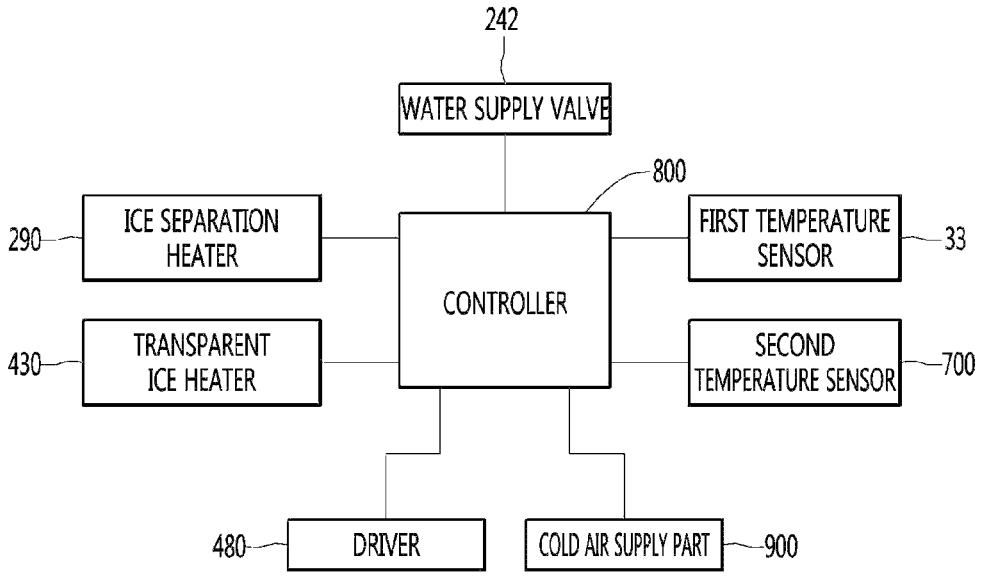
FIG. 42 is a block diagram illustrating a control of a refrigerator according to an embodiment.

FIG. 42 is a block diagram illustrating a control of a refrigerator according to an embodiment.

Referring to FIG. 42, the refrigerator according to this embodiment may include a cooler supplying a cold to the freezing compartment 32 (or the ice making cell).

In FIG. 42, for example, the cooler includes a cold air supply part 900. The cold air supply part 900 may supply cold air to the freezing compartment 32 using a refrigerant cycle. For example, the cold air supply part 900 may include a compressor compressing the refrigerant. A temperature of the cold air supplied to the freezing compartment 32 may vary according to the output (or frequency) of the compressor. Alternatively, the cold air supply part 900 may include a fan blowing air to an evaporator. An amount of cold air supplied to the freezing compartment 32 may vary according to the output (or rotation rate) of the fan. Alternatively, the cold air supply part 900 may include a refrigerant valve controlling an amount of refrigerant flowing through the refrigerant cycle. An amount of refrigerant flowing through the refrigerant cycle may vary by adjusting an opening degree by the refrigerant valve, and thus, the temperature of the cold air supplied to the freezing compartment 32 may vary. Therefore, in this embodiment, the cold air supply part 900 may include one or more of the compressor, the fan, and the refrigerant valve. The cold air supply part 900 may further include the evaporator exchanging heat between the refrigerant and the air. The cold air heat-exchanged with the evaporator may be supplied to the ice maker 200.

The refrigerator according to this embodiment may further include a controller 800 that controls the cold air supply part 900. The refrigerator may further include a water supply valve 242 controlling an amount of water supplied through the water supply part 240.

The controller 800 may control a portion or all of the ice separation heater 290, the transparent ice heater 430, the driver 480, the cold air supply part 900, and the water supply valve 242.

In this embodiment, when the ice maker 200 includes both the ice separation heater 290 and the transparent ice heater 430, an output of the ice separation heater 290 and an output of the transparent ice heater 430 may be different from each other. When the outputs of the ice separation heater 290 and the transparent ice heater 430 are different from each other, an output terminal of the ice separation heater 290 and an output terminal of the transparent ice heater 430 may be provided in different shapes, incorrect connection of the two output terminals may be prevented. Although not limited, the output of the ice separation heater 290 may be set larger than that of the transparent ice heater 430. Accordingly, ice may be quickly separated from the first tray 320 by the ice separation heater 290. In this embodiment, when the ice separation heater 290 is not provided, the transparent ice heater 430 may be disposed at a position adjacent to the second tray 380 described above or be disposed at a position adjacent to the first tray 320.

The refrigerator may further include a first temperature sensor 33 (or an internal temperature sensor) that senses a temperature of the freezing compartment 32. The controller 800 may control the cold air supply part 900 based on the temperature sensed by the first temperature sensor 33. The controller 800 may determine whether ice making is completed based on the temperature sensed by the second temperature sensor 700.

Figure 43:
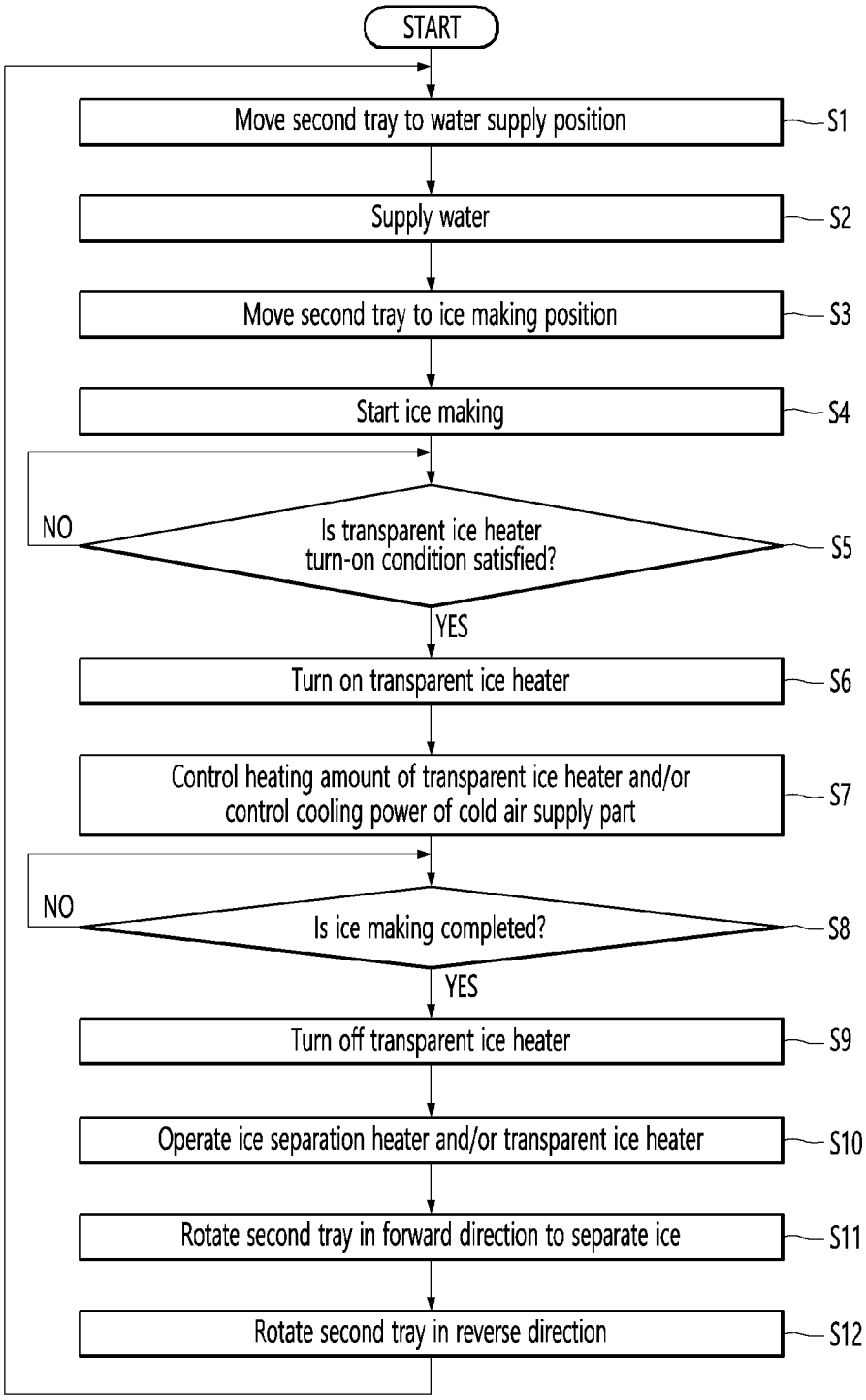
FIG. 43 is a flowchart for explaining a process of making ice in the ice maker according to an embodiment.
Figure 44A:
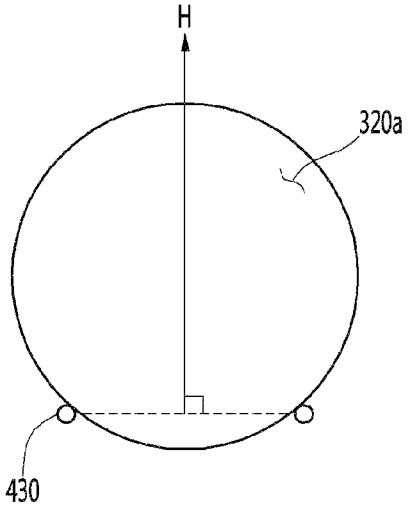
FIGS. 44A and 44B are views for explaining a height reference depending on a relative position of the transparent heater with respect to the ice making cell.
Figure 44B:
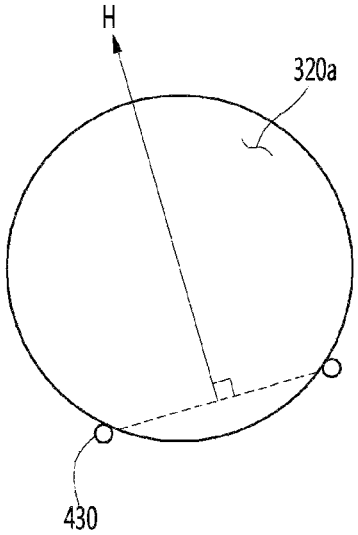
Figure 45A:
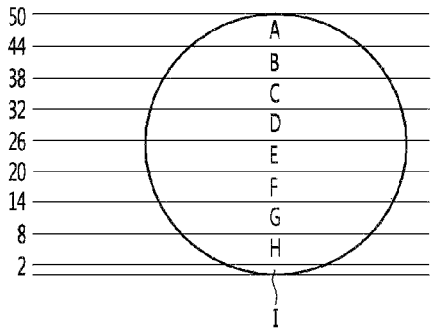
FIGS. 45A and 45B are views for explaining an output of the transparent heater per unit height of water within the ice making cell.
Figure 45B:
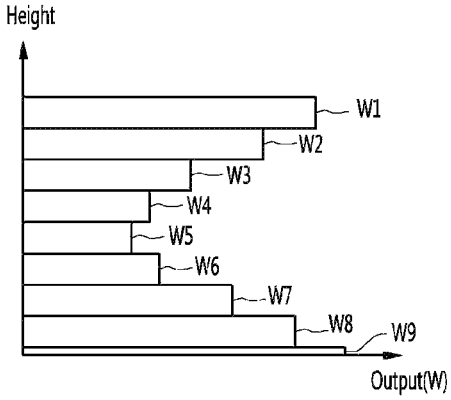
Figure 46:
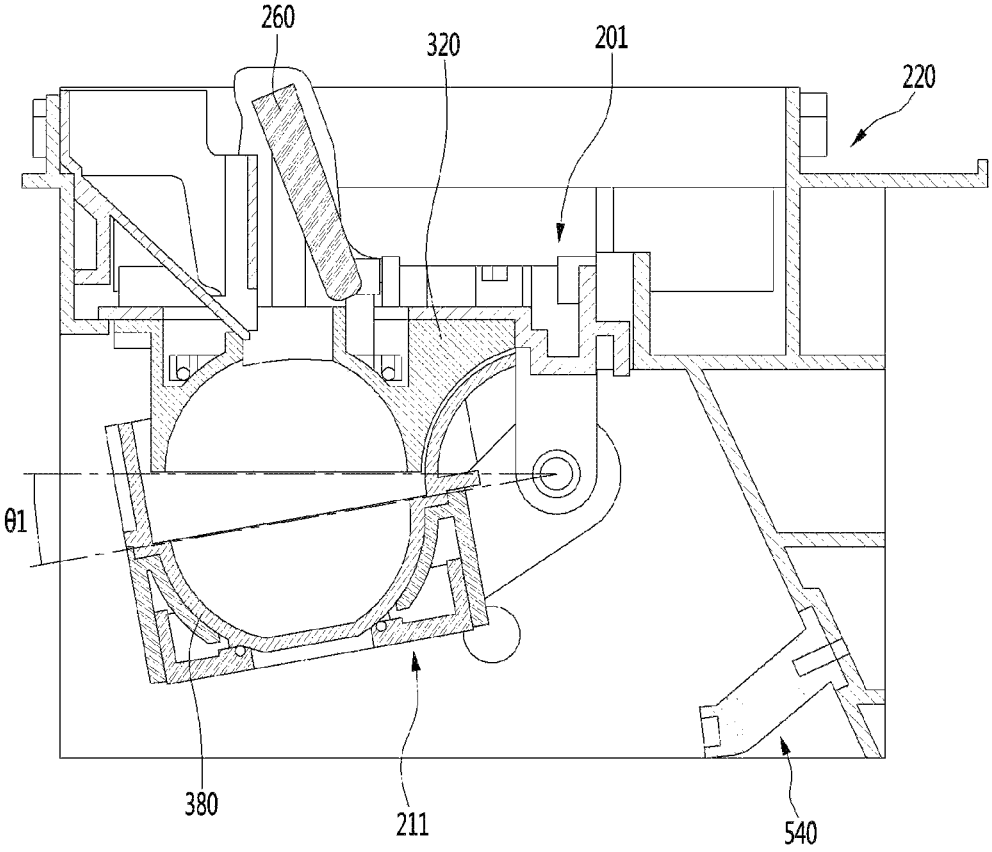
FIG. 46 is a cross-sectional view illustrating a position relationship between a first tray assembly and a second tray assembly at a water supply position.
Figure 47:
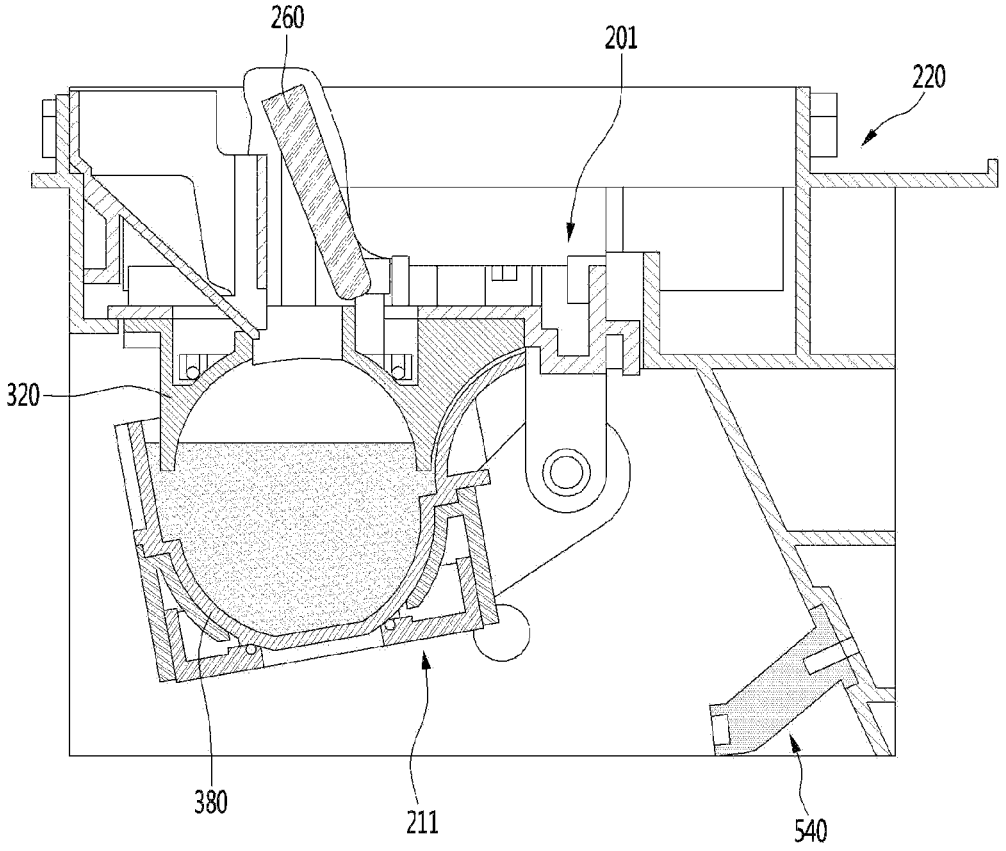
FIG. 47 is a view illustrating a state in which supply of water is complete in FIG. 46.

FIG. 43 is a flowchart for explaining a process of making ice in the ice maker according to an embodiment. FIG. 44 is a view for explaining a height reference depending on a relative position of the transparent heater with respect to the ice making cell, and FIG. 45 is a view for explaining an output of the transparent heater per unit height of water within the ice making cell. FIG. 46 is a cross-sectional view illustrating a position relationship between a first tray assembly and a second tray assembly at a water supply position. FIG. 47 is a view illustrating a state in which supply of water is complete in FIG. 46.

Figure 48:
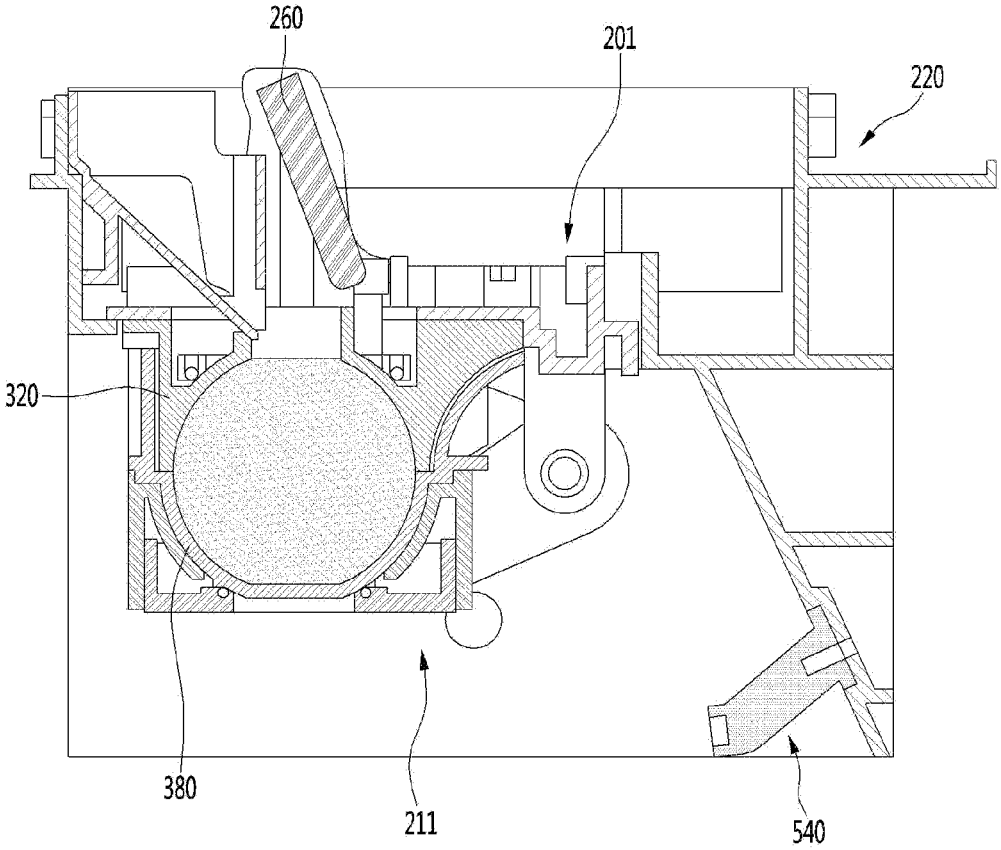
FIG. 48 is a cross-sectional view illustrating a position relationship between a first tray assembly and a second tray assembly at an ice making position.
Figure 50:
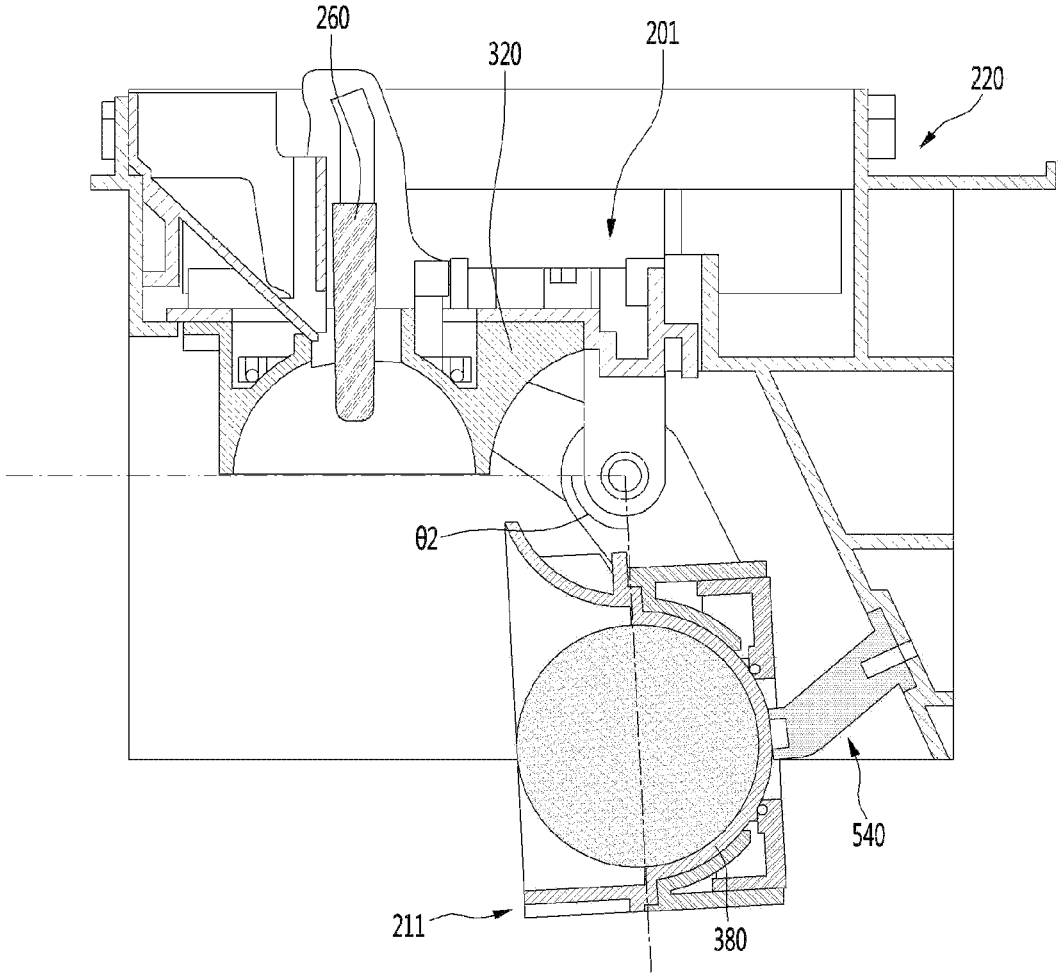
FIG. 50 is a cross-sectional view illustrating a position relationship between a first tray assembly and a second tray assembly in an ice separation process.
Figure 51:
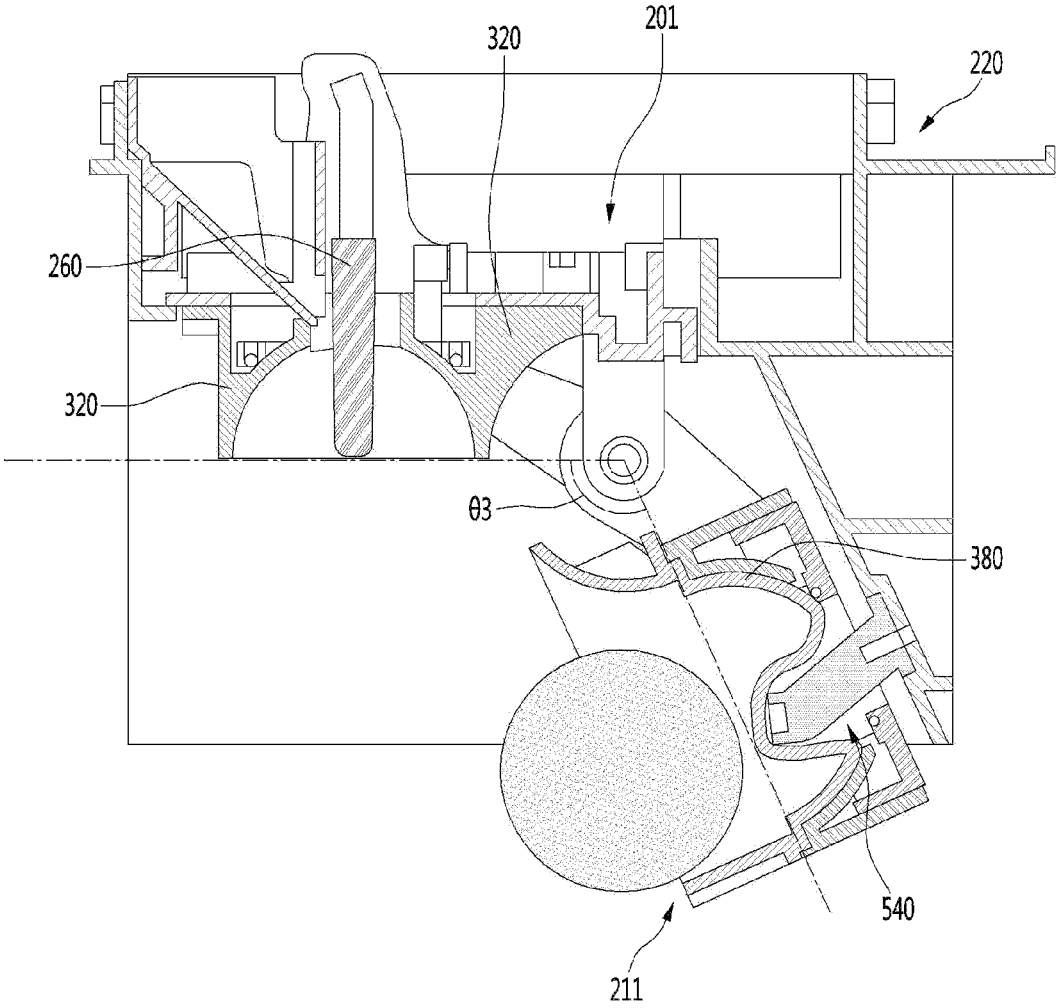
FIG. 51 is a cross-sectional view illustrating the position relationship between the first tray assembly and the second tray assembly at the ice separation position.
Figure 52A:
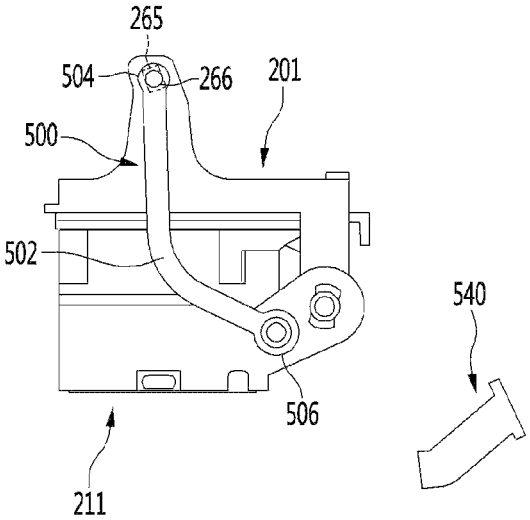
FIGS. 52A to 52D are views illustrating an operation of a pusher link when the second tray assembly moves from the ice making position to the ice separation position.
Figure 52B:
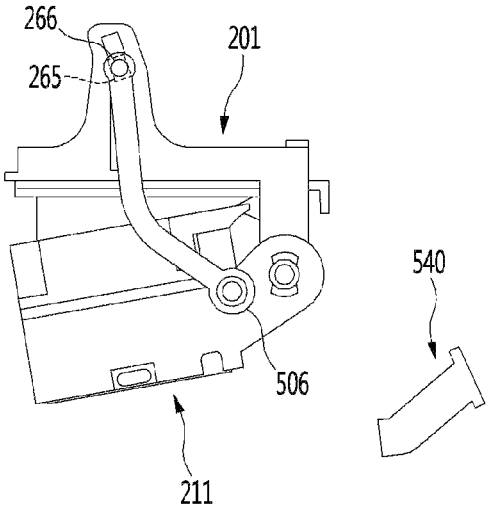
Figure 52C:
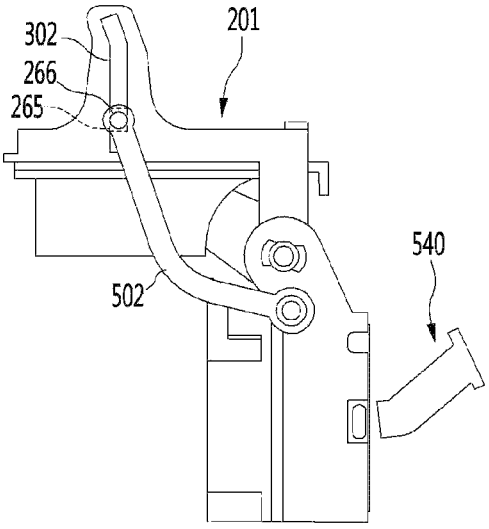
Figure 52D:
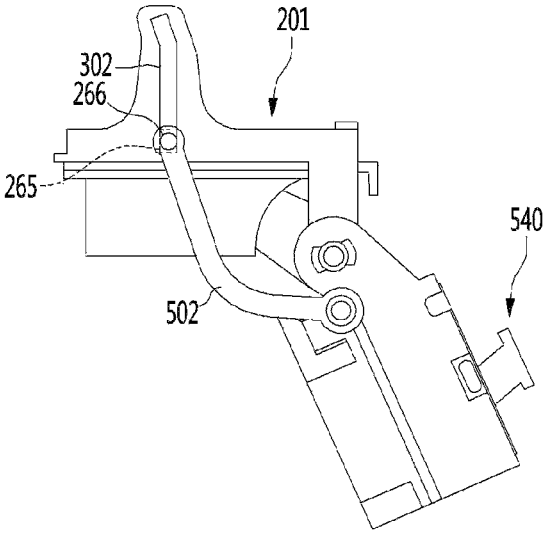

FIG. 48 is a cross-sectional view illustrating a position relationship between a first tray assembly and a second tray assembly at an ice making position, and FIG. 49 is a view illustrating a state in which a pressing part of the second tray is deformed in a state in which ice making is complete. FIG. 50 is a cross-sectional view illustrating a position relationship between a first tray assembly and a second tray assembly in an ice separation process, and FIG. 51 is a cross-sectional view illustrating the position relationship between the first tray assembly and the second tray assembly at the ice separation position.

Referring to FIGS. 43 to 51, to make ice in the ice maker 200, the controller 800 moves the second tray assembly 211 to a water supply position (S1). In this specification, a direction in which the second tray assembly 211 moves from the ice making position of FIG. 48 to the ice separation position of FIG. 51 may be referred to as forward movement (or forward rotation). On the other hand, the direction from the ice separation position of FIG. 48 to the water supply position of FIG. 46 may be referred to as reverse movement (or reverse rotation).

The movement to the water supply position of the second tray assembly 211 is detected by a sensor, and when it is detected that the second tray assembly 211 moves to the water supply position, the controller 800 stops the driver 480. At least a portion of the second tray 380 may be spaced apart from the first tray 320 at the water supply position of the second tray assembly 211.

At the water supply position of the second tray assembly 211, the first tray assembly 201 and the second tray assembly 211 define a first angle θ1 with respect to the rotation center C4. That is, the first contact surface 322*c* of the first tray 320 and the second contact surface 382*c* of the second tray 380 define a first angle therebetween.

The water supply starts when the second tray 380 moves to the water supply position (S2). For the water supply, the controller 800 turns on the water supply valve 242, and when it is determined that a predetermined amount of water is supplied, the controller 800 may turn off the water supply valve 242. For example, in the process of supplying water, when a pulse is outputted from a flow sensor (not shown), and the outputted pulse reaches a reference pulse, it may be determined that a predetermined amount of water is supplied. In the water supply position, the second portion 383 of the second tray 380 may surround the first tray 320. For example, the second portion 383 of the second tray 380 may surround the second portion 323 of the first tray 320. Accordingly, leakage of the water, which supplied to the ice making cell 320*a*, between the first tray assembly 201 and the second tray assembly 211 while the second tray 380 moves from the water supply position to the ice making position may be reduced. Also, it is possible to reduce a phenomenon in which water expanded in the ice making process leaks between the first tray assembly 201 and the second tray assembly 211 and is frozen.

After the water supply is completed, the controller 800 controls the driver 480 to allow the second tray assembly 211 to move to the ice making position (S3). For example, the controller 800 may control the driver 480 to allow the second tray assembly 211 to move from the water supply position in the reverse direction. When the second tray assembly 211 move in the reverse direction, the second contact surface 382*c* of the second tray 380 comes close to the first contact surface 322*c* of the first tray 320. Then, water between the second contact surface 382*c* of the second tray 380 and the first contact surface 322*c* of the first tray 320 is divided into each of the plurality of second cells 381*a* and then is distributed. When the second contact surface 382*c* of the second tray 380 and the first contact surface 322*c* of the first tray 320 contact each other, water is filled in the first cell 321*a*. As described above, when the second contact surface 382*c* of the second tray 380 contacts the first contact surface 322*c* of the first tray 320, the leakage of water in the ice making cell 320*a* may be reduced. The movement to the ice making position of the second tray assembly 211 is detected by a sensor, and when it is detected that the second tray assembly 211 moves to the ice making position, the controller 800 stops the driver 480.

In the state in which the second tray assembly 211 moves to the ice making position, ice making is started (S4).

At the ice making position of the second tray assembly 211, the second portion 383 of the second tray 380 may face the second portion 323 of the first tray 320. At least a portion of each of the second portion 383 of the second tray 380 and the second portion 323 of the first tray 320 may extend in a horizontal direction passing through the center of the ice making cell 320*a*. At least a portion of each of the second portion 383 of the second tray 380 and the second portion 323 of the first tray 320 is disposed at the same height or higher than the uppermost end of the ice making cell 320*a*. At least a portion of each of the second portion 383 of the second tray 380 and the second portion 323 of the first tray 320 may be lower than the uppermost end of the auxiliary storage chamber 325. At the ice making position of the second tray assembly 211, the second portion 383 of the second tray 380 may be spaced apart from the second portion 323 of the first tray 320. The space may extend to a portion having a height equal to or greater than the uppermost end of the ice making cell 320*a* defined by the first portion 322 of the first tray 320. The space may extend to a point lower than the uppermost end of the auxiliary storage chamber 325.

The ice separation heater 290 provides heat to reduce freezing of water in the space between the second portion 383 of the second tray 380 and the second portion 323 of the first tray 320.

As described above, the second portion 383 of the second tray 380 serves as a leakage prevention part. It is advantageous that a length of the leakage prevention part is provided as long as possible. This is because as the length of the leak prevention part increases, an amount of water leaking between the first and second tray assemblies is reduced. A length of the leakage prevention part defined by the second portion 383 may be greater than a distance from the center of the ice making cell 320*a* to the outer circumferential surface of the ice making cell 320*a*.

A second surface facing the first portion 322 of the first tray 320 at the first portion 382 of the second tray 380 may have a surface area greater than that of the first surface facing the first portion 382 of the second tray 380 at the first portion 322 of the first tray 320. Due to a difference in surface area, coupling force between the first tray assembly 201 and the second tray assembly 211 may increase.

The ice making may be started when the second tray 380 reaches the ice making position. Alternatively, when the second tray 380 reaches the ice making position, and the water supply time elapses, the ice making may be started. When ice making is started, the controller 800 may control the cold air supply part 900 to supply cool air to the ice making cell 320*a*.

After the ice making is started, the controller 800 may control the transparent ice heater 430 to be turned on in at least partial sections of the cold air supply part 900 supplying the cold air to the ice making cell 320*a*. When the transparent ice heater 430 is turned on, since the heat of the transparent ice heater 430 is transferred to the ice making cell 320*a*, the ice making rate of the ice making cell 320*a* may be delayed. According to this embodiment, the ice making rate may be delayed so that the bubbles dissolved in the water inside the ice making cell 320*a* move from the portion at which ice is made toward the liquid water by the heat of the transparent ice heater 430 to make the transparent ice in the ice maker 200.

In the ice making process, the controller 800 may determine whether the turn-on condition of the transparent ice heater 430 is satisfied (S5). In this embodiment, the transparent ice heater 430 is not turned on immediately after the ice making is started, and the transparent ice heater 430 may be turned on only when the turn-on condition of the transparent ice heater 430 is satisfied (S6).

Generally, the water supplied to the ice making cell 320*a* may be water having normal temperature or water having a temperature lower than the normal temperature. The temperature of the water supplied is higher than a freezing point of water. Thus, after the water supply, the temperature of the water is lowered by the cold air, and when the temperature of the water reaches the freezing point of the water, the water is changed into ice.

In this embodiment, the transparent ice heater 430 may not be turned on until the water is phase-changed into ice. If the transparent ice heater 430 is turned on before the temperature of the water supplied to the ice making cell 320*a* reaches the freezing point, the speed at which the temperature of the water reaches the freezing point by the heat of the transparent ice heater 430 is slow. As a result, the starting of the ice making may be delayed. The transparency of the ice may vary depending on the presence of the air bubbles in the portion at which ice is made after the ice making is started. If heat is supplied to the ice making cell 320*a* before the ice is made, the transparent ice heater 430 may operate regardless of the transparency of the ice. Thus, according to this embodiment, after the turn-on condition of the transparent ice heater 430 is satisfied, when the transparent ice heater 430 is turned on, power consumption due to the unnecessary operation of the transparent ice heater 430 may be prevented. Alternatively, even if the transparent ice heater 430 is turned on immediately after the start of ice making, since the transparency is not affected, it is also possible to turn on the transparent ice heater 430 after the start of the ice making.

In this embodiment, the controller 800 may determine that the turn-on condition of the transparent ice heater 430 is satisfied when a predetermined time elapses from the set specific time point. The specific time point may be set to at least one of the time points before the transparent ice heater 430 is turned on. For example, the specific time point may be set to a time point at which the cold air supply part 900 starts to supply cooling power for the ice making, a time point at which the second tray assembly 211 reaches the ice making position, a time point at which the water supply is completed, and the like. In this embodiment, the controller 800 determines that the turn-on condition of the transparent ice heater 430 is satisfied when a temperature sensed by the second temperature sensor 700 reaches a turn-on reference temperature. For example, the turn-on reference temperature may be a temperature for determining that water starts to freeze at the uppermost side (side of the opening 324) of the ice making cell 320*a*.

When a portion of the water is frozen in the ice making cell 320*a*, the temperature of the ice in the ice making cell 320*a* is below zero. The temperature of the first tray 320 may be higher than the temperature of the ice in the ice making cell 320*a*. Alternatively, although water is present in the ice making cell 320*a*, after the ice starts to be made in the ice making cell 320*a*, the temperature sensed by the second temperature sensor 700 may be below zero. Thus, to determine that making of ice is started in the ice making cell 320*a* on the basis of the temperature detected by the second temperature sensor 700, the turn-on reference temperature may be set to the below-zero temperature. That is, when the temperature sensed by the second temperature sensor 700 reaches the turn-on reference temperature, since the turn-on reference temperature is below zero, the ice temperature of the ice making cell 320*a* is below zero, i.e., lower than the below reference temperature. Therefore, it may be indirectly determined that ice is made in the ice making cell 320*a*. As described above, when the transparent ice heater 430 is not used, the heat of the transparent ice heater 430 is transferred into the ice making cell 320*a*.

In this embodiment, when the second tray 380 is disposed below the first tray 320, the transparent ice heater 430 is disposed to supply the heat to the second tray 380, the ice may be made from an upper side of the ice making cell 320*a*.

In this embodiment, since ice is made from the upper side in the ice making cell 320*a*, the bubbles move downward from the portion at which the ice is made in the ice making cell 320*a* toward the liquid water. Since density of water is greater than that of ice, water or bubbles may convex in the ice making cell 320*a*, and the bubbles may move to the transparent ice heater 430. In this embodiment, the mass (or volume) per unit height of water in the ice making cell 320*a* may be the same or different according to the shape of the ice making cell 320*a*. For example, when the ice making cell 320*a* is a rectangular parallelepiped, the mass (or volume) per unit height of water in the ice making cell 320*a* is the same. On the other hand, when the ice making cell 320*a* has a shape such as a sphere, an inverted triangle, a crescent moon, etc., the mass (or volume) per unit height of water is different.

When the cooling power of the cold air supply part 900 is constant, if the heating amount of the transparent ice heater 430 is the same, since the mass per unit height of water in the ice making cell 320*a* is different, an ice making rate per unit height may be different. For example, if the mass per unit height of water is small, the ice making rate is high, whereas if the mass per unit height of water is high, the ice making rate is slow. As a result, the ice making rate per unit height of water is not constant, and thus, the transparency of the ice may vary according to the unit height. In particular, when ice is made at a high rate, the bubbles may not move from the ice to the water, and the ice may contain the bubbles to lower the transparency. That is, the more the variation in ice making rate per unit height of water decreases, the more the variation in transparency per unit height of made ice may decrease.

Therefore, in this embodiment, the control part 800 may control the cooling power and/or the heating amount so that the cooling power of the cold air supply part 900 and/or the heating amount of the transparent ice heater 430 is variable according to the mass per unit height of the water of the ice making cell 320*a*.

In this specification, the variable of the cooling power of the cold air supply part 900 may include one or more of a variable output of the compressor, a variable output of the fan, and a variable opening degree of the refrigerant valve. Also, in this specification, the variation in the heating amount of the transparent ice heater 430 may represent varying the output of the transparent ice heater 430 or varying the duty of the transparent ice heater 430. In this case, the duty of the transparent ice heater 430 represents a ratio of the turn-on time and a sum of the turn-on time and the turn-off time of the transparent ice heater 430 in one cycle, or a ratio of the turn-off time and a sum of the turn-on time and the turn-off time of the transparent ice heater 430 in one cycle.

In this specification, a reference of the unit height of water in the ice making cell 320*a* may vary according to a relative position of the ice making cell 320*a* and the transparent ice heater 430. For example, as shown in FIG. 44(*a*), the transparent ice heater 430 at the bottom surface of the ice making cell 320*a* may be disposed to have the same height. In this case, a line connecting the transparent ice heater 430 is a horizontal line, and a line extending in a direction perpendicular to the horizontal line serves as a reference for the unit height of the water of the ice making cell 320*a*.

In the case of FIG. 44(*a*), ice is made from the uppermost side of the ice making cell 320*a* and then is grown. On the other hand, as shown in FIG. 44(*b*), the transparent ice heater 430 at the bottom surface of the ice making cell 320*a* may be disposed to have different heights. In this case, since heat is supplied to the ice making cell 320*a* at different heights of the ice making cell 320*a*, ice is made with a pattern different from that of FIG. 44(*a*). For example, in FIG. 44(*b*), ice may be made at a position spaced apart from the uppermost end to the left side of the ice making cell 320*a*, and the ice may be grown to a right lower side at which the transparent ice heater 430 is disposed.

Accordingly, in FIG. 44(*b*), a line (reference line) perpendicular to the line connecting two points of the transparent ice heater 430 serves as a reference for the unit height of water of the ice making cell 320*a*. The reference line of FIG. 44(*b*) is inclined at a predetermined angle from the vertical line.

FIG. 45 illustrates a unit height division of water and an output amount of transparent ice heater per unit height when the transparent ice heater is disposed as shown in FIG. 44(*a*).

Hereinafter, an example of controlling an output of the transparent ice heater so that the ice making rate is constant for each unit height of water will be described.

Referring to FIG. 45, when the ice making cell 320*a* is formed, for example, in a spherical shape, the mass per unit height of water in the ice making cell 320*a* increases from the upper side to the lower side to reach the maximum and then decreases again. For example, the water (or the ice making cell itself) in the spherical ice making cell 320*a* having a diameter of about 50 mm is divided into nine sections (section A to section I) by 6 mm height (unit height).

Here, it is noted that there is no limitation on the size of the unit height and the number of divided sections.

When the water in the ice making cell 320*a* is divided into unit heights, the height of each section to be divided is equal to the section A to the section H, and the section I is lower than the remaining sections. Alternatively, the unit heights of all divided sections may be the same depending on the diameter of the ice making cell 320*a* and the number of divided sections. Among the many sections, the section E is a section in which the mass of unit height of water is maximum. For example, in the section in which the mass per unit height of water is maximum, when the ice making cell 320*a* has spherical shape, a diameter of the ice making cell 320*a*, a horizontal cross-sectional area of the ice making cell 320*a*, or a circumference of the ice may be maximum.

As described above, when assuming that the cooling power of the cold air supply part 900 is constant, and the output of the transparent ice heater 430 is constant, the ice making rate in section E is the lowest, the ice making rate in the sections A and I is the fastest.

In this case, since the ice making rate varies for the height, the transparency of the ice may vary for the height. In a specific section, the ice making rate may be too fast to contain bubbles, thereby lowering the transparency. Therefore, in this embodiment, the output of the transparent ice heater 430 may be controlled so that the ice making rate for each unit height is the same or similar while the bubbles move from the portion at which ice is made to the water in the ice making process.

Specifically, since the mass of the section E is the largest, the output W5 of the transparent ice heater 430 in the section E may be set to a minimum value. Since the volume of the section D is less than that of the section E, the volume of the ice may be reduced as the volume decreases, and thus it is necessary to delay the ice making rate. Thus, an output W6 of the transparent ice heater 430 in the section D may be set to a value greater than an output W5 of the transparent ice heater 430 in the section E.

Since the volume in the section C is less than that in the section D by the same reason, an output W3 of the transparent ice heater 430 in the section C may be set to a value greater than the output W4 of the transparent ice heater 430 in the section D. Since the volume in the section B is less than that in the section C, an output W2 of the transparent ice heater 430 in the section B may be set to a value greater than the output W3 of the transparent ice heater 430 in the section C. Since the volume in the section A is less than that in the section B, an output W1 of the transparent ice heater 430 in the section A may be set to a value greater than the output W2 of the transparent ice heater 430 in the section B.

For the same reason, since the mass per unit height decreases toward the lower side in the section E, the output of the transparent ice heater 430 may increase as the lower side in the section E (see W6, W7, W8, and W9). Thus, according to an output variation pattern of the transparent ice heater 430, the output of the transparent ice heater 430 is gradually reduced from the first section to the intermediate section after the transparent ice heater 430 is initially turned on.

The output of the transparent ice heater 430 may be minimum in the intermediate section in which the mass of unit height of water is minimum. The output of the transparent ice heater 430 may again increase step by step from the next section of the intermediate section.

The output of the transparent ice heater 430 in two adjacent sections may be set to be the same according to the type or mass of the made ice. For example, the output of section C and section D may be the same. That is, the output of the transparent ice heater 430 may be the same in at least two sections.

Alternatively, the output of the transparent ice heater 430 may be set to the minimum in sections other than the section in which the mass per unit height is the smallest. For example, the output of the transparent ice heater 430 in the section D or the section F may be minimum. The output of the transparent ice heater 430 in the section E may be equal to or greater than the minimum output.

In summary, in this embodiment, the output of the transparent ice heater 430 may have a maximum initial output. In the ice making process, the output of the transparent ice heater 430 may be reduced to the minimum output of the transparent ice heater 430.

The output of the transparent ice heater 430 may be gradually reduced in each section, or the output may be maintained in at least two sections. The output of the transparent ice heater 430 may increase from the minimum output to the end output. The end output may be the same as or different from the initial output. In addition, the output of the transparent ice heater 430 may incrementally increase in each section from the minimum output to the end output, or the output may be maintained in at least two sections.

Alternatively, the output of the transparent ice heater 430 may be an end output in a section before the last section among a plurality of sections. In this case, the output of the transparent ice heater 430 may be maintained as an end output in the last section. That is, after the output of the transparent ice heater 430 becomes the end output, the end output may be maintained until the last section.

As the ice making is performed, an amount of ice existing in the ice making cell 320*a* may decrease. Thus, when the transparent ice heater 430 continues to increase until the output reaches the last section, the heat supplied to the ice making cell 320*a* may be reduced. As a result, excessive water may exist in the ice making cell 320*a* even after the end of the last section. Therefore, the output of the transparent ice heater 430 may be maintained as the end output in at least two sections including the last section.

The transparency of the ice may be uniform for each unit height, and the bubbles may be collected in the lowermost section by the output control of the transparent ice heater 430. Thus, when viewed on the ice as a whole, the bubbles may be collected in the localized portion, and the remaining portion may become totally transparent.

As described above, even if the ice making cell 320*a* does not have the spherical shape, the transparent ice may be made when the output of the transparent ice heater 430 varies according to the mass for each unit height of water in the ice making cell 320*a*.

The heating amount of the transparent ice heater 430 when the mass for each unit height of water is large may be less than that of the transparent ice heater 430 when the mass for each unit height of water is small. For example, while maintaining the same cooling power of the cold air supply part 900, the heating amount of the transparent ice heater 430 may vary so as to be inversely proportional to the mass per unit height of water. Also, it is possible to make the transparent ice by varying the cooling power of the cold air supply part 900 according to the mass per unit height of water. For example, when the mass per unit height of water is large, the cold force of the cold air supply part 900 may increase, and when the mass per unit height is small, the cold force of the cold air supply part 900 may decrease. For example, while maintaining a constant heating amount of the transparent ice heater 430, the cooling power of the cold air supply part 900 may vary to be proportional to the mass per unit height of water.

Referring to the variable cooling power pattern of the cold air supply part 900 in the case of making the spherical ice, the cooling power of the cold air supply part 900 from the initial section to the intermediate section during the ice making process may increase.

The cooling power of the cold air supply part 900 may be maximum in the intermediate section in which the mass for each unit height of water is minimum. The cooling power of the cold air supply part 900 may be reduced again from the next section of the intermediate section. Alternatively, the transparent ice may be made by varying the cooling power of the cold air supply part 900 and the heating amount of the transparent ice heater 430 according to the mass for each unit height of water. For example, the heating power of the transparent ice heater 430 may vary so that the cooling power of the cold air supply part 900 is proportional to the mass per unit height of water and inversely proportional to the mass for each unit height of water.

According to this embodiment, when one or more of the cooling power of the cold air supply part 900 and the heating amount of the transparent ice heater 430 are controlled according to the mass per unit height of water, the ice making rate per unit height of water may be substantially the same or may be maintained within a predetermined range.

As illustrated in FIG. 49, a pressing part 382*f* may be deformed in a direction away from the center of the ice making cell 320*a* by being pressed by the ice. The lower portion of the ice may have the spherical shape by the deformation of the pressing part 382*f*.

The controller 800 may determine whether the ice making is completed based on the temperature sensed by the second temperature sensor 700 (S8). When it is determined that the ice making is completed, the controller 800 may turn off the transparent ice heater 430 (S9). For example, when the temperature sensed by the second temperature sensor 700 reaches a first reference temperature, the controller 800 may determine that the ice making is completed to turn off the transparent ice heater 430.

In this case, since a distance between the second temperature sensor 700 and each ice making cell 320*a* is different, in order to determine that the ice making is completed in all the ice making cells 320*a*, the controller 800 may perform the ice separation after a certain amount of time, at which it is determined that ice making is completed, has passed or when the temperature sensed by the second temperature sensor 700 reaches a second reference temperature lower than the first reference temperature.

When the ice making is completed, the controller 800 operates one or more of the ice separation heater 290 and the transparent ice heater 430 (S10).

When at least one of the ice separation heater 290 or the transparent ice heater 430 is turned on, heat of the heater is transferred to at least one of the first tray 320 or the second tray 380 so that the ice may be separated from the surfaces (inner surfaces) of one or more of the first tray 320 and the second tray 380. Also, the heat of the heaters 290 and 430 is transferred to the contact surface of the first tray 320 and the second tray 380, and thus, the first contact surface 322*c* of the first tray 320 and the second contact surface 382*c* of the second tray 380 may be in a state capable of being separated from each other.

When at least one of the ice separation heater 290 and the transparent ice heater 430 operate for a predetermined time, or when the temperature sensed by the second temperature sensor 700 is equal to or higher than an off reference temperature, the controller 800 is turned off the heaters 290 and 430, which are turned on (S10). Although not limited, the turn-off reference temperature may be set to above zero temperature.

The controller 800 operates the driver 480 to allow the second tray assembly 211 to move in the forward direction (S11).

As illustrated in FIG. 50, when the second tray 380 move in the forward direction, the second tray 380 is spaced apart from the first tray 320. The moving force of the second tray 380 is transmitted to the first pusher 260 by the pusher link 500. Then, the first pusher 260 descends along the guide slot 302, and the pushing bar 264 passes through the opening 324 to press the ice in the ice making cell 320*a*. In this embodiment, ice may be separated from the first tray 320 before the pushing bar 264 presses the ice in the ice making process. That is, ice may be separated from the surface of the first tray 320 by the heater that is turned on. In this case, the ice may move together with the second tray 380 while the ice is supported by the second tray 380. For another example, even when the heat of the heater is applied to the first tray 320, the ice may not be separated from the surface of the first tray 320. Therefore, when the second tray assembly 211 moves in the forward direction, there is possibility that the ice is separated from the second tray 380 in a state in which the ice contacts the first tray 320.

In this state, in the process of moving the second tray 380, the pushing bar 264 passing through the opening 324 may press the ice contacting the first tray 320, and thus, the ice may be separated from the tray 320. The ice separated from the first tray 320 may be supported by the second tray 380 again.

When the ice moves together with the second tray 380 while the ice is supported by the second tray 380, the ice may be separated from the second tray 380 by its own weight even if no external force is applied to the second tray 380.

While the second tray 380 moves, even if the ice does not fall from the second tray 380 by its own weight, when the second pusher 540 contacts the second tray 540 as illustrated in FIGS. 50 and 51 to press the second tray 380, the ice may be separated from the second tray 380 to fall downward.

For example, as illustrated in FIG. 50, while the second tray assembly 311 moves in the forward direction, the second tray 380 may contact the pushing bar 544 of the second pusher 540. As illustrated in FIG. 50, when the second tray 380 contacts the second pusher 540, the first tray assembly 201 and the second tray assembly 211 form a second angle θ2 therebetween with respect to the rotation center C4. That is, the first contact surface 322*c* of the first tray 320 and the second contact surface 382*c* of the second tray 380 form a second angle therebetween. The second angle may be greater than the first angle and may be close to about 90 degrees.

When the second tray assembly 211 continuously moves in the forward direction, the pushing bar 544 may press the second tray 380 to deform the second tray 380. Thus, the pressing force of the pushing bar 544 may be transferred to the ice so that the ice is separated from the surface of the second tray 380. The ice separated from the surface of the second tray 380 may drop downward and be stored in the ice bin 600.

In this embodiment, as shown in FIG. 51, the position at which the second tray 380 is pressed by the second pusher 540 and deformed may be referred to as an ice separation position. As illustrated in FIG. 51, at the ice separation position of the second tray assembly 211, the first tray assembly 201 and the second tray assembly 211 may form a third angle θ3 based on the rotation center C4. That is, the first contact surface 322*c* of the first tray 320 and the second contact surface 382*c* of the second tray 380 form the third angle θ3. The third angle θ3 is greater than the second angle θ2. For example, the third angle θ3 is greater than about 90 degrees and less than about 180 degrees.

At the ice separation position, a distance between a first edge 544*a* of the second pusher 540 and a second contact surface 382*c* of the second tray 380 may be less than that between the first edge 544*a* of the second pusher 540 and the lower opening 406*b* of the second tray supporter 400 so that the pressing force of the second pusher 540 increases.

An attachment degree between the first tray 320 and the ice is greater than that between the second tray 380 and the ice. Thus, a minimum distance between the first edge 264*a* of the first pusher 260 and the first contact surface 322*c* of the first tray 320 at the ice separation position may be greater than a minimum distance between the first edge 544*a* of the second pusher 540 and the second contact surface 382*c* of the second tray 380.

At the ice separation position, a distance between the first edge 264*a* of the first pusher 260 and the line passing through the first contact surface 322*c* of the first tray 320 may be greater than 0 and may be less than about ½ of a radius of the ice making cell 320*a*. Accordingly, since the first edge 264*a* of the first pusher 260 moves to a position close to the first contact surface 322*c* of the first tray 320, the ice is easily separated from the first tray 320.

Whether the ice bin 600 is full may be detected while the second tray assembly 211 moves from the ice making position to the ice separation position. For example, the full ice detection lever 520 rotates together with the second tray assembly 211, and the rotation of the full ice detection lever 520 is interrupted by ice while the full ice detection lever 520 rotates. In this case, it may be determined that the ice bin 600 is in a full ice state. On the other hand, if the rotation of the full ice detection lever 520 is not interfered with the ice while the full ice detection lever 520 rotates, it may be determined that the ice bin 600 is not in the ice state.

After the ice is separated from the second tray 380, the controller 800 controls the driver 480 to allow the second tray assembly 211 to move in the reverse direction (S11). Then, the second tray assembly 211 moves from the ice separation position to the water supply position. When the second tray assembly 211 moves to the water supply position of FIG. 46, the controller 800 stops the driver 480 (S1).

When the second tray 380 is spaced apart from the pushing bar 544 while the second tray assembly 211 moves in the reverse direction, the deformed second tray 380 may be restored to its original shape.

In the reverse movement of the second tray assembly 211, the moving force of the second tray 380 is transmitted to the first pusher 260 by the pusher link 500, and thus, the first pusher 260 ascends, and the pushing bar 264 is removed from the ice making cell 320*a*.

FIG. 52 is a view illustrating an operation of the pusher link when the second tray assembly moves from the ice making position to the ice separation position. FIG. 52(*a*) illustrates the ice making position, FIG. 52(*b*) illustrates the water supply position, FIG. 52(*c*) illustrates the position at which the second tray contacts the second pusher, and FIG. 52(*d*) illustrates the ice separation position.

Figure 53:
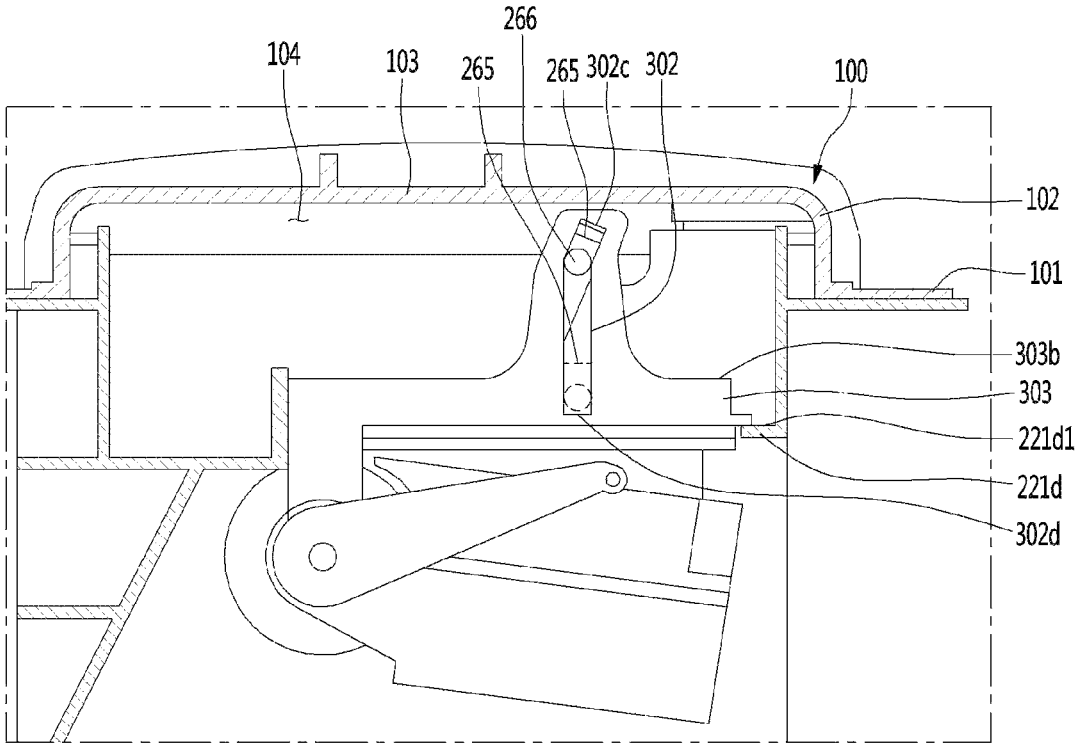
FIG. 53 is a view illustrating a position of a first pusher at a water supply position at which the ice maker is installed in a refrigerator.
Figure 54:
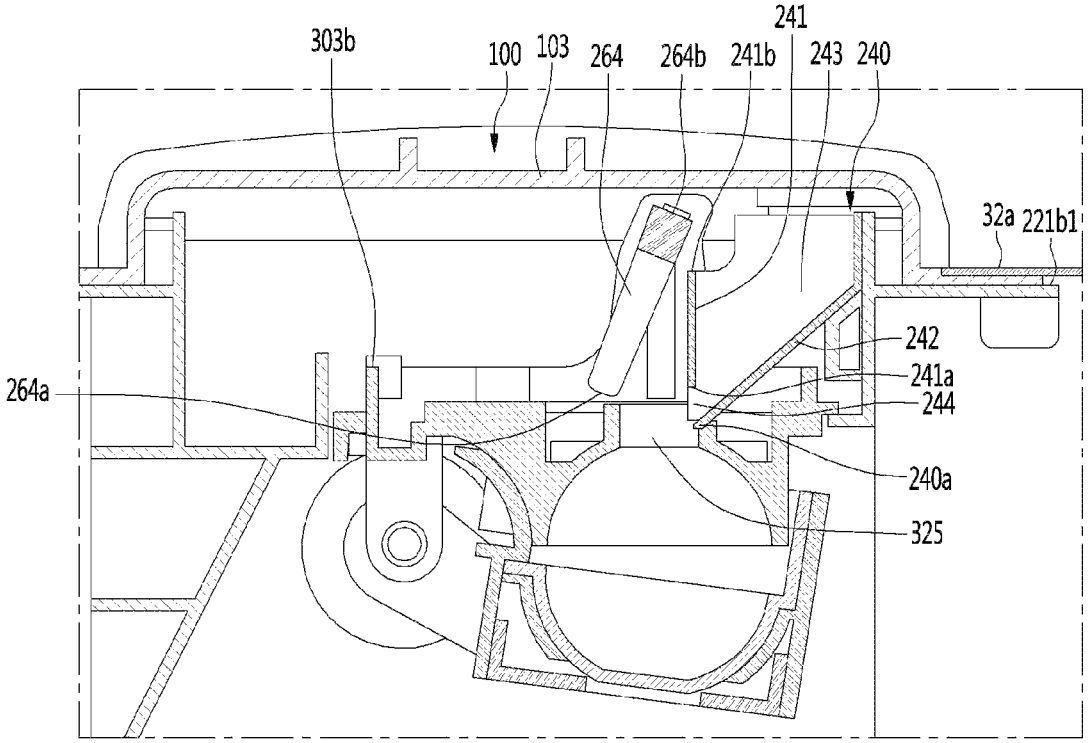
FIG. 54 is a cross-sectional view illustrating the position of the first pusher at the water supply position at which the ice maker is installed in the refrigerator.
Figure 55:
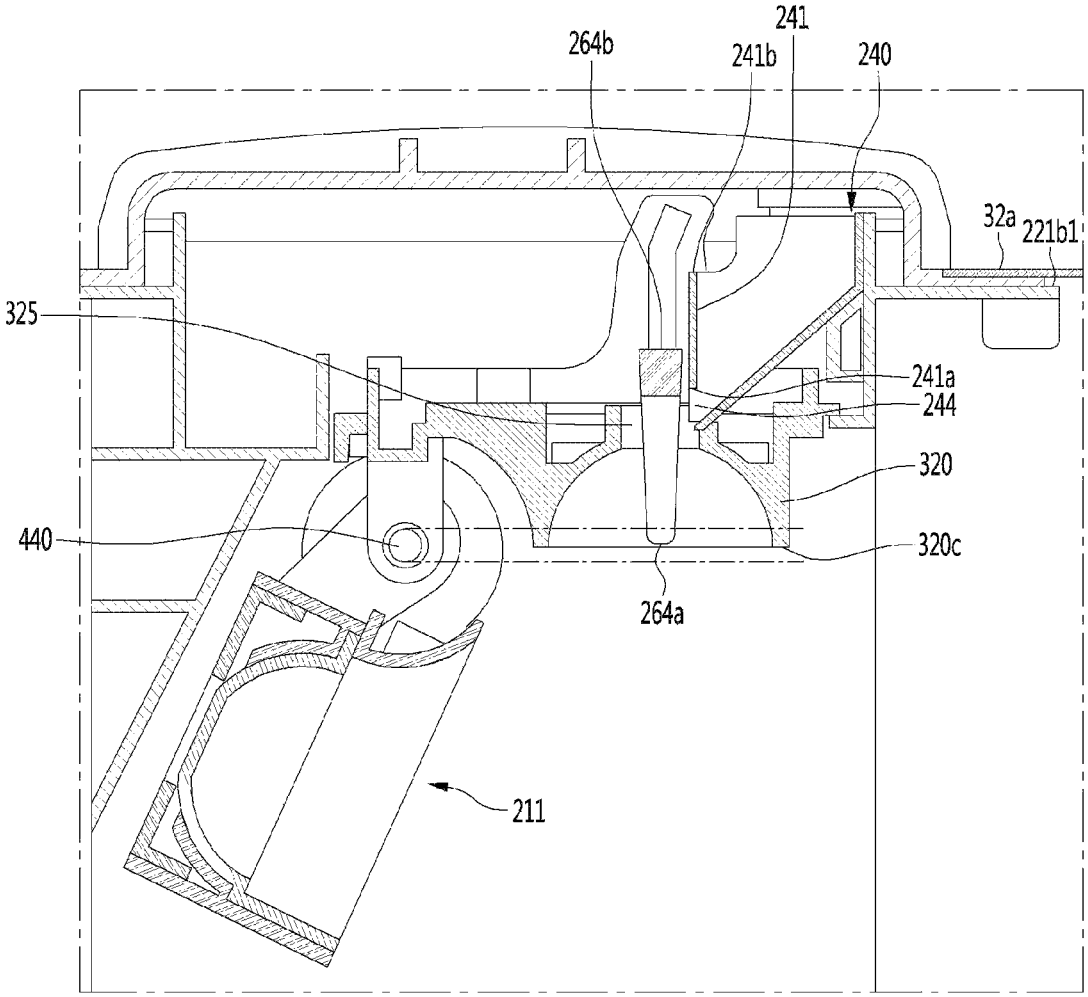
FIG. 55 is a cross-sectional view illustrating a position of the first pusher at the ice separation position at which the ice maker is installed in the refrigerator.

FIG. 53 is a view illustrating a position of the first pusher at the water supply position at which the ice maker is installed in the refrigerator, FIG. 54 is a cross-sectional view illustrating the position of the first pusher at the water supply position at which the ice maker is installed in the refrigerator, and FIG. 55 is a cross-sectional view illustrating a position of the first pusher at the ice separation position at which the ice maker is installed in the refrigerator.

Referring to FIGS. 52 to 55, the pushing bar 264 of the first pusher 260 may include the first edge 264*a* and the second edge 264*b* as described above. The first pusher 260 may move by receiving power from the driver 480.

The controller 800 may control the first edge 264*a* so as to be disposed at a different position from the ice making position so that a phenomenon in which water supplied into the ice making cell 320*a* at the water supply position is attached to the first pusher 260 and then frozen in the ice making process is reduced.

In this specification, the control of the position by the controller 800 may be understood as controlling the position by controlling the driver 480.

The controller 800 may control the position so that the first edge 264*a* is disposed at different positions at the water supply position, the ice making position, and the ice separation position.

The controller 800 control the first edge 264*a* to allow the first edge 264*a* to move in the first direction in the process of moving from the ice separation position to the water supply position and to allow the first edge 264*a* to additionally move in the first direction in the process of moving from the water supply position to the ice making position. Alternatively, the controller 800 controls the first edge 264*a* to allow the first edge 264*a* to move in the first direction in the process of moving from the ice separation position to the water supply position and allow the first edge to move in a second direction different from the first direction in the process of moving from the water supply position to the ice making position.

For example, the first edge 264*a* may move in the first direction by the first slot 302*a* of the guide slot 302, and the second edge 264*a* may rotate in a second direction or move in a second direction inclined with the first direction by the second slot 302*b*. The first edge 264*a* may be disposed at a first point outside the ice making cell 320*a* at the ice making position and may be controlled to be disposed at a second point of the ice making cell 320*a* during the ice separation process.

The refrigerator further includes a cover member 100 including a first portion 101 defining a support surface supporting the bracket 220 and a third portion 103 defining the accommodation space 104. A wall 32*a* defining the freezing compartment 32 may be supported on a top surface of the first portion 101. The first portion 101 and the third portion 103 may be spaced a predetermined distance from each other and may be connected by the second portion 102. The second portion 102 and the third portion 103 may define the accommodation space 104 accommodating at least a portion of the ice maker 200. At least a portion of the guide slot 302 may be defined in the accommodation space 104. For example, the upper end 302*c* of the guide slot 302 may be disposed in the accommodation space 104. The lower end 302*d* of the guide slot 302 may be disposed outside the accommodation space 104. The lower end 302*d* of the guide slot 302 may be higher than the support wall 221*d* of the bracket 220 and be lower than the upper surface 303*b* of the circumferential wall 303 of the first tray cover 300. Accordingly, a length of the guide slot 302 may increase without increasing the height of the ice maker 200.

The water supply part 240 may be coupled to the bracket 220. The water supply part 240 may include a first portion 241, a second portion 242 disposed to be inclined with respect to the first portion 241, and a third portion extending from both sides of the first portion 241. The through-hole 244 may be defined in the first portion 241. Alternatively, the through-hole 244 may be defined between the first portion 241 and the second portion 242. The water supplied to the water supply part 240 may flow downward along the second portion 242 and then be discharged from the water supply part 240 through the through-hole 244. The water discharged from the water supply part 244 may be supplied to the ice making cell 320*a* through the auxiliary storage chamber 325 and the opening 324 of the first tray 320. The through-hole 244 may be defined in a direction in which the water supply part 240 faces the ice making cell 320*a*. The lowermost end 240*a* of the water supply part 240 may be disposed lower than an upper end of the auxiliary storage chamber 325. The lowermost end 240*a* of the water supply part 240 may be disposed in the auxiliary storage chamber 325.

The controller 800 may control a position of the first edge 264*a* so that the first edge moves in the direction away from the through-hole 244 of the water supply unit 240 in the process of allowing the second tray assembly 211 to move from the ice separation position to the water supply position. For example, the first edge 264*a* may rotate in a direction away from the through-hole 244. When the first edge 264*a* moves away from the through-hole 244, the contact of the water with the first edge 264*a* in the water supply process may be reduced, and thus, the freezing of the water at the first edge 264*a* is reduced.

In the process of allowing the second tray assembly 211 to move from the water supply position to the ice making position, the second edge 264*b* may further move in the second direction.

At the water supply position, the first edge 264*a* may be disposed outside the ice making cell 320*a*. At the water supply position, the first edge 264*a* may be disposed outside the auxiliary storage chamber 325. At the water supply position, the first edge 264*a* may be disposed higher than the lower end of the through-hole 244. At the water supply position, a maximum value of a distance between the center line C1 of the ice making cell 320*a* and the first edge 264*a* may be greater than that of a distance between the center line C1 of the ice making cell 320*a* and the storage wall 325*a*. At the water supply position, the first edge 264*a* may be disposed higher than the upper end 325*c* of the auxiliary storage chamber 325 and be disposed lower than the upper end 325*b* of the circumferential wall 303 of the first tray cover 300. In this case, the first edge 264*a* may be disposed close to the ice making cell 320*a* to allow the first edge 264*a* to press the ice at the initial ice separation process, thereby improving the ice separation performance.

At the ice separation position, a length of the first pusher 260 inserted into the ice making cell 320*a* may be longer than that of the second pusher 540 inserted into the second tray supporter 400. At the ice separation position, the first edge 264*a* may be disposed on an area (the area between the two dotted lines in FIG. 55) between parallel lines extending in the direction of the first contact surface 322*c* by passing through the highest and lowest points of the shaft 440. Alternatively, at the ice separation position, the first edge 264*a* may be disposed on an extension line extending from the first contact surface 322*c*.

At the water supply position, the second edge 264*b* may be disposed lower than the third portion 103 of the cover member 100. At the water supply position, the second edge 264*b* may be disposed higher than an upper end 241*b* of the first portion 241 of the water supply 240. At the water supply position, the second edge 264*b* may be higher than a top surface 221*b*1 of the first fixing wall 221*b* of the bracket 220.

The controller 800 may control a position of the second edge 264*b* to be closer to the water supply 240 than the first edge 264*a* at the water supply position. At the water supply position, the second edge 264*b* may be disposed between the first portion 101 of the cover member 100 and the third portion 103 of the cover member 100. For example, the second edge 264*b* at the water supply position may be disposed in the accommodation space 104. Accordingly, since a portion of the ice maker 200 is disposed in the accommodation space 104, the space accommodating food in the freezing compartment 32 may be reduced by the ice maker 200, and the first pusher 260 may increase in moving length. When the moving length of the first pusher 260 increase, the pressing force pressing the ice by the first pusher 260 may increase during the ice making process.

At the ice separation position, the second edge 264*b* may be disposed outside the accommodation space 104. At the ice separation position, the second edge 264*b* may be disposed between the support surface 221*d*1 supporting the first tray assembly 201 in the bracket 220 and the first portion of the cover member 100. At the ice separation position, the second edge 264*b* may be lower than the top surface 221*b*1 of the first fixing wall 221*b* of the bracket 220. At the ice separation position, the second edge 264*b* may be disposed outside the ice making cell 320*a*. At the ice separation position, the second edge 264*b* may be disposed outside the auxiliary storage chamber 325.

At the ice separation position, the second edge 264*b* may be disposed higher than the support surface 221*d*1 of the support wall 221*d*. At the ice separation position, the second edge 264*b* may be higher than the through hole 244 of the water supply 240. At the ice separation position, the second edge 264*b* may be disposed higher than the lower end 241*a* of the first portion 241 of the water supply 240.

The first portion 241 of the water supply part 240 may extend in the vertical direction as a whole or may partially extend in the vertical direction, and the other portion of the first portion 241 may extend in a direction away from the first pusher 260. Alternatively, the first portion 241 of the water supply unit 240 may be provided to be farther from the first pusher 260 from the lower end 241*a* to the upper end 241*b*. A distance between the second edge 264*b* and the first portion 241 of the water supply 240 at the water supply position may be greater than that between the second edge 264*b* and the first portion 241 of the water supply part 240 at the ice making position. A distance between the second edge 264*b* and the portion at which the first portion 241 of the water supply 240 faces the first pusher 260 at the water supply position may be greater than that between the second edge 264*b* and the portion at which the first portion 241 of the water supply part 240 faces the first pusher 260 at the ice separation position.

Figure 56:
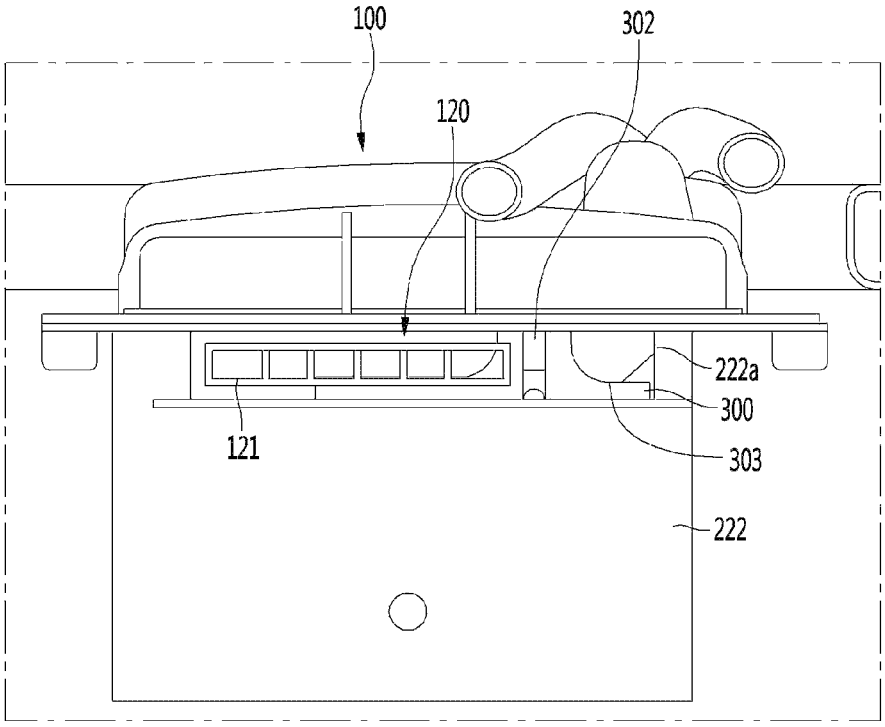
FIG. 56 is a view illustrating a position relationship between a through-hole of the bracket and a cold air duct.

FIG. 56 is a view illustrating a position relationship between the through-hole of the bracket and a cold air duct.

Referring to FIG. 56, the refrigerator may further include a cold air duct 120 (or a cold air supply part) guiding cold air of the cold air supply unit 900.

An outlet 121 of the cold air duct 120 may be aligned with the through-hole 222*a* of the bracket 220.

A through-hole may be formed in a wall defining the freezing compartment 32, and the outlet 121 of the cold air duct 120 may be the through-hole. Alternatively, a through-hole may be formed in a wall defining the freezing compartment 32, and the outlet 121 may be aligned with the through-hole. The outlet 121 of the cold air duct 120 may be located at a position higher than the through-hole 221*a* of the first wall 221.

The outlet 121 of the cold air duct 120 may be disposed so as not to face at least the guide slot 302. When the cold air flows directly into the guide slot 302, freezing may occur in the guide slot 302 so that the first pusher 260 does not move smoothly. At least a portion of the outlet 121 of the cold air duct 120 may be disposed higher than an upper end of the circumferential wall 303 of the first tray cover 300. For example, the outlet 121 of the cold air duct 120 may be disposed higher than the opening 324 of the first tray 320. Therefore, the cold air may flow toward the opening 324 from the upper side of the ice making cell 320*a*. An area of the outlet 121 of the cold air duct 120, which does not overlap the first tray cover 300, is larger than that that overlaps the first tray cover 300. Therefore, the cold air may flow to the upper side of the ice making cell 320*a* without interfering with the first tray cover 300 to cool water or ice of the ice making cell 320*a*.

That is, the cold air supply part 900 (or cooler) is disposed so that an amount of cold air (or cold) supplied to the first tray assembly is greater than that of cold air supplied to the second tray assembly in which the transparent ice heater 430 is disposed.

Also, the cold air supply part 900 (or cooler) may be disposed so that more amount of cold air (or cold) may be supplied to the area of the first cell 321*a*, which is farther from the transparent ice heater, than the area of the first cell 321*a*, which is close to the transparent ice heater 430. For example, a distance between the cooler and the area of the first cell 321*a*, which is close to the transparent ice heater 430 is greater than that between the cooler and the area of the first cell 321*a*, which is far from the transparent ice heater 430. A distance between the cooler and the second cell 381*a* may be greater than that between the cooler and the first cell 321*a*.

Figure 57:
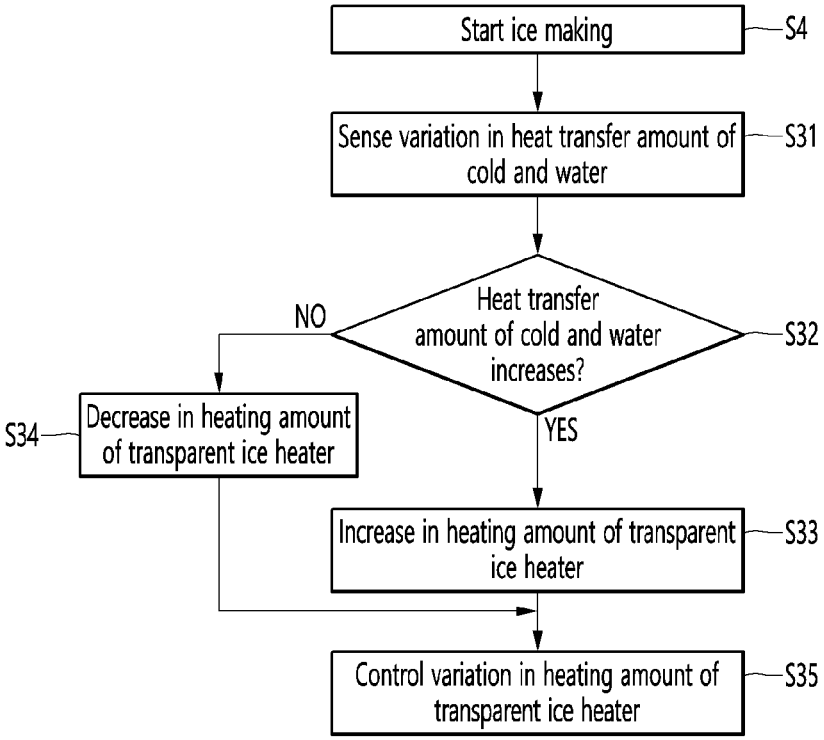
FIG. 57 is a view for explaining a method for controlling a refrigerator when a heat transfer amount between cold air and water vary in an ice making process.

FIG. 57 is a view for explaining a method for controlling the refrigerator when a heat transfer amount between cold air and water vary in the ice making process.

Referring to FIGS. 42 and 57, cooling power of the cold air supply part 900 may be determined corresponding to the target temperature of the freezing compartment 32. The cold air generated by the cold air supply part 900 may be supplied to the freezing chamber 32. The water of the ice making cell 320*a* may be phase-changed into ice by heat transfer between the cold water supplied to the freezing chamber 32 and the water of the ice making cell 320*a*.

In this embodiment, a heating amount of the transparent ice heater 430 for each unit height of water may be determined in consideration of predetermined cooling power of the cold air supply part 900.

In this embodiment, the heating amount of the transparent ice heater 430 determined in consideration of the predetermined cooling power of the cold air supply part 900 is referred to as a reference heating amount. The magnitude of the reference heating amount per unit height of water is different. However, when the amount of heat transfer between the cold of the freezing compartment 32 and the water in the ice making cell 320*a* is variable, if the heating amount of the transparent ice heater 430 is not adjusted to reflect this, the transparency of ice for each unit height varies.

In this embodiment, the case in which the heat transfer amount between the cold and the water increase may be a case in which the cooling power of the cold air supply part 900 increases or a case in which the air having a temperature lower than the temperature of the cold air in the freezing compartment 32 is supplied to the freezing compartment 32.

On the other hand, the case in which the heat transfer amount between the cold and the water decrease may be a case in which the cooling power of the cold air supply part 900 decreases or a case in which the air having a temperature higher than the temperature of the cold air in the freezing compartment 32 is supplied to the freezing compartment 32.

For example, a target temperature of the freezing compartment 32 is lowered, an operation mode of the freezing compartment 32 is changed from a normal mode to a rapid cooling mode, an output of at least one of the compressor or the fan increases, or an opening degree increases, the cooling power of the cold air supply part 900 may increase.

On the other hand, the target temperature of the freezer compartment 32 increases, the operation mode of the freezing compartment 32 is changed from the rapid cooling mode to the normal mode, the output of at least one of the compressor or the fan decreases, or the opening degree of the refrigerant valve decreases, the cooling power of the cold air supply part 900 may decrease.

When the cooling power of the cold air supply part 900 increases, the temperature of the cold air around the ice maker 200 is lowered to increase in ice making rate. On the other hand, if the cooling power of the cold air supply part 900 decreases, the temperature of the cold air around the ice maker 200 increases, the ice making rate decreases, and also, the ice making time increases.

Therefore, in this embodiment, when the amount of heat transfer of cold and water increases so that the ice making rate is maintained within a predetermined range lower than the ice making rate when the ice making is performed with the transparent ice heater 430 that is turned off, the heating amount of transparent ice heater 430 may be controlled to increase.

On the other hand, when the amount of heat transfer between the cold and the water decreases, the heating amount of transparent ice heater 430 may be controlled to decrease.

In this embodiment, when the ice making rate is maintained within the predetermined range, the ice making rate is less than the rate at which the bubbles move in the portion at which the ice is made, and no bubbles exist in the portion at which the ice is made.

When the cooling power of the cold air supply part 900 increases, the heating amount of transparent ice heater 430 may increase. On the other hand, when the cooling power of the cold air supply part 900 decreases, the heating amount of transparent ice heater 430 may decrease.

Hereinafter, the case in which the target temperature of the freezing compartment 32 varies will be described with an example.

The controller 800 may control the output of the transparent ice heater 430 so that the ice making rate may be maintained within the predetermined range regardless of the target temperature of the freezing compartment 32.

For example, the ice making may be started (S4), and a change in heat transfer amount of cold and water may be detected (S31). For example, it may be sensed that the target temperature of the freezing compartment 32 is changed through an input part (not shown).

The controller 800 may determine whether the heat transfer amount of cold and water increases (S32). For example, the controller 800 may determine whether the target temperature increases.

As the result of the determination in the process (S32), when the target temperature increases, the controller 800 may decrease the reference heating amount of transparent ice heater 430 that is predetermined in each of the current section and the remaining sections. The variable control of the heating amount of the transparent ice heater 430 may be normally performed until the ice making is completed (S35). On the other hand, if the target temperature decreases, the controller 800 may increase the reference heating amount of transparent ice heater 430 that is predetermined in each of the current section and the remaining sections. The variable control of the heating amount of the transparent ice heater 430 may be normally performed until the ice making is completed (S35).

In this embodiment, the reference heating mount that increases or decreases may be predetermined and then stored in a memory. According to this embodiment, the reference heating amount for each section of the transparent ice heater increases or decreases in response to the change in the heat transfer amount of cold and water, and thus, the ice making rate may be maintained within the predetermined range, thereby realizing the uniform transparency for each unit height of the ice.

What is claimed is:

1. A refrigerator comprising:

an ice maker comprising:

a first tray assembly having a portion of a cell;

a second tray assembly having another portion of the cell, the portion and the another portion of the cell being configured to define a space of the cell to receive a liquid to be phase-changed to form ice;

a liquid supply configured to supply the liquid to the cell; and a bracket having a wall defining at least one portion of a space that accommodates the first tray assembly and the second tray assembly, wherein the second tray assembly is connected to a driver to contact the first tray assembly during an ice making process and to be spaced apart from the first tray assembly during an ice separation process, wherein the first tray assembly includes:

a first tray to define the portion of the cell, the first tray including a wall defining the portion of the cell and a deformation resistance reinforcement wall extending from the wall of the first tray; and a first tray case being a separate component from the first tray and configured to surround the first tray, wherein the first tray case includes a portion contacting the deformation resistance reinforcement wall of the first tray, and wherein the first tray case is a separate component from the bracket, and is coupled to the bracket.

2. The refrigerator of claim 1, wherein the bracket is configured to support the deformation resistance reinforcement wall of the first tray.

3. The refrigerator of claim 1, wherein the deformation resistance reinforcement wall of the first tray is connected to the first tray case and supported by the bracket.

4. The refrigerator of claim 1, further comprising a pusher including a first edge having a surface for pressing the ice or at least one surface of the second tray assembly such that the ice is easily separated from the second tray assembly, wherein the pusher is connected to the bracket.

5. A refrigerator comprising:

an ice maker comprising:

a first tray assembly having a portion of a cell;

a second tray assembly having another portion of the cell, the portion and the another portion of the cell being configured to define a space of the cell to receive a liquid to be phase-changed to form ice;

a liquid supply configured to supply the liquid to the cell; and a bracket having a wall defining at least one portion of a space that accommodates the first tray assembly and the second tray assembly, wherein the second tray assembly is connected to a driver to contact the first tray assembly during an ice making process and to be spaced apart from the first tray assembly during an ice separation process, wherein the first tray assembly includes:

a first portion defining at least a portion of the cell and a second portion extending outward from the first portion, the second portion being a deformation resistance reinforcement wall, and wherein the bracket includes a surface that supports the deformation resistance reinforcement wall of the first tray assembly.

6. The refrigerator of claim 5, wherein the first tray assembly includes a first tray and a first tray case configured to surround the first tray.

7. The refrigerator of claim 5, further comprising:

a first pusher including a pushing bar; and a cover, wherein the pushing bar includes:

a first edge having a surface for pressing the ice or the first tray assembly in the ice separation process; and a second edge disposed in opposite to the first edge of the pushing bar, wherein the cover includes:

a first wall having a surface that supports the bracket;

a third wall spaced apart from the first wall of the cover; and a second wall connecting the first wall of the cover and the third wall of the cover, and wherein the second wall of the cover and the third wall of the cover defines an accommodation space where the second edge of the pushing bar is disposed at a liquid supply position.

8. The refrigerator of claim 5, further comprising a second pusher including a first edge having a surface for pressing the ice or at least one surface of the second tray assembly such that the ice is easily separated from the second tray assembly, wherein the second pusher is connected to the bracket.

9. An ice maker comprising:

a first tray assembly having a portion of a cell;

a second tray assembly having another portion of the cell, the portion and the another portion of the cell being configured to define a space of the cell to receive a liquid to be phase-changed to form ice;

a bracket having a wall defining at least one portion of a space that accommodates the first tray assembly and the second tray assembly; and a heater disposed adjacent to at least one of the first tray assembly or the second tray assembly, wherein the first tray assembly includes:

a first tray; and a first tray case being a separate component from the bracket and coupled to the bracket.

10. The ice maker of claim 9, wherein the second tray assembly is connected to a driver to contact the first tray assembly during an ice making process and to be spaced apart from the first tray assembly during an ice separation process.

11. The ice maker of claim 10, wherein the first tray includes a wall defining the portion of the cell and a deformation resistance reinforcement wall extending from the wall of the first tray; and the first tray case is a separate component from the first tray and is configured to surround the first tray.

12. The ice maker of claim 11, wherein the first tray case includes a portion contacting the deformation resistance reinforcement wall of the first tray.

13. The ice maker of claim 2, further comprising a second pusher including a first edge having a surface for pressing the ice or at least one surface of the second tray assembly such that the ice is easily separated from the second tray assembly, wherein the second pusher is connected to the bracket.

14. The ice maker of claim 2, wherein the heater includes an ice separation heater disposed at a position adjacent to the first tray assembly and the ice separation heater being installed in the first tray case.

15. The ice maker of claim 9, wherein the heater includes an ice separation heater disposed at a position adjacent to the first tray assembly.

16. The ice maker of claim 15, wherein the first tray includes a wall defining the portion of the cell and a deformation resistance reinforcement wall extending from the wall of the first tray; and the first tray case is a separate component from the first tray and is configured to surround the first tray, the ice separation heater being installed in the first tray case.

17. The ice maker of claim 16, wherein the first tray case includes a portion contacting the deformation resistance reinforcement wall of the first tray.

18. The ice maker of claim 15, further comprising a cover including:

a first wall having a surface that supports the bracket;

a third wall spaced apart from the first wall of the cover; and a second wall connecting the first wall of the cover and the third wall of the cover, wherein the second wall of the cover and the third wall of the cover defines an accommodation space where a pusher is disposed at a liquid supply position.

19. The ice maker of claim 9, further comprising a cover including:

a first wall having a surface that supports the bracket;

a third wall spaced apart from the first wall of the cover; and a second wall connecting the first wall of the cover and the third wall of the cover, wherein the second wall of the cover and the third wall of the cover defines an accommodation space where a pusher is disposed at a liquid supply position.

20. A refrigerator comprising:

a storage chamber including a space for storing food; and the ice maker according to the claim 9.

* * * * *